US012622523B2

(12) United States Patent
Fischer et al.

(10) Patent No.: US 12,622,523 B2
(45) Date of Patent: May 12, 2026

(54) CHAIR ASSEMBLY

(71) Applicant: Dick's Sporting Goods, Inc., Coraopolis, PA (US)

(72) Inventors: Daniel Fischer, Pittsburgh, PA (US); Anthony J. Koch, Mckees Rocks, PA (US); Chinawut Paesang, Sewickley, PA (US); Nathan Quince, Imperial, PA (US); Craig Hofmann, Pittsburgh, PA (US); Casper Crouse, Coraopolis, PA (US); David Vogler, Rochester, NY (US); Robert James Fulbright, Pittsburgh, PA (US)

(73) Assignee: DICK'S SPORTING GOODS, INC., Coraopolis, PA (US)

( * ) Notice: Subject to any disclaimer, the term of this patent is extended or adjusted under 35 U.S.C. 154(b) by 133 days.

(21) Appl. No.: 18/529,869

(22) Filed: Dec. 5, 2023

(65) Prior Publication Data

US 2025/0176725 A1 Jun. 5, 2025

(51) Int. Cl.
*A47C 4/28* (2006.01)
*A47C 1/032* (2006.01)
(Continued)

(52) U.S. Cl.
CPC ..... *A47C 7/004* (2013.01); *A47C 1/03255* (2013.01); *A47C 3/18* (2013.01); *A47C 4/286* (2013.01); *A47C 1/03277* (2013.01)

(58) Field of Classification Search
CPC ..... A47C 4/286; A47C 1/03277
See application file for complete search history.

(56) References Cited

U.S. PATENT DOCUMENTS 1,344,431 A 6/1920 Albertie
2,828,801 A 4/1958 Papst
(Continued)

FOREIGN PATENT DOCUMENTS

CN 106714619 A 5/2017
DE 20012517 U1 2/2001
(Continued)

OTHER PUBLICATIONS

Patio Master Corporation, Patio Master Corporation Sienna Swivel Rocker (Set of 2)(Gray), Amazon.com, https://www.amazon.com/Patio-Master-Corporation-Sienna-Swivel/dp/B07JYQ64MZ/ref=sr_1_6?crid=20OXSAZWHF3KJ&keywords=patio swivel rocker&qid=1641826980&sprefix=patio swivel rocker%2Caps%2C70&sr=8-6 [accessed Nov. 15, 2023].
(Continued)

*Primary Examiner* — Rodney B White
(74) *Attorney, Agent, or Firm* — Foley & Lardner LLP

(57) ABSTRACT

A frame assembly for a chair assembly includes a base assembly, a joint assembly, and a seat assembly. The base assembly includes a first leg and a base mount. The base mount includes a mounting aperture and a first base coupler. The first base coupler is coupled to the first leg and facilitates rotation of the first leg. The joint assembly includes a joint mount, a mounting arm, and a first deflection plate. The joint mount includes a mounting post inserted within the mounting aperture. The mounting arm includes a support arm coupled to the joint mount and a suspension arm coupled to the support arm. The first deflection plate is coupled to the suspension arm and extends over the joint mount.

20 Claims, 53 Drawing Sheets

(51) Int. Cl.

| | |
|---|---|
| ***A47C 1/033*** | (2006.01) |
| ***A47C 3/18*** | (2006.01) |
| ***A47C 7/00*** | (2006.01) |

(56) References Cited

U.S. PATENT DOCUMENTS

| | | | | |
|---|---|---|---|---|
| 3,745,937 | A | 7/1973 | Gail | |
| 4,119,343 | A | 10/1978 | Pentzien | |
| 5,039,164 | A | 8/1991 | Gibbs | |
| 5,599,064 | A | 2/1997 | Vanderminden | |
| 5,611,594 | A | 3/1997 | Findlay | |
| 7,175,232 | B2 | 2/2007 | Rivera | |
| 7,841,660 | B2 | 11/2010 | Wang et al. | |
| 8,141,944 | B2 * | 3/2012 | Reeb | A47C 9/105 297/45 X |
| 8,979,184 | B2 * | 3/2015 | Stafford | A47C 9/105 297/16.2 |
| 9,066,597 | B2 * | 6/2015 | Lee | A47C 4/42 |
| 9,339,115 | B2 * | 5/2016 | Lee | A47C 4/02 |
| 9,854,914 | B2 * | 1/2018 | Yoo | A47C 4/286 |
| 10,010,179 | B1 * | 7/2018 | Stump | A47C 4/44 |
| 10,070,728 | B2 | 9/2018 | Piretti | |
| 10,149,545 | B2 * | 12/2018 | Bergling | A47D 9/005 |
| 10,531,739 | B2 | 1/2020 | Ostwald et al. | |
| 10,548,399 | B2 * | 2/2020 | Humphreys | A47C 1/027 |
| 10,874,217 | B2 | 12/2020 | Grace | |
| 11,439,238 | B1 * | 9/2022 | Wang | A47C 4/286 |
| 11,700,943 | B1 * | 7/2023 | Wang | A47C 4/286 297/16.2 |
| 11,737,564 | B2 * | 8/2023 | Chen | A47C 4/286 297/47 |
| 11,786,041 | B1 * | 10/2023 | Chen | A47C 4/42 297/16.1 |
| 11,844,439 | B1 * | 12/2023 | Wang | A47C 3/40 |
| 11,864,660 | B1 * | 1/2024 | Wang | F16M 11/242 |
| 11,871,848 | B1 * | 1/2024 | Wang | A47C 4/286 |
| 11,937,709 | B2 * | 3/2024 | Xu | A47B 3/12 |
| 11,980,292 | B1 * | 5/2024 | Wang | A47C 7/14 |
| 11,980,296 | B2 * | 5/2024 | Kim | A47C 3/12 |
| 11,986,099 | B2 * | 5/2024 | Garcia | A47C 4/28 |
| 11,986,103 | B1 * | 5/2024 | Li | A47C 4/30 |
| 12,059,079 | B1 * | 8/2024 | Chen | A47C 4/286 |
| 12,075,919 | B2 * | 9/2024 | Fulbright | A47C 4/286 |
| 12,127,687 | B1 * | 10/2024 | Zhang | A47C 4/30 |
| 12,185,831 | B2 * | 1/2025 | Xu | A47B 13/02 |
| 12,185,843 | B2 * | 1/2025 | Yuan | A47C 4/286 |
| 12,349,806 | B1 * | 7/2025 | Wang | A47C 3/025 |
| 12,419,422 | B2 * | 9/2025 | Zhang | A47C 4/286 |
| 12,520,942 | B1 * | 1/2026 | Zhang | A47C 3/03 |
| 2002/0117878 | A1 * | 8/2002 | Fox | A47C 4/286 297/16.2 |
| 2009/0174233 | A1 * | 7/2009 | Hoffman | A47C 4/286 297/16.2 |
| 2010/0314926 | A1 | 12/2010 | Chesness | |
| 2011/0156449 | A1 * | 6/2011 | Obolewicz | A47C 4/286 297/16.2 |
| 2011/0254325 | A1 * | 10/2011 | Obolewicz | A47C 4/286 297/16.2 |
| 2011/0285192 | A1 | 11/2011 | Holt et al. | |
| 2012/0274107 | A1 | 11/2012 | Chesness | |
| 2012/0306249 | A1 * | 12/2012 | Jung | A47C 3/026 297/313 |
| 2014/0306493 | A1 | 10/2014 | Obolewicz et al. | |
| 2015/0189994 | A1 * | 7/2015 | Lee | A47C 4/30 297/16.1 |
| 2015/0233522 | A1 * | 8/2015 | Kallas | F16M 11/2021 403/322.2 |
| 2019/0029429 | A1 | 1/2019 | Browning et al. | |
| 2019/0231075 | A1 * | 8/2019 | Browning | A47C 4/286 |
| 2021/0153657 | A1 | 5/2021 | Cook et al. | |
| 2021/0317942 | A1 * | 10/2021 | Mendo | F16M 11/245 |
| 2022/0039556 | A1 | 2/2022 | Fulbright et al. | |
| 2022/0175141 | A1 | 6/2022 | Zhu | |
| 2022/0225773 | A1 | 7/2022 | Sun et al. | |
| 2023/0023969 | A1 * | 1/2023 | Zhu | A47C 4/286 |
| 2024/0415286 | A1 * | 12/2024 | Zhu | A47C 4/46 |
| 2025/0040711 | A1 | 2/2025 | Cook | |
| 2025/0127304 | A1 * | 4/2025 | Tang | A47C 4/286 |

FOREIGN PATENT DOCUMENTS

| | | | |
|---|---|---|---|
| WO | WO-00/48487 | A1 | 8/2000 |
| WO | WO-2005/055769 | A2 | 6/2005 |

OTHER PUBLICATIONS

Office Action in CN Application No. 202180055601.1 dated Aug. 6, 2025, 23 pgs. (with translation).

* cited by examiner

CHAIR ASSEMBLY

TECHNICAL FIELD

The present application relates generally to chair assemblies.

BACKGROUND

Chairs may be collapsible and may include a seat portion and a base portion. The seat portion may rotate in multiple directions relative to the base portion. Chairs may be constructed from tubular members. The tubular members can include bends to facilitate creation of various shapes. Chairs can include a cover that is attached to the seat portion and the base portion. Chairs can be configured such that the cover provides a seat.

SUMMARY

In one set of embodiments, a frame assembly for a chair assembly includes a base assembly, a joint assembly, and a seat assembly. The base assembly includes a first leg and a base mount. The base mount includes a mounting aperture and a first base coupler. The first base coupler is coupled to the first leg and facilitates rotation of the first leg. The joint assembly includes a joint mount, a mounting arm, and a first deflection plate. The joint mount includes a mounting post inserted within the mounting aperture. The mounting arm includes a support arm coupled to the joint mount and a suspension arm coupled to the support arm. The first deflection plate is coupled to the suspension arm and extends over the joint mount. The seat assembly includes a frame plate, a first arm assembly, a second arm assembly, a first back assembly, and a second back assembly. The frame plate is coupled to the first deflection plate. The first arm assembly is coupled to the frame plate. The second arm assembly is coupled to the frame plate. The first back assembly is coupled to the frame plate. The second back assembly is coupled to the frame plate.

In another set of embodiments, a chair assembly includes a frame assembly and a cover. The frame assembly includes a joint assembly and a seat assembly. The joint assembly includes a joint mount, a mounting arm, and a deflection plate. The mounting arm includes a support arm that is coupled to the joint mount and a suspension arm coupled to the support arm. The deflection plate is coupled to the suspension arm and extends over the joint mount. The seat assembly includes a frame plate, a first arm assembly, a second arm assembly, a first back assembly, and a second back assembly. The frame plate is coupled to the deflection plate. The frame plate includes a first arm joint coupler, a second arm joint coupler, a first back joint coupler, and a second back joint coupler. The first arm assembly is coupled to the first arm joint coupler and rotatable relative to the frame plate. The second arm assembly is coupled to the second arm joint coupler and rotatable relative to the frame plate. The first back assembly is coupled to the first back joint coupler and rotatable relative to the frame plate. The second back assembly is coupled to the second back joint coupler and rotatable relative to the frame plate. The cover is coupled to the first arm assembly, the second arm assembly, the first back assembly, and the second back assembly.

BRIEF DESCRIPTION OF THE DRAWINGS

The details of one or more implementations are set forth in the accompanying drawing and the description below.

Other features, aspects, and advantages of the disclosure will become apparent from the description, the drawing, and the claims, in which:

It will be recognized that the Figures are schematic representations for purposes of illustration. The Figures are provided for the purpose of illustrating one or more implementations with the explicit understanding that the Figures will not be used to limit the scope or the meaning of the claims.

DETAILED DESCRIPTION

Following below are more detailed descriptions of various concepts related to, and implementations of, methods, apparatuses, and systems for providing a chair assembly. The various concepts introduced above and discussed in greater detail below may be implemented in any of a number of ways, as the described concepts are not limited to any particular manner of implementation. Examples of specific implementations and applications are provided primarily for illustrative purposes.

I. First Example Chair Assembly

Figure 1:
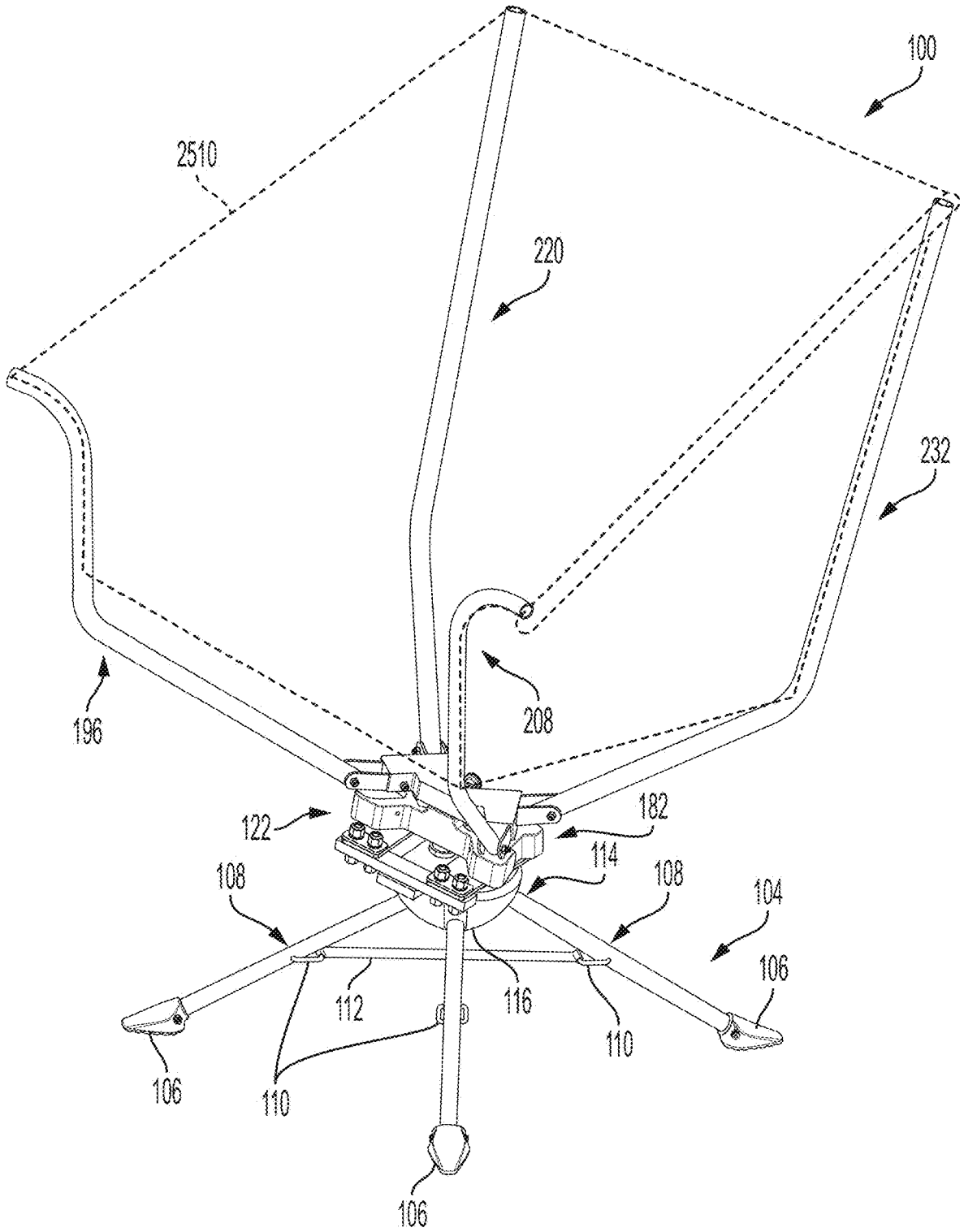
FIG. 1 is a perspective view of a chair assembly.
Figure 2:
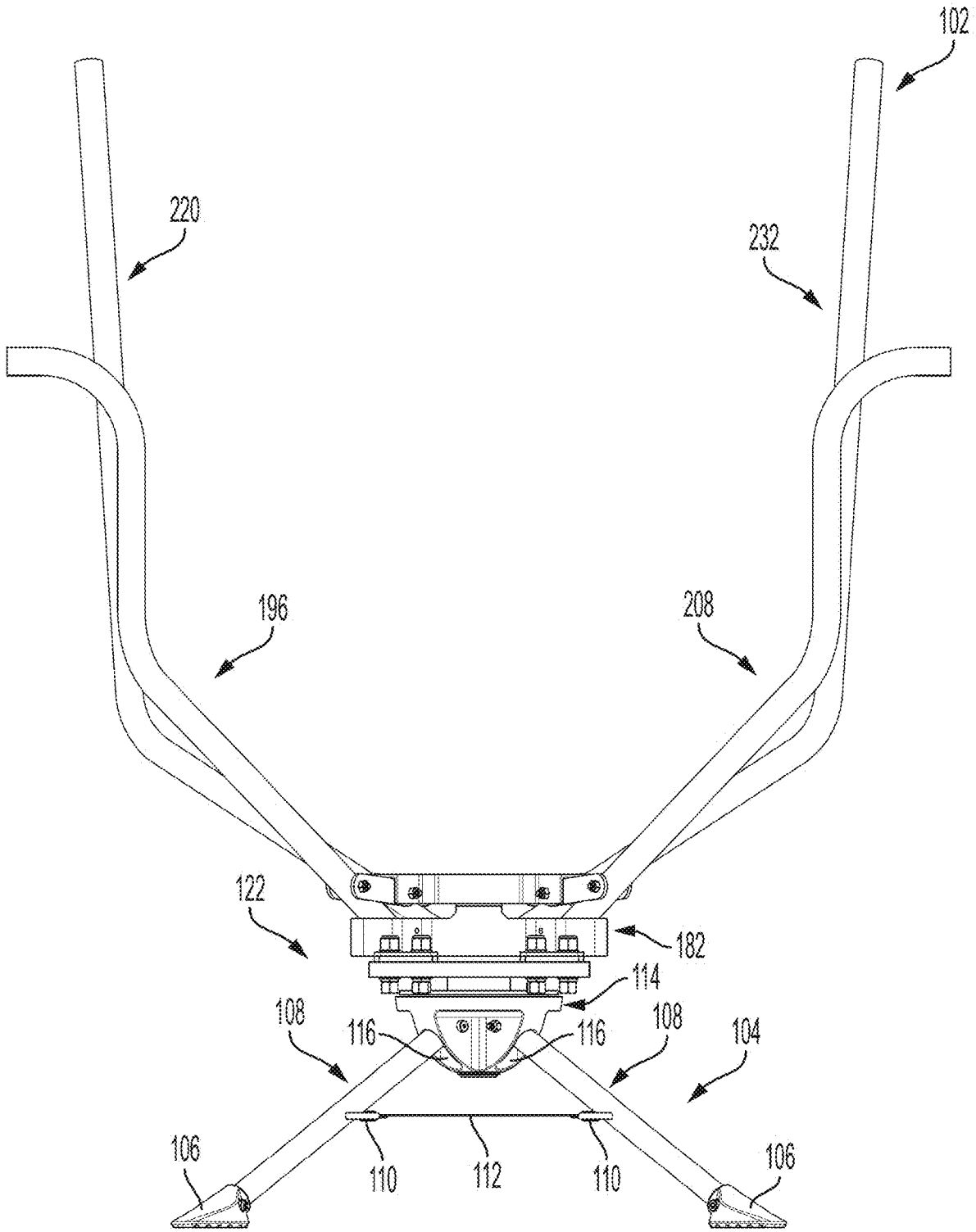
FIG. 2 is a front view of a frame assembly for the chair assembly in an expanded state.
Figure 3:
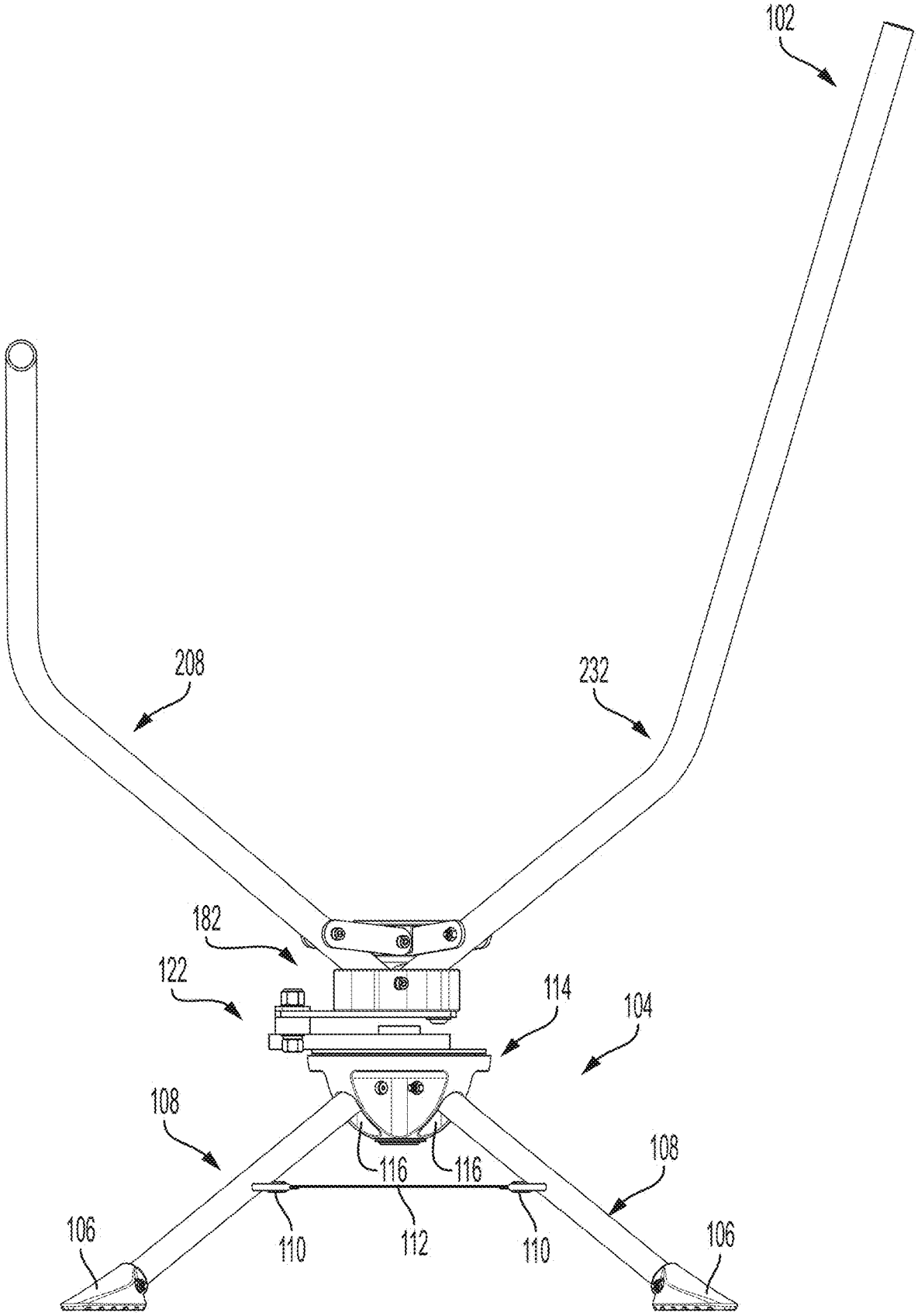
FIG. 3 is a side view of the frame assembly in the expanded state.
Figure 4:
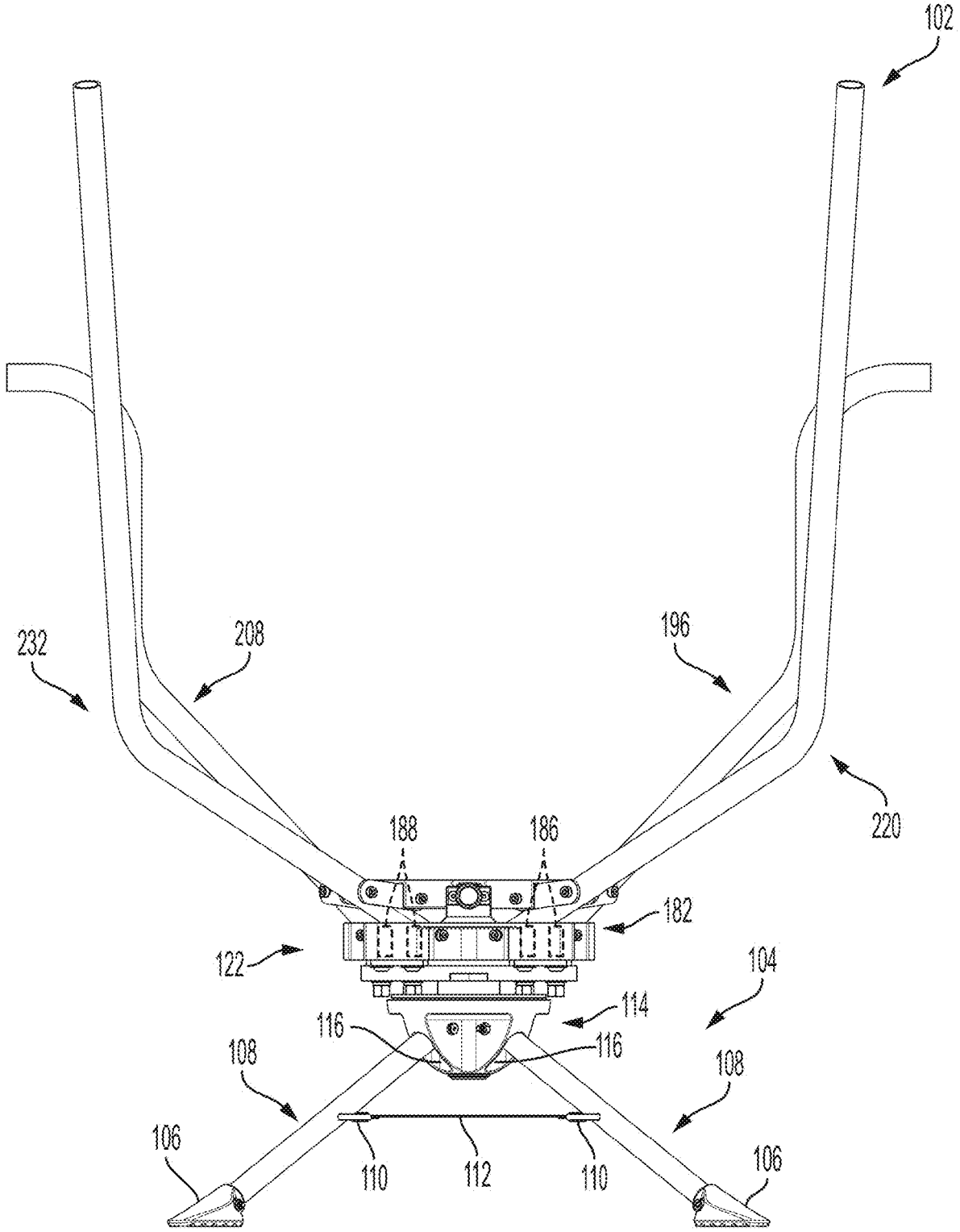
FIG. 4 is a rear view of the frame assembly in the expanded state.
Figure 5:
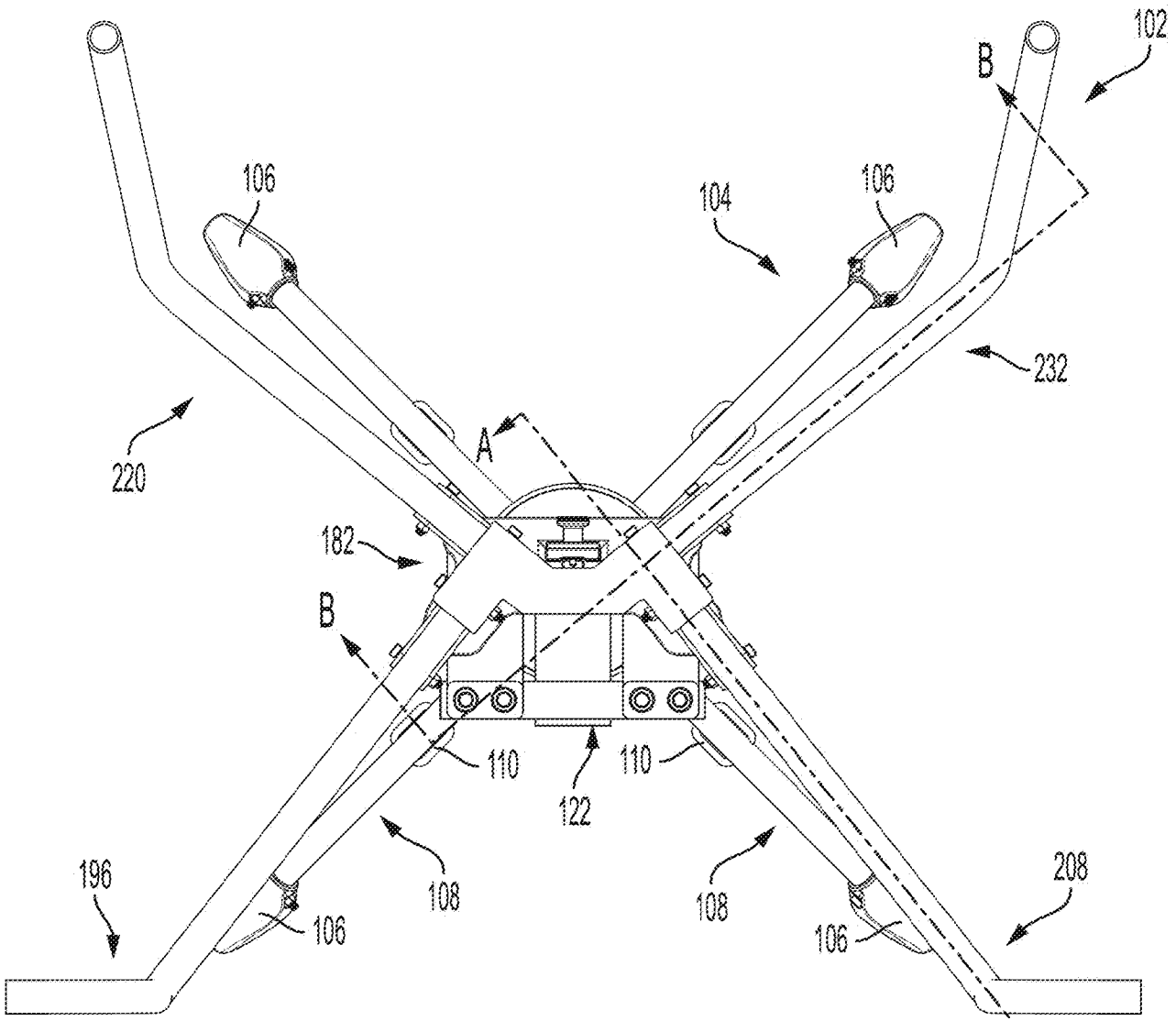
FIG. 5 is a top view of the frame assembly in the expanded state.

FIG. 1 depicts an example chair assembly 100 (e.g., collapsible chair assembly, foldable chair assembly, etc.). The chair assembly 100 may be utilized to support a user (e.g., occupant, human, adult, child, etc.) in a seated (e.g., upright, reclined, etc.) position. As is explained in more detail herein, the chair assembly 100 facilitates rocking (e.g., inclining, etc.) of the user relative to a ground surface. In this way, the chair assembly 100 provides additional functionality relative to other chairs that do not facilitate rocking. For example, the chair assembly 100 may be more comfortable or ergonomic. Additionally, the chair assembly 100 may enable use in certain applications such as soothing an infant (e.g., baby).

The chair assembly 100 is operable between a collapsed state (e.g., folded state, travel state, etc.) and an expanded state (e.g., deployed state, supporting state, etc.). A user may, for example, store (e.g., stow, etc.) the chair assembly 100 in the collapsed state (e.g., in a vehicle, etc.) and then subsequently utilize the chair assembly 100 in the expanded state. In this way, the chair assembly 100 may be stored in a smaller space than other chairs that do not collapse.

As shown in FIG. 1, the chair assembly 100 includes a frame assembly 102 (e.g., support assembly, etc.). As is described in more detail herein, the frame assembly 102 is configured to provide structural support for the user when the chair assembly 100 is in the expanded state.

The frame assembly 102 includes a base assembly 104 (e.g., leg assembly, etc.). The base assembly 104 separates the user from the ground surface. The base assembly 104 does not rock relative to the ground surface when the user is rocked. Rather, the base assembly 104 remains stationary during rocking.

The base assembly 104 includes a plurality of feet 106 (e.g., shoes, cleats, etc.). The feet 106 contact the ground surface. In various embodiments, one or more of the feet 106 include a textured surface that is configured to engage the ground surface so as to resist movement of the foot 106 relative to the ground surface. The feet 106 may be constructed of plastic or rubber, for example.

The base assembly 104 also includes a plurality of legs 108 (e.g., struts, etc.). Each of the legs 108 is coupled to one of the feet 106. When the chair assembly 100 is in the expanded state, the legs 108 extend vertically and horizontally (e.g., relative to a direction of gravity, etc.). The legs 108 also convey force (e.g., due to a weight of the user, etc.) to the feet 106 and therefore to the ground surface.

Each of the legs 108 includes a brace connector 110 (e.g., hook, eyelet, etc.). As is explained in more detail herein, the brace connector 110 facilitates creation of a link (e.g., connection, etc.) between two or more of the legs 108.

The base assembly 104 also includes a plurality of braces 112. Each of the braces 112 is coupled to two of the brace connectors 110 (e.g., an opposing pair of the brace connectors 110, etc.). Each of the braces 112 is configured to limit movement of one of the legs 108 relative to at least one other leg 108. In this way, the braces 112 can cooperate to provide a maximum spread of the legs 108 (e.g., footprint of the chair assembly 100, etc.) when the chair assembly 100 is in the expanded state. In some embodiments, the braces 112 are flexible. For example, the braces 112 may be constructed from fabric, rubber, wire, chain, or other flexible material.

The base assembly 104 also includes a base mount 114 (e.g., base, hub, etc.). The base mount 114 includes a plurality of base couplers 116 (e.g., sockets, etc.). Each of the base couplers 116 is coupled to one of the legs 108 (e.g., via a fastener, etc.). Each of the base couplers 116 facilitates rotation of one of the legs 108 relative to the base mount 114. In this way, the base mount 114 facilitate collapsing of the legs 108 when transitioning the chair assembly 100 from the expanded state to the collapsed state, for example.

Figure 16:
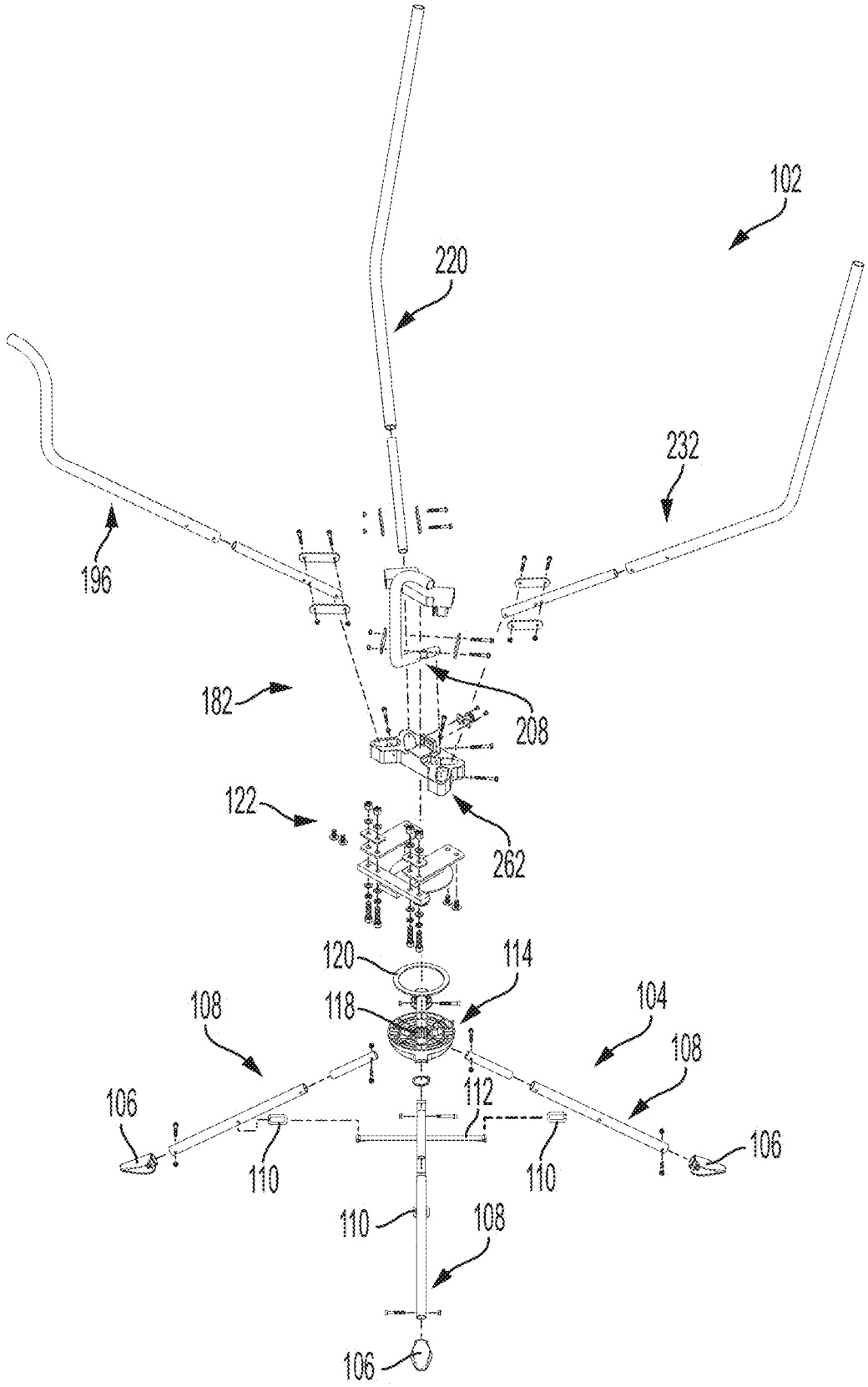
FIG. 16 is an exploded view of the frame assembly.
Figure 19:
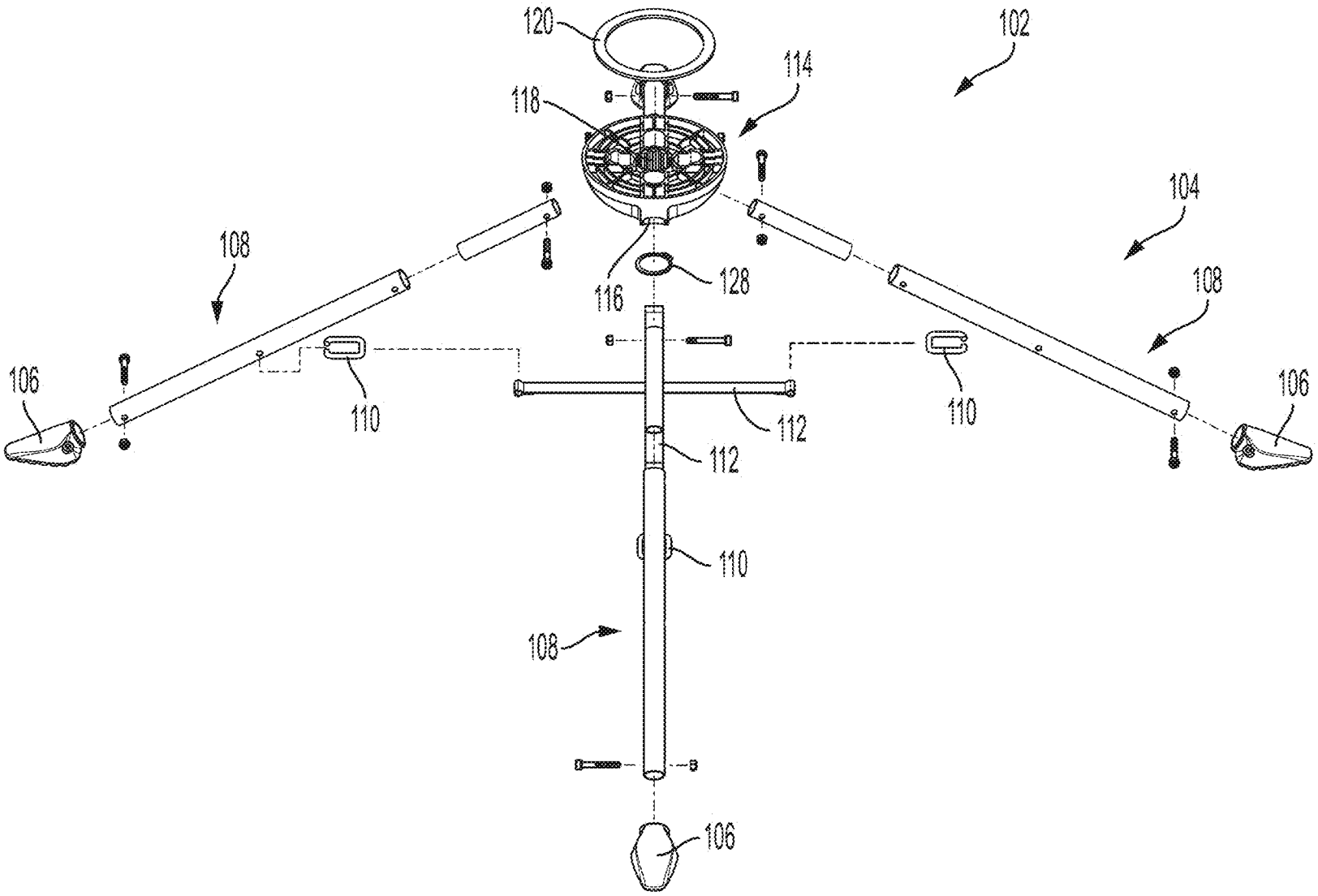
FIG. 19 is another portion of the exploded view shown in FIG. 16.

As shown in FIGS. 16 and 19, the base mount 114 also includes a mounting aperture 118 (e.g., socket, hole, etc.). The mounting aperture 118 is formed in a body of the base mount 114. As is explained in more detail herein, the mounting aperture 118 is configured to facilitate rotation of the user relative to the ground surface about an axis of rotation. The base assembly 104 also includes a shim 120

(e.g., gasket, etc.). Similar to the mounting aperture 118, the shim 120 is configured to facilitate rotation of the user relative to the base mount 114. For example, the shim 120 may decrease wear (e.g., due to friction, etc.) on the base mount 114, thereby facilitating prolonged desirable operation of the chair assembly 100. In various embodiments, the shim 120 is made from high density polyethylene.

The frame assembly 102 also includes a joint assembly 122 (e.g., rocking assembly, etc.). As is explained in more detail herein, the joint assembly 122 is configured to facilitate rocking of the user relative to the base assembly 104, and therefore relative to the ground surface upon which the base assembly 104 is positioned. The joint assembly 122 is shown in greater detail in FIG. 18, for example.

The joint assembly 122 includes a joint mount 125 (e.g., mounting plate, etc.). The joint mount 125 is supported on the base mount 114 over the mounting aperture 118. In some embodiments, a shape (e.g., circular, etc.) and a size (e.g., diameter, area, etc.) of the joint mount 125 are the same as a shape and a size of the base mount 114. The joint mount 125 includes a mounting post 126 (e.g., pin, column, protrusion, etc.). The mounting post 126 extends from a body of the joint mount 125. The mounting post 126 is configured to be received within the mounting aperture 118.

The joint assembly 122 also includes a mounting post retainer 128 (e.g., clip, etc.). The mounting post retainer 128 is configured to be coupled to the mounting post 126 and to cooperate with the base mount 114 to retain the mounting post 126 in the mounting aperture 118. The mounting post 126 includes a retainer groove 130 (e.g., cavity, etc.). The retainer groove 130 is positioned on an end of a body of the mounting post 126 such that the retainer groove 130 is exposed when the mounting post 126 is received within the mounting aperture 118. The mounting post retainer 128 is received within the retainer groove 130, thereby coupling the mounting post 126 to the base mount 114. In various embodiments, the mounting post retainer 128 is a C-clip retainer.

The joint assembly 122 is coupled to the base assembly 104 through a coupling between the joint mount 125 and the base mount 114 when the mounting post 126 is received within the mounting aperture 118 and the mounting post retainer 128 is received within the retainer groove 130. By removing the mounting post retainer 128 from the retainer groove 130, the joint assembly 122 may be removed from the base assembly 104 (e.g., for replacement of the joint assembly 122, for replacement of the base assembly 104, etc.).

The joint assembly 122 also includes a mounting arm 132 (e.g., brace, etc.). The mounting arm 132 extends from a body of the joint mount 125. In various embodiments, the mounting arm 132 extends beyond the base mount 114. In various embodiments, the mounting arm 132 is T-shaped (e.g., capital T shaped, lowercase t shaped, cross shaped, etc.).

Figure 18:
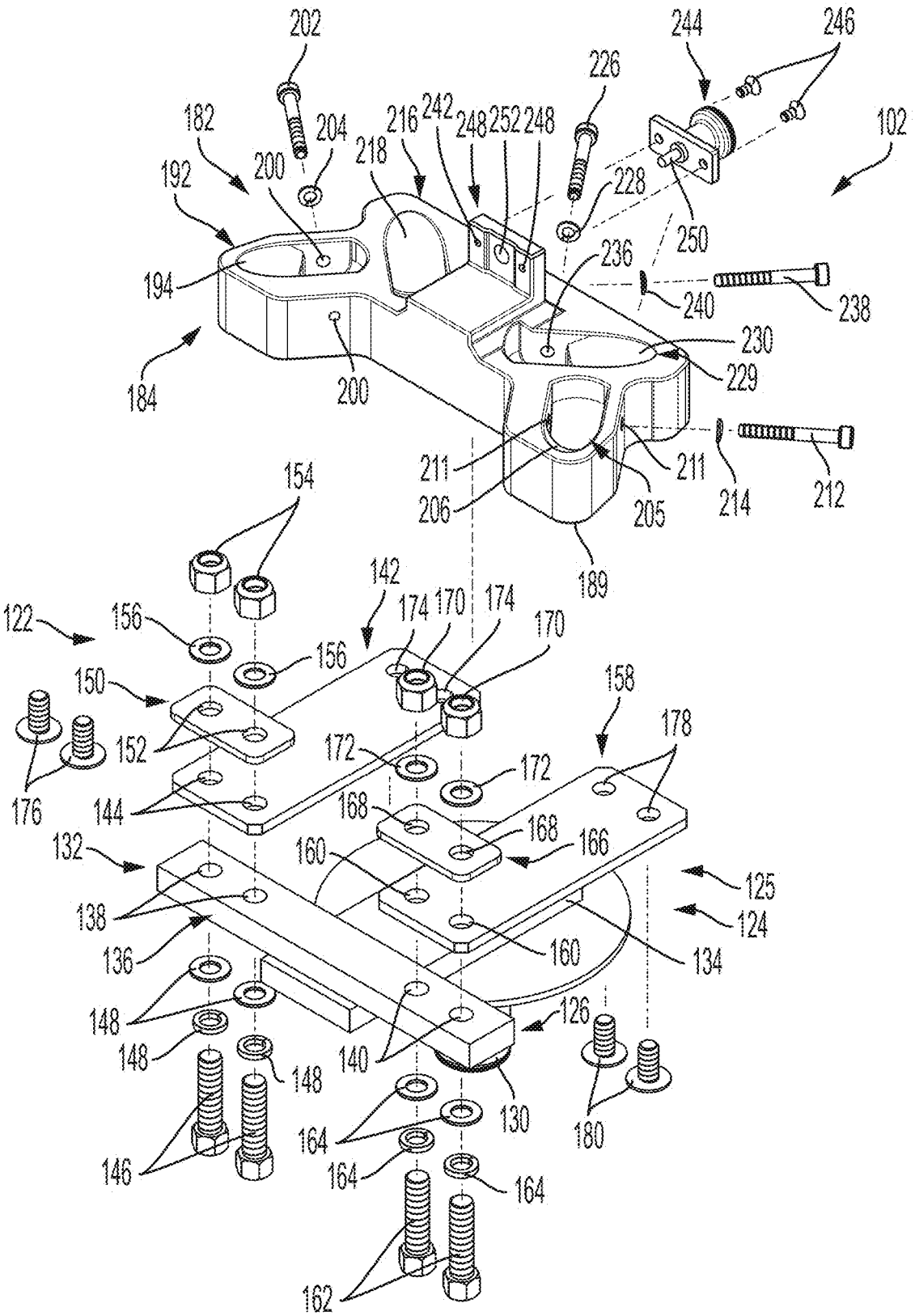
FIG. 18 is another portion of the exploded view shown in FIG. 16.

The mounting arm 132 includes a support arm 134 (e.g., lower arm, etc.). The support arm 134 is coupled to the body of the joint mount 124. In various embodiments, such as is shown in FIG. 18, the support arm 134 extends over the mounting aperture 118, and therefore across the axis of rotation of the chair assembly 100. In some embodiments, the support arm 134 is coupled to the mounting post 126. The mounting post 126 may, for example, extends through an aperture in the support arm 134 and be welded to the support arm 134.

The mounting arm 132 also includes a suspension arm 136 (e.g., upper arm, etc.). The suspension arm 136 is coupled to the support arm 134 and separated from the joint mount 125 by the support arm 134. In various embodiments, such as is shown in FIG. 18, the suspension arm 136 is coupled to a first side of the support arm 134 and a second side of the support arm 134 is coupled to the joint mount 124.

The suspension arm 136 includes first arm apertures 138 (e.g., holes, etc.). As is explained in more detail herein, the first arm apertures 138 are configured to facilitate coupling of additional components of the joint assembly 122 to the suspension arm 136. In some embodiments, at least a portion of at least one of the first arm apertures 138 is threaded (e.g., include threaded inserts, have been tapped to include threads, etc.).

The suspension arm 136 includes second arm apertures 140 (e.g., holes, etc.). As is explained in more detail herein, the second arm apertures 140 are configured to facilitate coupling of additional components of the joint assembly 122 to the suspension arm 136. In some embodiments, at least a portion of at least one of the second arm apertures 140 is threaded. The suspension arm 136 may have a first end and a second end opposite the first end, and the first arm apertures 138 may be disposed proximate the first end while the second arm apertures 140 are disposed proximate the second end.

The joint assembly 122 also includes a first deflection plate 142. As is explained in more detail herein, the first deflection plate 142 deflects (e.g., bends, elastically deforms, etc.) relative to the suspension arm 136 so as to facilitate rocking of the user. The first deflection plate 142 is constructed so as to have mechanical properties (e.g., modulus of elasticity, Young's modulus, etc.) that facilitate rocking of the user. A material and/or a shape of the first deflection plate 142 may be selected so as to facilitate rocking of the user. In some embodiments, the first deflection plate 142 is constructed from a spring steel (e.g., 1070 steel, 1074 steel, 1075 steel, 1080 steel, 1095 steel, 5160 steel, etc.).

The first deflection plate 142 includes first deflection plate arm apertures 144 (e.g., holes, etc.). As is explained in more detail herein, the first deflection plate arm apertures 144 are configured to facilitate coupling of the first deflection plate 142 to the suspension arm 136. In some embodiments, at least a portion of at least one of the first deflection plate arm apertures 144 is threaded.

The joint assembly 122 also includes first arm fasteners 146 (e.g., screws, bolts, etc.). Each of the first arm fasteners 146 couples the suspension arm 136 to the first deflection plate 142. Each of the first arm fasteners 146 extends through one of the first arm apertures 138 and through one of the first deflection plate arm apertures 144. In various embodiments, the joint assembly 122 also includes first arm washers 148 (e.g., spacers, etc.). One or more of the first arm washers 148 may be positioned between each of the first arm fasteners 146 and the suspension arm 136.

The joint assembly 122 also includes a first load plate 150 (e.g., distribution plate, etc.). As is explained in more detail herein, the first load plate 150 is configured to facilitate distribution of force between the first arm fasteners 146 thereby mitigating stress concentration at one of the first arm fasteners 146. In this way, the first load plate 150 may mitigate failure of the joint assembly 122 and facilitate prolonged desirable operation of the chair assembly 100. The first load plate 150 includes first load plate apertures 152 (e.g., holes, etc.). As is explained in more detail herein, the first load plate apertures 152 are configured to facilitate coupling of the first load plate 150 to the first deflection plate 142. In some embodiments, at least a portion of at least one of the first load plate apertures 152 is threaded. Each of the first arm fasteners 146 extends through one of the first load plate apertures 152.

The joint assembly 122 also includes first joint nuts 154. Each of the first joint nuts 154 is coupled to one of the first arm fasteners 146 and facilitates coupling of the first load plate 150, the first deflection plate 142, and the suspension arm 136. In various embodiments, the joint assembly 122 also includes first load plate washers 156 (e.g., spacers, etc.). One or more of the first load plate washers 156 may be positioned between the first load plate 150 and one of the first joint nuts 154.

The joint assembly 122 also includes a second deflection plate 158. As is explained in more detail herein, the second deflection plate 158 deflects relative to the suspension arm 136 so as to facilitate rocking of the user. The second deflection plate 158 is constructed so as to have mechanical properties that facilitate rocking of the user. A material and/or a shape of the second deflection plate 158 may be selected so as to facilitate rocking of the user. In some embodiments, the second deflection plate 158 is constructed from a spring. In various embodiments, the mechanical properties, the material, and/or the shape of the first deflection plate 142 and the second deflection plate 158 are the same. For example, the first deflection plate 142 may be identical to the second deflection plate 158.

The second deflection plate 158 includes second deflection plate arm apertures 160 (e.g., holes, etc.). As is explained in more detail herein, the second deflection plate arm apertures 160 are configured to facilitate coupling of the second deflection plate 158 to the suspension arm 136. In some embodiments, at least a portion of at least one of the second deflection plate arm apertures 160 is threaded. The second deflection plate 158 is separated from the first deflection plate 142 by a portion of the suspension arm 136 (e.g., a portion of the suspension arm 136 extends between the first deflection plate 142 and the second deflection plate 158, etc.).

The joint assembly 122 also includes second arm fasteners 162 (e.g., screws, bolts, etc.). Each of the second arm fasteners 162 couples the suspension arm 136 to the second deflection plate 158. Each of the second arm fasteners 162 extends through one of the second arm apertures 140 and through one of the second deflection plate arm apertures 160. In various embodiments, the joint assembly 122 also includes second arm washers 164 (e.g., spacers, etc.). One or more of the second arm washers 164 may be positioned between each of the second arm fasteners 162 and the suspension arm 136.

The joint assembly 122 also includes a second load plate 166 (e.g., distribution plate, etc.). As is explained in more detail herein, the second load plate 166 is configured to facilitate distribution of force between the second arm fasteners 162 thereby mitigating stress concentration at one of the second arm fasteners 162. In this way, the second load plate 166 may mitigate failure of the joint assembly 122 and facilitate prolonged desirable operation of the chair assembly 100. The second load plate 166 includes second load plate apertures 168 (e.g., holes, etc.). As is explained in more detail herein, the second load plate apertures 168 are configured to facilitate coupling of the second load plate 166 to the second deflection plate 158. In some embodiments, at least a portion of at least one of the second load plate apertures 168 is threaded. Each of the second arm fasteners 162 extends through one of the second load plate apertures 168.

The joint assembly 122 also includes second joint nuts 170. Each of the second joint nuts 170 is coupled to one of the second arm fasteners 162 and facilitates coupling of the second load plate 166, the second deflection plate 158, and the suspension arm 136. In various embodiments, the joint assembly 122 also includes second load plate washers 172 (e.g., spacers, etc.). One or more of the second load plate washers 172 may be positioned between the second load plate 166 and one of the second joint nuts 170.

The first deflection plate 142 also includes first deflection plate seat apertures 174 (e.g., holes, etc.). As is explained in more detail herein, the first deflection plate seat apertures 174 are configured to facilitate coupling of the first deflection plate 142 to additional components of the frame assembly 102. In some embodiments, at least a portion of at least one of the first deflection plate seat apertures 174 is threaded. The first deflection plate 142 may have a first end and a second end opposite the first end, and the first deflection plate arm apertures 144 may be disposed proximate the first end while the first deflection plate seat apertures 174 are disposed proximate the second end.

The joint assembly 122 also includes first seat joint fasteners 176 (e.g., screws, bolts, etc.). Each of the first seat joint fasteners 176 extends through one of the first deflection plate seat apertures 174. As is explained in more detail herein, the first seat joint fasteners 176 are configured to facilitate coupling of the first deflection plate 142 to additional components of the frame assembly 102.

The first deflection plate 142 also includes first deflection plate seat apertures 174 (e.g., holes, etc.). As is explained in more detail herein, the first deflection plate seat apertures 174 are configured to facilitate coupling of the first deflection plate 142 to additional components of the frame assembly 102. In some embodiments, at least a portion of at least one of the first deflection plate seat apertures 174 is threaded. The first deflection plate 142 may have a first end and a second end opposite the first end, and the first deflection plate arm apertures 144 may be disposed proximate the first end while the first deflection plate seat apertures 174 are disposed proximate the second end.

The joint assembly 122 also includes first seat joint fasteners 176 (e.g., screws, bolts, etc.). Each of the first seat joint fasteners 176 extends through one of the first deflection plate seat apertures 174. As is explained in more detail herein, the first seat joint fasteners 176 are configured to facilitate coupling of the first deflection plate 142 to additional components of the frame assembly 102.

The second deflection plate 158 also includes second deflection plate seat apertures 178 (e.g., holes, etc.). As is explained in more detail herein, the second deflection plate seat apertures 178 are configured to facilitate coupling of the second deflection plate 158 to additional components of the frame assembly 102. In some embodiments, at least a portion of at least one of the second deflection plate seat apertures 178 is threaded. The second deflection plate 158 may have a first end and a second end opposite the first end, and the second deflection plate arm apertures 160 may be disposed proximate the first end while the second deflection plate seat apertures 178 are disposed proximate the second end.

The joint assembly 122 also includes second seat joint fasteners 180 (e.g., screws, bolts, etc.). Each of the second seat joint fasteners 180 extends through one of the second deflection plate seat apertures 178. As is explained in more detail herein, the second seat joint fasteners 180 are configured to facilitate coupling of the second deflection plate 158 to additional components of the frame assembly 102.

The frame assembly 102 also includes a seat assembly 182 (e.g., support assembly, etc.). As is explained in more detail herein, the seat assembly 182 is configured to facilitate support of the user relative to the base assembly 104 and the joint assembly 122, and therefore relative to the ground surface upon which the base assembly 104 is positioned. The seat assembly 182 is shown in greater detail in FIG. 17, for example.

The seat assembly 182 includes a frame plate 184 (e.g., base, hub, etc.). As is explained in more detail herein, the frame plate 184 is configured to facilitate transitioning the chair assembly 100 from the expanded state to the collapsed state, for example. The frame plate 184 includes first frame plate apertures 186 (e.g., holes, etc.). Each of the first seat joint fasteners 176 extends through one of the first deflection plate seat apertures 174 and one of the first frame plate apertures 186 to couple the first deflection plate 142, and therefore the joint assembly 122, to the frame plate 184, and therefore the seat assembly 182. The frame plate 184 also includes second frame plate apertures 188 (e.g., holes, etc.). Each of the second seat joint fasteners 180 extends through one of the second deflection plate seat apertures 178 and one of the second frame plate apertures 188 to couple the second deflection plate 158, and therefore the joint assembly 122, to the frame plate 184, and therefore the seat assembly 182.

The frame plate 184 includes a frame plate mounting surface 189 (e.g., face, etc.). At least one of the first frame plate apertures 186 and/or at least one of the second frame plate apertures 188 is disposed on the frame plate mounting surface 189. In various embodiments, the first frame plate apertures 186 and the second frame plate apertures 188 are disposed on the frame plate mounting surface 189.

The frame plate mounting surface 189 is planar (e.g., disposed along a single plane, etc.) and is disposed on a mounting plane 190. In various embodiments, the frame assembly 102 and the seat assembly 182 are configured such that the mounting plane 190 is approximately (e.g., within 5% of, etc.) parallel to a plane along which the ground surface is disposed.

The frame plate 184 also includes a first arm joint coupler 192 (e.g., socket, etc.). The first arm joint coupler 192 is a recess (e.g., depression, etc.) in the frame plate 184. The first arm joint coupler 192 includes a first arm support 194 (e.g., cradle, etc.). The first arm support 194 may be curved. For example, the first arm support 194 may be formed as a portion of a cylinder.

The seat assembly 182 also includes a first arm assembly 196 (e.g., linkage, bar, beam, etc.). As is explained in more detail herein, the first arm assembly 196 is configured to cooperate with other components of the chair assembly 100 provide a seating surface for the user. The first arm assembly 196 is disposed at a front (e.g., relative to a position of the user when the user is seated in the chair assembly 100, etc.) of the chair assembly 100.

The first arm assembly 196 includes a first arm base 198 (e.g., coupling arm, etc.). As is explained in more detail herein, the first arm base 198 is coupled to the first arm joint coupler 192 and is configured to be rotated relative to the frame plate 184. Additionally, the first arm support 194 is configured to interface with (e.g., contact, etc.) the first arm base 198 when the chair assembly is in the expanded state. The interfacing (e.g., contact, etc.) between the first arm base 198 and the first arm support 194 enables the first arm base 198 to support the user relative to the ground surface.

The frame plate 184 also includes a first arm coupler aperture 200 (e.g., hole, etc.). The first arm coupler aperture 200 is disposed adjacent the first arm support 194 and extends through the first arm joint coupler 192. The first arm coupler aperture 200 is centered on a first arm coupler aperture axis. As is explained herein, the first arm coupler aperture axis is an axis of rotation of the first arm base 198, and therefore of the first arm assembly 196, relative to the first arm joint coupler 192. In some embodiments, at least a portion of the first arm coupler aperture 200 is threaded.

The seat assembly 182 also includes a first arm joint fastener 202 (e.g., screw, etc.). The first arm joint fastener 202 is received within the first arm coupler aperture 200 and couples the first arm base 198 to the first arm joint coupler 192 via a first arm base joint aperture 203 (e.g., hole, etc.) in the first arm base 198. In various embodiments, the seat assembly 182 also includes a first arm fastener washer 204 (e.g., spacer, etc.). The first arm fastener washer 204 is positioned between the first arm joint fastener 202 and the frame plate 184.

In various embodiments, the frame plate 184 is configured such that at least a portion of the first arm support 194 is disposed over (e.g., relative to a direction of gravity, etc.) a portion of the first deflection plate 142 and/or a portion of the suspension arm 136. For example, the frame plate 184 may be configured such that a portion of the first arm support 194 is disposed over a portion of the first deflection plate 142 and a portion of the suspension arm 136.

The frame plate 184 also includes a second arm joint coupler 205 (e.g., socket, etc.). The second arm joint coupler 205 is a recess (e.g., depression, etc.) in the frame plate 184. The second arm joint coupler 205 includes a second arm support 206 (e.g., cradle, etc.). The second arm support 206 may be curved. For example, the second arm support 206 may be formed as a portion of a cylinder.

The seat assembly 182 also includes a second arm assembly 208 (e.g., linkage, bar, beam, etc.). As is explained in more detail herein, the second arm assembly 208 is configured to cooperate with other components of the chair assembly 100 provide a seating surface for the user. The second arm assembly 208 is disposed at the front of the chair assembly 100. The second arm assembly 208 is also disposed opposite the first arm assembly 196. Specifically, the first arm assembly 196 is disposed at one end of the front of the chair assembly 100 and the second arm assembly 208 is disposed at the other end of the front of the chair assembly 100.

The second arm assembly 208 includes a second arm base 210 (e.g., coupling arm, etc.). As is explained in more detail herein, the second arm base 210 is coupled to the second arm joint coupler 205 and is configured to be rotated relative to the frame plate 184. Additionally, the second arm support 206 is configured to interface with the second arm base 210 when the chair assembly is in the expanded state. The interfacing between the second arm base 210 and the second arm support 206 enables the second arm base 210 to support the user relative to the ground surface.

The frame plate 184 also includes a second arm coupler aperture 211 (e.g., hole, etc.). The second arm coupler aperture 211 is disposed adjacent the second arm support 206 and extends through the second arm joint coupler 205. The second arm coupler aperture 211 is centered on a second arm coupler aperture axis. As is explained herein, the second arm coupler aperture axis is an axis of rotation of the second arm base 210, and therefore of the second arm assembly 208, relative to the second arm joint coupler 205. In some embodiments, at least a portion of the second arm coupler aperture 211 is threaded.

The seat assembly 182 also includes a second arm joint fastener 212 (e.g., screw, etc.). The second arm joint fastener 212 is received within the second arm coupler aperture 211 and couples the second arm base 210 to the second arm joint coupler 205 via a second arm base joint aperture 213 (e.g., hole, etc.) in the second arm base 210. In various embodiments, the seat assembly 182 also includes a second arm fastener washer 214 (e.g., spacer, etc.). The second arm fastener washer 214 is positioned between the second arm joint fastener 212 and the frame plate 184.

In various embodiments, the frame plate 184 is configured such that at least a portion of the second arm support 206 is disposed over a portion of the second deflection plate 158 and/or a portion of the suspension arm 136. For example, the frame plate 184 may be configured such that a portion of the second arm support 206 is disposed over a portion of the second deflection plate 158 and a portion of the suspension arm 136.

The frame plate 184 may be variously configured to enable expansion of the first arm assembly 196 and the second arm assembly 208. In various embodiments, the frame plate 184 is symmetrical about a plane that bisects the frame plate 184, is orthogonal to the mounting plane 190, and is separated from the first arm support 194 and the second arm support 206 by the same distance.

The frame plate 184 also includes a first back joint coupler 216 (e.g., socket, etc.). The first back joint coupler 216 is a recess (e.g., depression, etc.) in the frame plate 184. The first back joint coupler 216 includes a first back support 218 (e.g., cradle, etc.). The first back support 218 may be curved. For example, the first back support 218 may be formed as a portion of a cylinder.

The seat assembly 182 also includes a first back assembly 220 (e.g., linkage, bar, beam, etc.). As is explained in more detail herein, the first back assembly 220 is configured to cooperate with other components of the chair assembly 100 provide a seating surface for the user. The first back assembly 220 is disposed at a rear of the chair assembly 100. The first back assembly 220 is also disposed opposite the first arm assembly 196. Specifically, the first arm assembly 196 is disposed at one end of the front of the chair assembly 100 and the first back assembly 220 is disposed at one end of the rear of the chair assembly 100.

The first back assembly 220 includes a first back base 222 (e.g., coupling arm, etc.). As is explained in more detail herein, the first back base 222 is coupled to the first back joint coupler 216 and is configured to be rotated relative to the frame plate 184. Additionally, the first back support 218 is configured to interface with the first back base 222 when the chair assembly is in the expanded state. The interfacing between the first back base 222 and the first back support 218 enables the first back base 222 to support the user relative to the ground surface.

The frame plate 184 also includes a first back coupler aperture 224 (e.g., hole, etc.). The first back coupler aperture 224 is disposed adjacent the first back support 218 and extends through the first back joint coupler 216. The first back coupler aperture 224 is centered on a first back coupler aperture axis. As is explained herein, the first back coupler aperture axis is an axis of rotation of the first back base 222, and therefore of the first back assembly 220, relative to the first back joint coupler 216. In some embodiments, at least a portion of the first back coupler aperture 224 is threaded.

The seat assembly 182 also includes a first back fastener 226 (e.g., screw, etc.). The first back fastener 226 is received within the first back coupler aperture 224 and couples the first back base 222 to the first back joint coupler 216 via a first back base joint aperture 227 (e.g., hole, etc.) in the first back base 222. In various embodiments, the seat assembly 182 also includes a first back fastener washer 228 (e.g., spacer, etc.). The first back fastener washer 228 is positioned between the first back fastener 226 and the frame plate 184. In various embodiments, the frame plate 184 is configured such that at least a portion of the first back support 218 is disposed over a portion of the second deflection plate 158.

The frame plate 184 also includes a second back joint coupler 229 (e.g., socket, etc.). The second back joint coupler 229 is a recess (e.g., depression, etc.) in the frame plate 184. The second back joint coupler 229 includes a second back support 230 (e.g., cradle, etc.). The second back support 230 may be curved. For example, the second back support 230 may be formed as a portion of a cylinder.

The seat assembly 182 also includes a second back assembly 232 (e.g., linkage, bar, beam, etc.). As is explained in more detail herein, the second back assembly 232 is configured to cooperate with other components of the chair assembly 100 provide a seating surface for the user. The second back assembly 232 is disposed at the rear of the chair assembly 100. The second back assembly 232 is also disposed opposite the second arm assembly 208. Specifically, the second arm assembly 208 is disposed at one end of the front of the chair assembly 100 and the second back assembly 232 is disposed at the other end of the rear of the chair assembly 100. The second back assembly 232 is also disposed opposite the first back assembly 220. Specifically, the first back assembly 220 is disposed at one send of the rear of the chair assembly 100 and the second arm assembly 208 is disposed at the other end of the rear of the chair assembly 100. The first arm assembly 196, the second arm assembly 208, the first back assembly 220, and the second back assembly 232 are each disposed at one of the four corners of the chair assembly 100.

The second back assembly 232 includes a second back base 234 (e.g., coupling arm, etc.). As is explained in more detail herein, the second back base 234 is coupled to the second back joint coupler 229 and is configured to be rotated relative to the frame plate 184. Additionally, the second back support 230 is configured to interface with the second back base 234 when the chair assembly is in the expanded state. The interfacing between the second back base 234 and the second back support 230 enables the second back base 234 to support the user relative to the ground surface.

The frame plate 184 also includes a second back coupler aperture 236 (e.g., hole, etc.). The second back coupler aperture 236 is disposed adjacent the second back support 230 and extends through the second back joint coupler 229. The second back coupler aperture 236 is centered on a second back coupler aperture axis. As is explained herein, the second back coupler aperture axis is an axis of rotation of the second back base 234, and therefore of the second back assembly 232, relative to the second back joint coupler 229. In some embodiments, at least a portion of the second back coupler aperture 236 is threaded.

The seat assembly 182 also includes a second back fastener 238 (e.g., screw, etc.). The second back fastener 238 is received within the second back coupler aperture 236 and couples the second back base 234 to the second back joint coupler 229 via a second back base joint aperture 239 (e.g., hole, etc.) in the second back base 234. In various embodiments, the seat assembly 182 also includes a second back fastener washer 240 (e.g., spacer, etc.). The second back fastener washer 240 is positioned between the second back fastener 238 and the frame plate 184. In various embodiments, the frame plate 184 is configured such that at least a portion of the second back support 230 is disposed over a portion of the second deflection plate 158.

The frame plate 184 may be variously configured to enable expansion of the first arm assembly 196, the second arm assembly 208, the first back assembly 220, and the second back assembly 232. In various embodiments, the frame plate 184 is symmetrical about a plane that bisects the frame plate 184, is orthogonal to the mounting plane 190, and is separated from the first back support 218 and the second back support 230 by the same distance.

The frame plate 184 also includes a latch flange 242 (e.g., protrusion, etc.). The latch flange 242 protrudes away from the mounting plane 190. In various embodiments, the latch flange 242 is disposed between the first back joint coupler 216 and the second back joint coupler 229. The seat assembly 182 also includes a latch 244 (e.g., lock, etc.). The seat assembly 182 also includes latch fasteners 246 (e.g., screws, etc.). The latch flange 242 includes latch fastener apertures 248 (e.g., holes, etc.). Each of the latch fasteners 246 extends through one of the latch fastener apertures 248 to couple the latch 244 to the latch flange 242. The latch 244 includes a latch pin 250 (e.g., detent, etc.). The latch 244 is operable between a first position where the latch pin extends a first distance and a second position where the latch pin extends a second distance greater than the first distance. The latch flange 242 includes a latch pin aperture 252 (e.g., hole, etc.). The latch pin 250 is repositionable within the latch pin aperture 252. As is explained in more detail herein, the latch pin 250 is configured to retain the chair assembly 100 in the expanded state when the latch pin is in the second position. By repositioning the latch pin 250 from the second position to the first position, the chair assembly 100 may be transitioned from the expanded state to the collapsed state.

Figure 17:
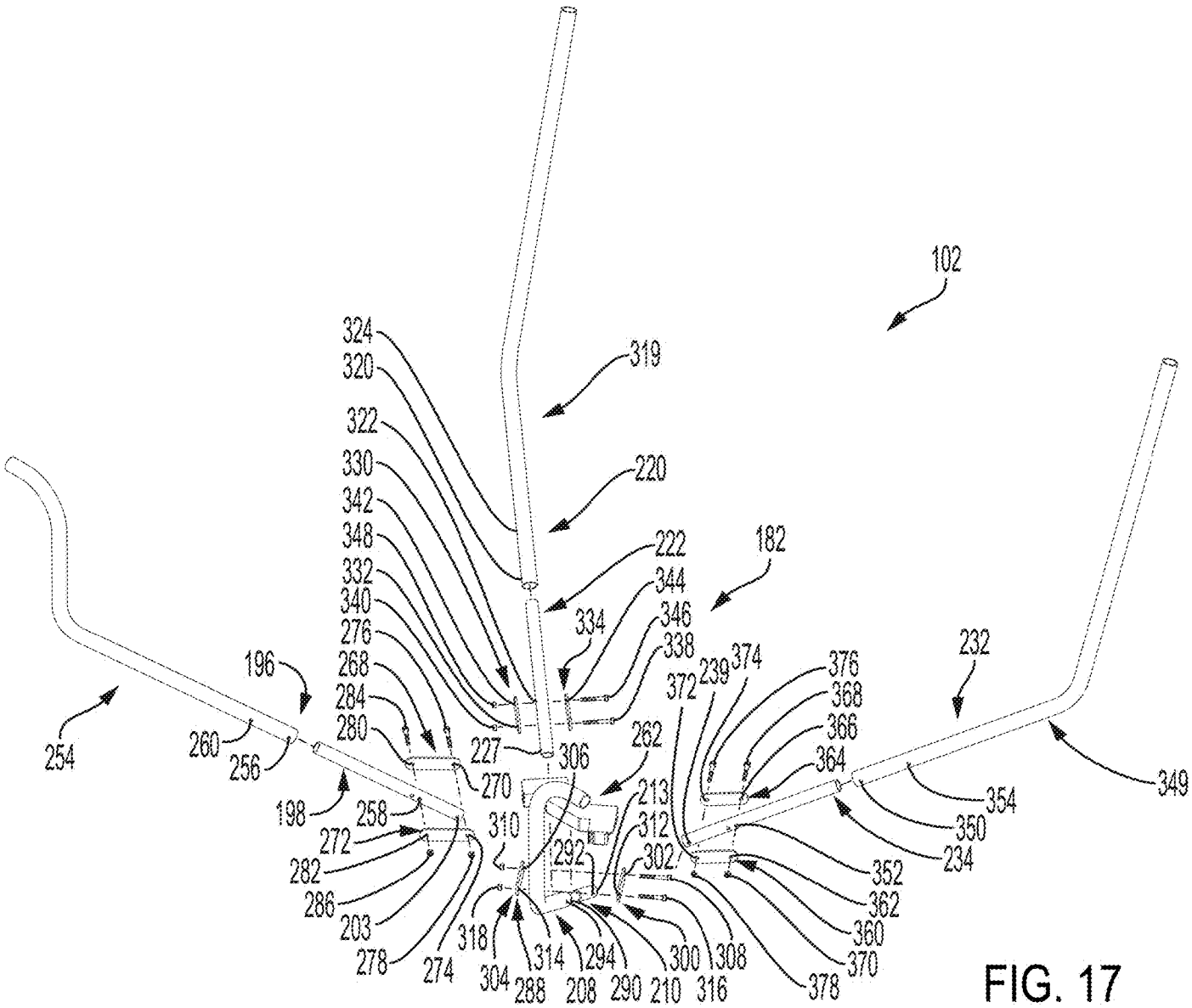
FIG. 17 is a portion of the exploded view shown in FIG. 16.

As shown in FIG. 17, the first arm assembly 196 also includes a first arm frame 254. The first arm frame 254 is coupled to the first arm base 198. In various embodiments, the first arm base 198 is received within the first arm frame 254. In other embodiments, the first arm frame 254 is received within the first arm base 198. The first arm frame 254 includes a first arm frame joint aperture 256 (e.g., hole, etc.). The first arm frame joint aperture 256 is aligned with the first arm base joint aperture 203. The first arm joint fastener 202 extends through the first arm frame joint aperture 256 and the first arm base joint aperture 203 and couples the frame plate 184 to the first arm base 198 and the first arm frame 254.

The first arm base 198 also includes a first arm base latch aperture 258 (e.g., hole, etc.). The first arm base latch aperture 258 is separated from the first arm base joint aperture 203 by a first arm base distance. The first arm base distance is selected to facilitate transitioning of the chair assembly 100 between the expanded state and the collapsed state.

Similarly, the first arm frame 254 also includes a first arm frame latch aperture 260 (e.g., hole, etc.). The first arm frame latch aperture 260 is separated from the first arm frame joint aperture 256 by the first arm base distance. When the first arm base 198 is received within the first arm frame 254 or the first arm frame 254 is received within the first arm base 198, the first arm base joint aperture 203 is aligned with the first arm frame joint aperture 256 and the first arm base latch aperture 258 is aligned with the first arm frame latch aperture 260.

Figure 25:
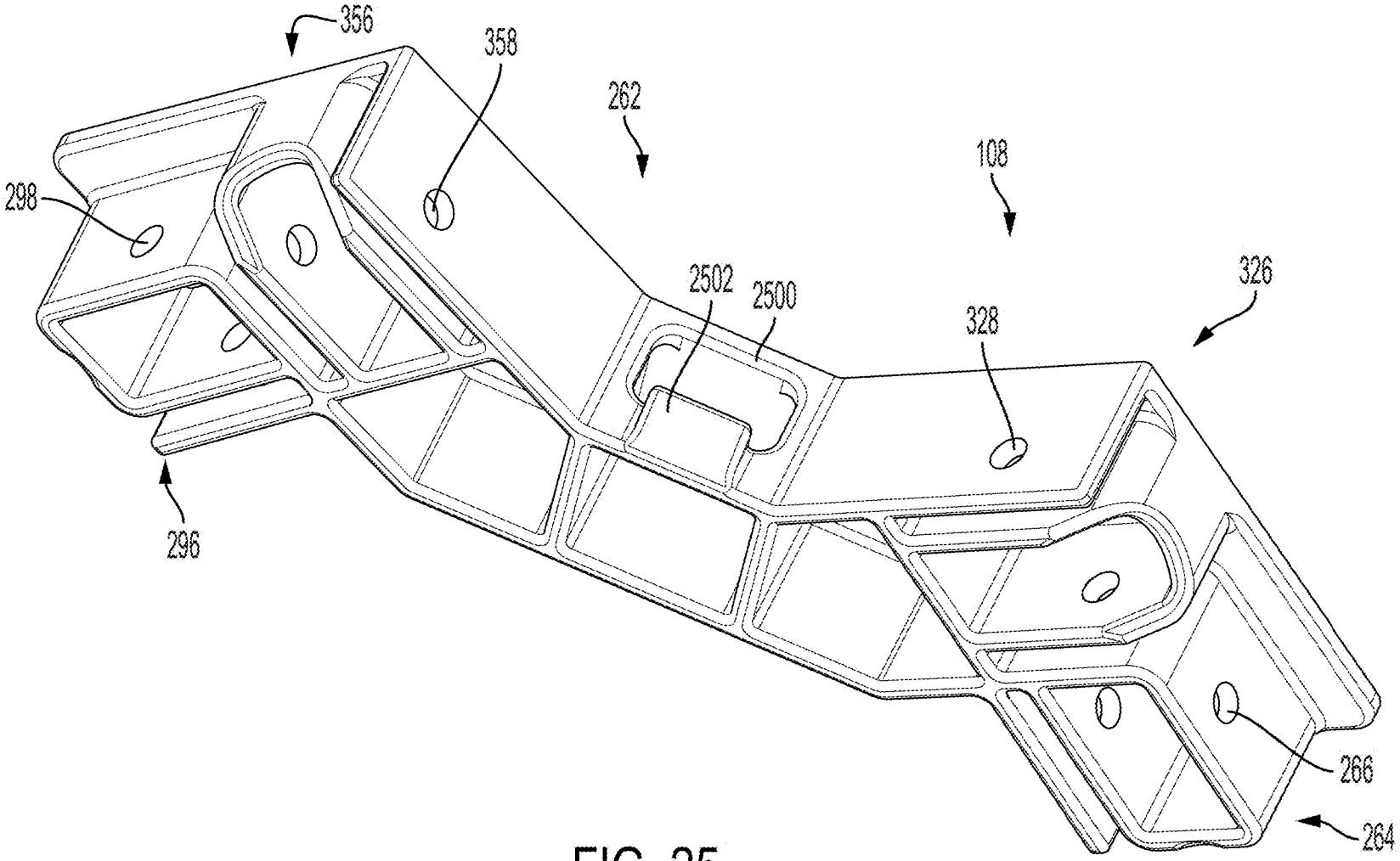
FIG. 25 is a perspective view of a latch plate of the frame assembly.

The seat assembly 182 also includes a latch plate 262 (e.g., support, etc.). FIG. 25 illustrates the latch plate 262 in greater detail. As explained in more detail herein, the latch plate 262 is configured to retain the first arm assembly 196, the second arm assembly 208, the first back assembly 220, and the second back assembly 232 relative to one another. The latch plate 262 also cooperates with the latch flange 242 to facilitate locking of the chair assembly 100 in the expanded state using the latch 244.

The latch plate 262 also includes a first arm latch receiver 264 (e.g., socket, etc.). The first arm latch receiver 264 may be formed by multiple parallel flanges formed in the latch plate 262, where the flanges are spaced a part from one another. One or more of these flanges may include recesses that provide additional clearance for the first arm assembly 196 when in the collapsed state.

The first arm latch receiver 264 includes a first arm latch aperture 266 (e.g., hole, etc.). The first arm latch aperture 266 is centered on a first arm latch aperture axis. As is explained herein, the first arm latch aperture axis is an axis of rotation of the first arm assembly 196 relative to the first arm latch receiver 264. In some embodiments, at least a portion of the first arm latch aperture 266 is threaded.

The seat assembly 182 also includes a first arm first link 268. The first arm first link 268 is configured to retain the first arm assembly 196 relative to the first arm latch receiver 264. The first arm first link 268 includes a first arm first link latch aperture 270 (e.g., hole, etc.). The first arm first link latch aperture 270 is aligned with the first arm latch aperture 266. In some embodiments, at least a portion of the first arm first link latch aperture 270 is threaded.

The seat assembly 182 also includes a first arm second link 272. The first arm second link 272 is configured to retain the first arm assembly 196 relative to the first arm latch receiver 264. The first arm second link 272 includes a first arm second link latch aperture 274 (e.g., hole, etc.). The first arm second link latch aperture 274 is aligned with the first arm latch aperture 266. In some embodiments, at least a portion of the first arm second link latch aperture 274 is threaded.

The seat assembly 182 also includes a first arm latch fastener 276 (e.g., screw, etc.). The first arm latch fastener 276 is received within the first arm latch aperture 266, the first arm first link latch aperture 270, and the first arm second link latch aperture 274. The first arm first link 268 and the first arm second link 272 are each rotatable about the first arm latch fastener 276 to facilitate rotation of each of the first arm first link 268 and the first arm second link 272 about the first arm latch fastener 276. In this way, the first arm latch fastener 276 couples the latch plate 262 to the first arm first link 268 and the first arm second link 272. The seat assembly 182 also includes a first arm latch nut 278. The first arm latch nut 278 is coupled to the first arm latch fastener 276 and facilitates coupling of the latch plate 262, the first arm first link 268, and the first arm second link 272.

The first arm first link 268 also includes a first arm first link frame aperture 280 (e.g., hole, etc.). The first arm first link frame aperture 280 is aligned with the first arm base latch aperture 258 and the first arm frame latch aperture 260. In some embodiments, at least a portion of the first arm first link frame aperture 280 is threaded.

The first arm second link 272 also includes a first arm second link frame aperture 282 (e.g., hole, etc.). The first arm second link frame aperture 282 is aligned with the first arm base latch aperture 258 and the first arm frame latch aperture 260. In some embodiments, at least a portion of the first arm second link frame aperture 282 is threaded.

The seat assembly 182 also includes a first arm frame fastener 284 (e.g., screw, etc.). The first arm frame fastener 284 is received within the first arm base latch aperture 258 and the first arm frame latch aperture 260, the first arm first link frame aperture 280, and the first arm second link frame aperture 282. The first arm first link 268 and the first arm second link 272 are each rotatable about the first arm frame fastener 284 to facilitate rotation of each of the first arm first link 268 and the first arm second link 272 about the first arm frame fastener 284. In this way, the first arm frame fastener 284 couples the first arm base 198 and the first arm frame 254 to the first arm first link 268 and the first arm second link 272. The seat assembly 182 also includes a first arm frame nut 286. The first arm frame nut 286 is coupled to the first arm frame fastener 284 and facilitates coupling of the first arm base 198 and the first arm frame 254, the first arm first link 268, and the first arm second link 272.

As shown in FIG. 17, the second arm assembly 208 also includes a second arm frame 288. The second arm frame 288 is coupled to the second arm base 210. In various embodiments, the second arm base 210 is received within the second arm frame 288. In other embodiments, the second arm frame 288 is received within the second arm base 210. The second arm frame 288 includes a second arm frame joint aperture 290 (e.g., hole, etc.). The second arm frame joint aperture 290 is aligned with the second arm base joint aperture 213. The second arm joint fastener 212 extends through the second arm frame joint aperture 290 and the second arm base joint aperture 213 and couples the frame plate 184 to the second arm base 210 and the second arm frame 288.

The second arm base 210 also includes a second arm base latch aperture 292 (e.g., hole, etc.). The second arm base latch aperture 292 is separated from the second arm base joint aperture 213 by a second arm base distance. The second arm base distance is selected to facilitate transitioning of the chair assembly 100 between the expanded state and the collapsed state. In various embodiments, the second arm base distance is the same as the first arm base distance.

Similarly, the second arm frame 288 also includes a second arm frame latch aperture 294 (e.g., hole, etc.). The second arm frame latch aperture 294 is separated from the second arm frame joint aperture 290 by the second arm base distance. When the second arm base 210 is received within the second arm frame 288 or the second arm frame 288 is received within the second arm base 210, the second arm base joint aperture 213 is aligned with the second arm frame joint aperture 290 and the second arm base latch aperture 292 is aligned with the second arm frame latch aperture 294.

The latch plate 262 also includes a second arm latch receiver 296 (e.g., socket, etc.). The second arm latch receiver 296 may be formed by multiple parallel flanges formed in the latch plate 262, where the flanges are spaced a part from one another. One or more of these flanges may include recesses that provide additional clearance for the second arm assembly 208 when in the collapsed state.

The second arm latch receiver 296 includes a second arm latch aperture 298 (e.g., hole, etc.). The second arm latch aperture 298 is centered on a second arm latch aperture axis. As is explained herein, the second arm latch aperture axis is an axis of rotation of the second arm assembly 208 relative to the second arm latch receiver 296. In some embodiments, at least a portion of the second arm latch aperture 298 is threaded.

The seat assembly 182 also includes a second arm first link 300. The second arm first link 300 is configured to retain the second arm assembly 208 relative to the second arm latch receiver 296. The second arm first link 300 includes a second arm first link latch aperture 302 (e.g., hole, etc.). The second arm first link latch aperture 302 is aligned with the second arm latch aperture 298. In some embodiments, at least a portion of the second arm first link latch aperture 302 is threaded.

The seat assembly 182 also includes a second arm second link 304. The second arm second link 304 is configured to retain the second arm assembly 208 relative to the second arm latch receiver 296. The second arm second link 304 includes a second arm second link latch aperture 306 (e.g., hole, etc.). The second arm second link latch aperture 306 is aligned with the second arm latch aperture 298. In some embodiments, at least a portion of the second arm second link latch aperture 306 is threaded.

The seat assembly 182 also includes a second arm latch fastener 308 (e.g., screw, etc.). The second arm latch fastener 308 is received within the second arm latch aperture 298, the second arm first link latch aperture 302, and the second arm second link latch aperture 306. The second arm first link 300 and the second arm second link 304 are each rotatable about the second arm latch fastener 308 to facilitate rotation of each of the second arm first link 300 and the second arm second link 304 about the second arm latch fastener 308. In this way, the second arm latch fastener 308 couples the latch plate 262 to the second arm first link 300 and the second arm second link 304. The seat assembly 182 also includes a second arm latch nut 310. The second arm latch nut 310 is coupled to the second arm latch fastener 308 and facilitates coupling of the latch plate 262, the second arm first link 300, and the second arm second link 304.

The second arm first link 300 also includes a second arm first link frame aperture 312 (e.g., hole, etc.). The second arm first link frame aperture 312 is aligned with the second arm base latch aperture 292 and the second arm frame latch aperture 294. In some embodiments, at least a portion of the second arm first link frame aperture 312 is threaded.

The second arm second link 304 also includes a second arm second link frame aperture 314 (e.g., hole, etc.). The second arm second link frame aperture 314 is aligned with the second arm base latch aperture 292 and the second arm frame latch aperture 294. In some embodiments, at least a portion of the second arm second link frame aperture 314 is threaded.

The seat assembly 182 also includes a second arm frame fastener 316 (e.g., screw, etc.). The second arm frame fastener 316 is received within the second arm base latch aperture 292 and the second arm frame latch aperture 294, the second arm first link frame aperture 312, and the second arm second link frame aperture 314. The second arm first link 300 and the second arm second link 304 are each rotatable about the second arm frame fastener 316 to facilitate rotation of each of the second arm first link 300 and the second arm second link 304 about the second arm frame fastener 316. In this way, the second arm frame fastener 316 couples the second arm base 210 and the second arm frame 288 to the second arm first link 300 and the second arm second link 304. The seat assembly 182 also includes a second arm frame nut 318. The second arm frame nut 318 is coupled to the second arm frame fastener 316 and facilitates coupling of the second arm base 210 and the second arm frame 288, the second arm first link 300, and the second arm second link 304.

As shown in FIG. 17, the first back assembly 220 also includes a first back frame 319. The first back frame 319 is coupled to the first back base 222. In various embodiments, the first back base 222 is received within the first back frame 319. In other embodiments, the first back frame 319 is received within the first back base 222. The first back frame 319 includes a first back frame joint aperture 320 (e.g., hole, etc.). The first back frame joint aperture 320 is aligned with the first back base joint aperture 227. The first back fastener 226 extends through the first back frame joint aperture 320 and the first back base joint aperture 227 and couples the frame plate 184 to the first back base 222 and the first back frame 319.

The first back base 222 also includes a first back base latch aperture 322 (e.g., hole, etc.). The first back base latch aperture 322 is separated from the first back base joint aperture 227 by a first back base distance. The first back base distance is selected to facilitate transitioning of the chair assembly 100 between the expanded state and the collapsed state. In various embodiments, the first back base distance is the same as the first arm base distance.

Similarly, the first back frame 319 also includes a first back frame latch aperture 324 (e.g., hole, etc.). The first back frame latch aperture 324 is separated from the first back frame joint aperture 320 by the first back base distance. When the first back base 222 is received within the first back frame 319 or the first back frame 319 is received within the first back base 222, the first back base joint aperture 227 is aligned with the first back frame joint aperture 320 and the first back base latch aperture 322 is aligned with the first back frame latch aperture 324.

The latch plate 262 also includes a first back latch receiver 326 (e.g., socket, etc.). The first back latch receiver 326 may be formed by multiple parallel flanges formed in the latch plate 262, where the flanges are spaced a part from one another. One or more of these flanges may include recesses that provide additional clearance for the first back assembly 220 when in the collapsed state.

The first back latch receiver 326 includes a first back latch aperture 328 (e.g., hole, etc.). The first back latch aperture 328 is centered on a first back latch aperture axis. As is explained herein, the first back latch aperture axis is an axis of rotation of the first back assembly 220 relative to the first back latch receiver 326. In some embodiments, at least a portion of the first back latch aperture 328 is threaded.

The seat assembly 182 also includes a first back first link 330. The first back first link 330 is configured to retain the first back assembly 220 relative to the first back latch receiver 326. The first back first link 330 includes a first back first link latch aperture 332 (e.g., hole, etc.). The first back first link latch aperture 332 is aligned with the first back latch aperture 328. In some embodiments, at least a portion of the first back first link latch aperture 332 is threaded.

The seat assembly 182 also includes a first back second link 334. The first back second link 334 is configured to retain the first back assembly 220 relative to the first back latch receiver 326. The first back second link 334 includes a first back second link latch aperture 336 (e.g., hole, etc.). The first back second link latch aperture 336 is aligned with the first back latch aperture 328. In some embodiments, at least a portion of the first back second link latch aperture 336 is threaded.

The seat assembly 182 also includes a first back latch fastener 338 (e.g., screw, etc.). The first back latch fastener 338 is received within the first back latch aperture 328, the first back first link latch aperture 332, and the first back second link latch aperture 336. The first back first link 330 and the first back second link 334 are each rotatable about the first back latch fastener 338 to facilitate rotation of each of the first back first link 330 and the first back second link 334 about the first back latch fastener 338. In this way, the first back latch fastener 338 couples the latch plate 262 to the first back first link 330 and the first back second link 334. The seat assembly 182 also includes a first back latch nut 340. The first back latch nut 340 is coupled to the first back latch fastener 338 and facilitates coupling of the latch plate 262, the first back first link 330, and the first back second link 334.

The first back first link 330 also includes a first back first link frame aperture 342 (e.g., hole, etc.). The first back first link frame aperture 342 is aligned with the first back base latch aperture 322 and the first back frame latch aperture 324. In some embodiments, at least a portion of the first back first link frame aperture 342 is threaded.

The first back second link 334 also includes a first back second link frame aperture 344 (e.g., hole, etc.). The first back second link frame aperture 344 is aligned with the first back base latch aperture 322 and the first back frame latch aperture 324. In some embodiments, at least a portion of the first back second link frame aperture 344 is threaded.

The seat assembly 182 also includes a first back frame fastener 346 (e.g., screw, etc.). The first back frame fastener 346 is received within the first back base latch aperture 322 and the first back frame latch aperture 324, the first back first link frame aperture 342, and the first back second link frame aperture 344. The first back first link 330 and the first back second link 334 are each rotatable about the first back frame fastener 346 to facilitate rotation of each of the first back first link 330 and the first back second link 334 about the first back frame fastener 346. In this way, the first back frame fastener 346 couples the first back base 222 and the first back frame 319 to the first back first link 330 and the first back second link 334. The seat assembly 182 also includes a first back frame nut 348. The first back frame nut 348 is coupled to the first back frame fastener 346 and facilitates coupling of the first back base 222 and the first back frame 319, the first back first link 330, and the first back second link 334.

As shown in FIG. 17, the second back assembly 232 also includes a second back frame 349. The second back frame 349 is coupled to the second back base 234. In various embodiments, the second back base 234 is received within the second back frame 349. In other embodiments, the second back frame 349 is received within the second back base 234. The second back frame 349 includes a second back frame joint aperture 350 (e.g., hole, etc.). The second back frame joint aperture 350 is aligned with the second back base joint aperture 239. The second back fastener 238 extends through the second back frame joint aperture 350 and the second back base joint aperture 239 and couples the frame plate 184 to the second back base 234 and the second back frame 349.

The second back base 234 also includes a second back base latch aperture 352 (e.g., hole, etc.). The second back base latch aperture 352 is separated from the second back base joint aperture 239 by a second back base distance. The second back base distance is selected to facilitate transitioning of the chair assembly 100 between the expanded state and the collapsed state. In various embodiments, the second back base distance is the same as the second back base distance and/or the first arm base distance.

Similarly, the second back frame 349 also includes a second back frame latch aperture 354 (e.g., hole, etc.). The second back frame latch aperture 354 is separated from the second back frame joint aperture 350 by the second back base distance. When the second back base 234 is received within the second back frame 349 or the second back frame 349 is received within the second back base 234, the second back base joint aperture 239 is aligned with the second back frame joint aperture 350 and the second back base latch aperture 352 is aligned with the second back frame latch aperture 354.

The latch plate 262 also includes a second back latch receiver 356 (e.g., socket, etc.). The second back latch receiver 356 may be formed by multiple parallel flanges formed in the latch plate 262, where the flanges are spaced a part from one another. One or more of these flanges may include recesses that provide additional clearance for the second back assembly 232 when in the collapsed state.

The second back latch receiver 356 includes a second back latch aperture 358 (e.g., hole, etc.). The second back latch aperture 358 is centered on a second back latch aperture axis. As is explained herein, the second back latch aperture axis is an axis of rotation of the second back assembly 232 relative to the second back latch receiver 356. In some embodiments, at least a portion of the second back latch aperture 358 is threaded.

The seat assembly 182 also includes a second back first link 360. The second back first link 360 is configured to retain the second back assembly 232 relative to the second back latch receiver 356. The second back first link 360 includes a second back first link latch aperture 362 (e.g., hole, etc.). The second back first link latch aperture 362 is aligned with the second back latch aperture 358. In some embodiments, at least a portion of the second back first link latch aperture 362 is threaded.

The seat assembly 182 also includes a second back second link 364. The second back second link 364 is configured to retain the second back assembly 232 relative to the second back latch receiver 356. The second back second link 364 includes a second back second link latch aperture 366 (e.g., hole, etc.). The second back second link latch aperture 366 is aligned with the second back latch aperture 358. In some embodiments, at least a portion of the second back second link latch aperture 366 is threaded.

The seat assembly 182 also includes a second back latch fastener 368 (e.g., screw, etc.). The second back latch fastener 368 is received within the second back latch aperture 358, the second back first link latch aperture 362, and the second back second link latch aperture 366. The second back first link 360 and the second back second link 364 are each rotatable about the second back latch fastener 368 to facilitate rotation of each of the second back first link 360 and the second back second link 364 about the second back latch fastener 368. In this way, the second back latch fastener 368 couples the latch plate 262 to the second back first link 360 and the second back second link 364. The seat assembly 182 also includes a second back latch nut 370. The second back latch nut 370 is coupled to the second back latch fastener 368 and facilitates coupling of the latch plate 262, the second back first link 360, and the second back second link 364.

The second back first link 360 also includes a second back first link frame aperture 372 (e.g., hole, etc.). The second back first link frame aperture 372 is aligned with the second back base latch aperture 352 and the second back frame latch aperture 354. In some embodiments, at least a portion of the second back first link frame aperture 372 is threaded.

The second back second link 364 also includes a second back second link frame aperture 374 (e.g., hole, etc.). The second back second link frame aperture 374 is aligned with the second back base latch aperture 352 and the second back frame latch aperture 354. In some embodiments, at least a portion of the second back second link frame aperture 374 is threaded.

The seat assembly 182 also includes a second back frame fastener 376 (e.g., screw, etc.). The second back frame fastener 376 is received within the second back base latch aperture 352 and the second back frame latch aperture 354, the second back first link frame aperture 372, and the second back second link frame aperture 374. The second back first link 360 and the second back second link 364 are each rotatable about the second back frame fastener 376 to facilitate rotation of each of the second back first link 360 and the second back second link 364 about the second back frame fastener 376. In this way, the second back frame fastener 376 couples the second back base 234 and the second back frame 349 to the second back first link 360 and the second back second link 364. The seat assembly 182 also includes a second back frame nut 378. The second back frame nut 378 is coupled to the second back frame fastener 376 and facilitates coupling of the second back base 234 and the second back frame 349, the second back first link 360, and the second back second link 364.

Figure 6:
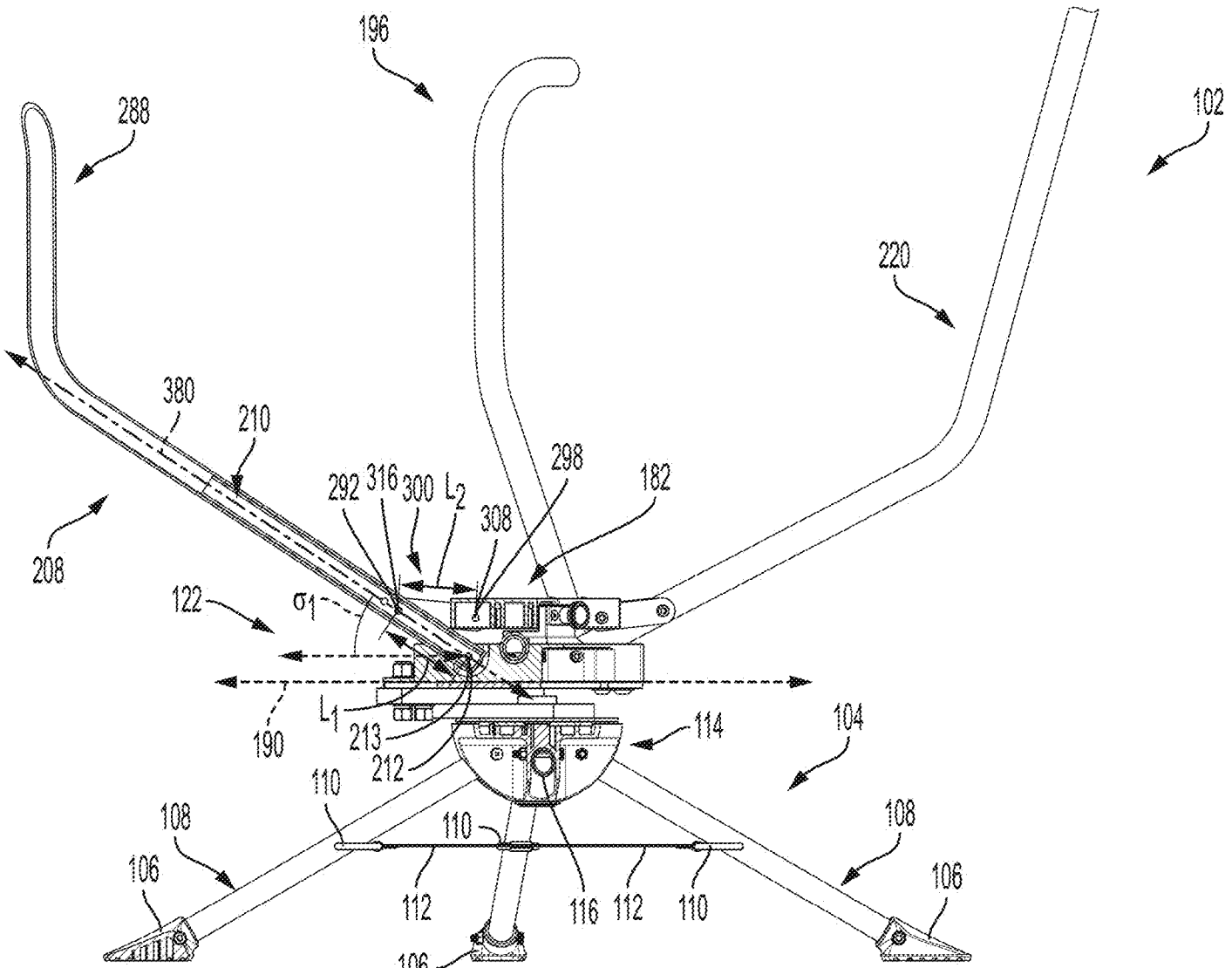
FIG. 6 is a cross-sectional view of the frame assembly shown in FIG. 5 taken along plane A-A.

FIG. 6 illustrates the second arm assembly 208 in greater detail. It is understood that the first arm assembly 196 may be configured analogously to the second arm assembly 208. The second arm base 210 is centered on a second arm base axis 380. In various embodiments, a portion of the second arm frame 288 is also centered on the second arm base axis 380. When the chair assembly 100 is in the expanded state, the second arm base axis 380 is separated from a plane parallel to the mounting plane 190 by a second arm angle $\sigma_1$ along a plane that is orthogonal to the mounting plane 190 and along which the second arm base axis 380 extends. In various embodiments, the second arm assembly 208 is configured such that the second arm angle $\sigma_1$ is approximately equal to (e.g., equal to, within 5% of, etc.) 20 degrees (°) to 45°, inclusive. For example, the second arm assembly 208 may be configured such that the second arm angle $\sigma_1$ is approximately equal to 33.2°.

As is also shown in FIG. 6, the second arm assembly 208 is configured such that the second arm base joint aperture 213 is separated from the second arm base latch aperture 292 by the second arm base distance $L_1$. In various embodiments, the second arm base distance $L_1$ is approximately equal to 30 millimeters (mm) to 80 mm, inclusive. For example, the second arm assembly 208 may be configured such that the second arm base distance $L_1$ is approximately equal to 65 mm.

As is also shown in FIG. 6, the second arm assembly 208, the second arm first link 300, the second arm second link 304, and the latch plate 262 are configured such that the second arm latch aperture 298 is separated from the second arm base latch aperture 292 by a second arm latch distance $L_2$. In various embodiments, the second arm latch distance $L_2$ is approximately equal to 30 mm to 80 mm, inclusive. For example, the second arm assembly 208, the second arm first link 300, the second arm second link 304, and the latch plate 262 may be configured such that the second arm latch distance $L_2$ is approximately equal to 60 mm.

Figure 7:
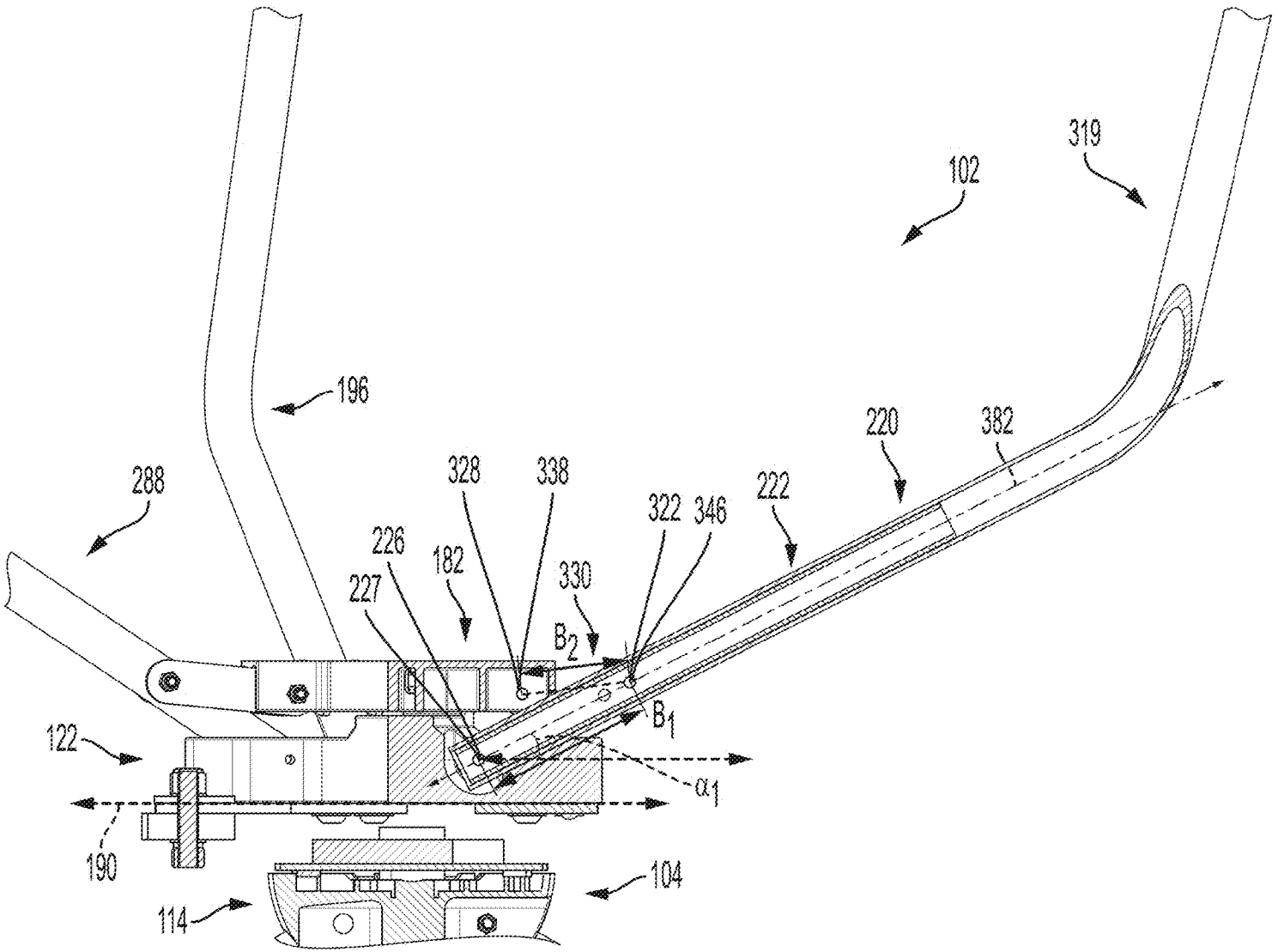
FIG. 7 is a cross-sectional view of the frame assembly shown in FIG. 5 taken along plane B-B.
Figure 8:
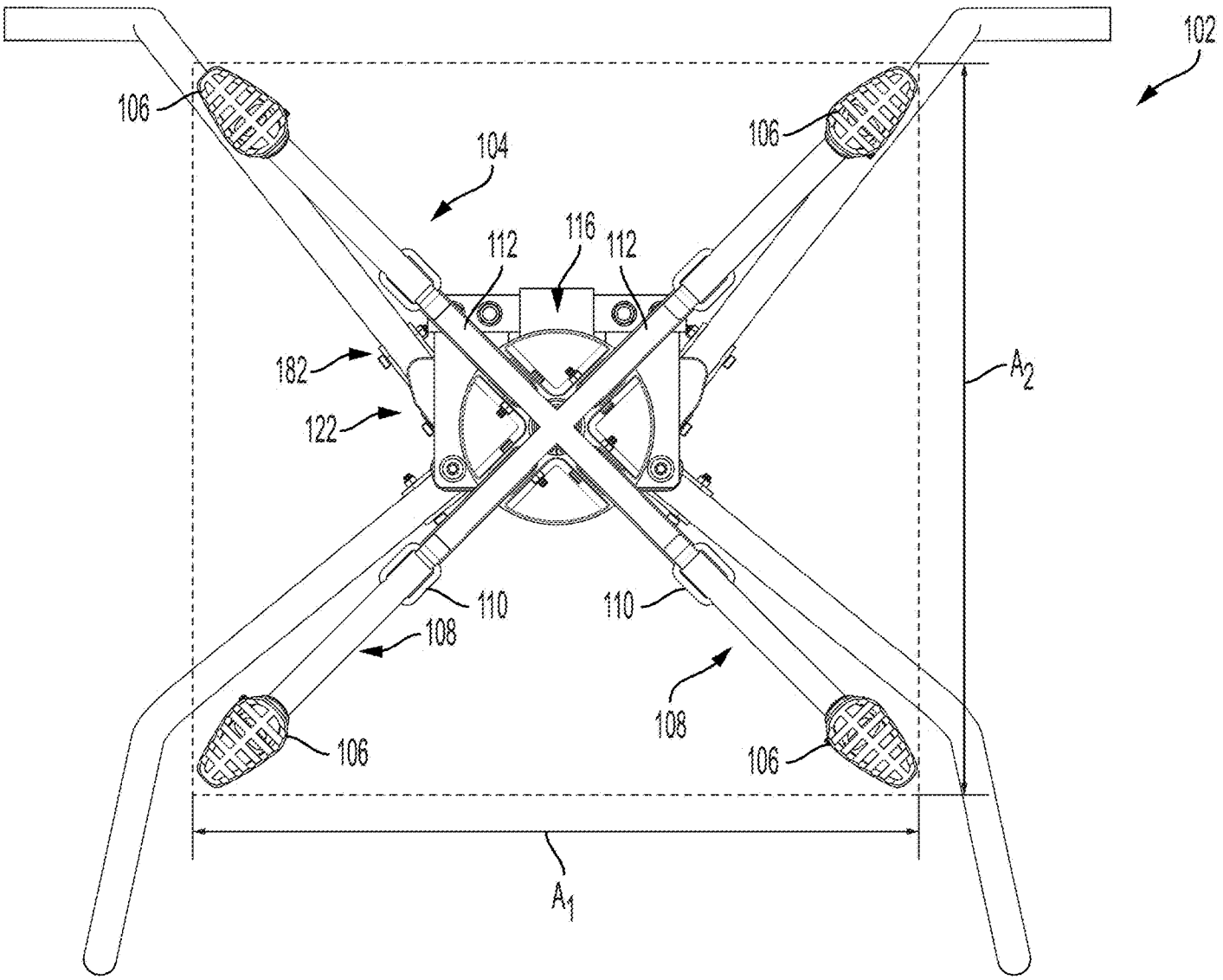
FIG. 8 is a bottom view of the frame assembly in the expanded state.
Figure 9:
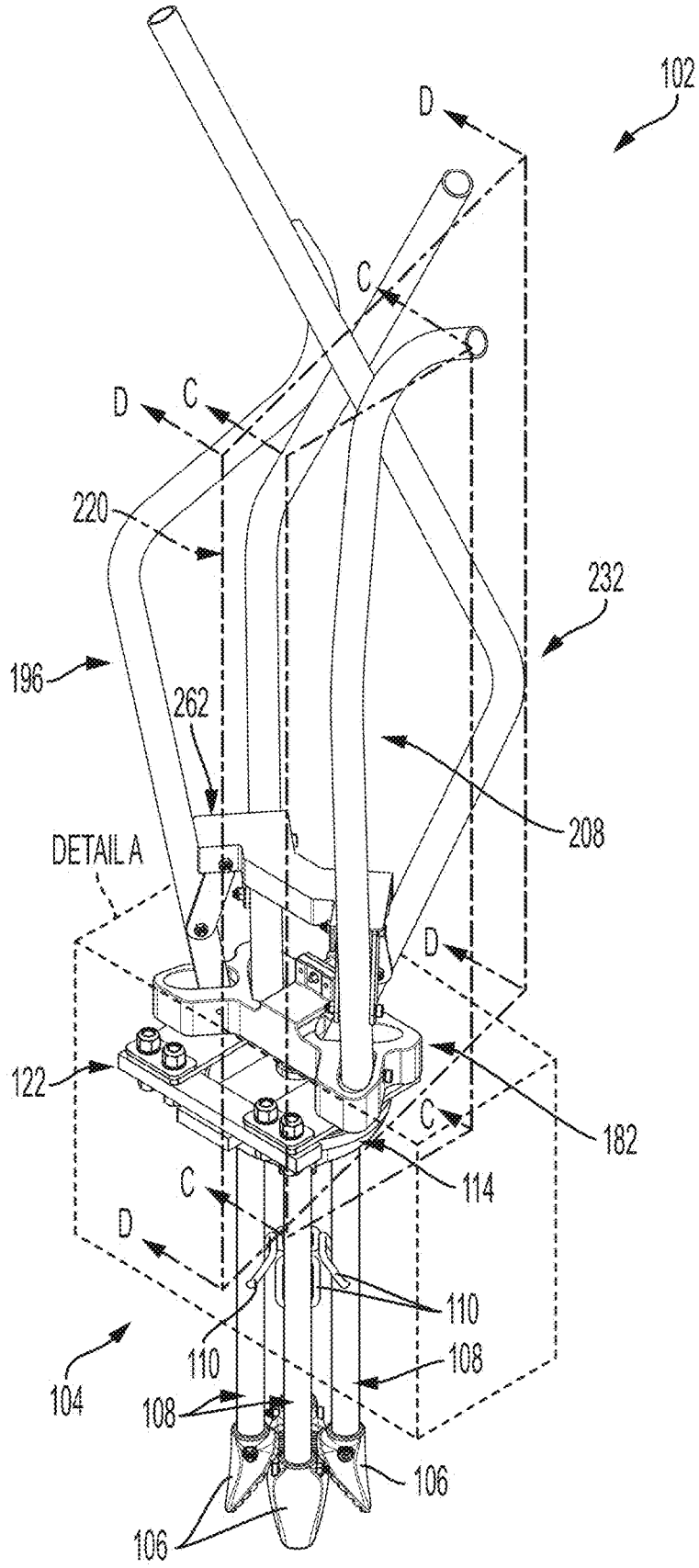
FIG. 9 is a perspective view of the frame assembly in a collapsed state.
Figure 10:
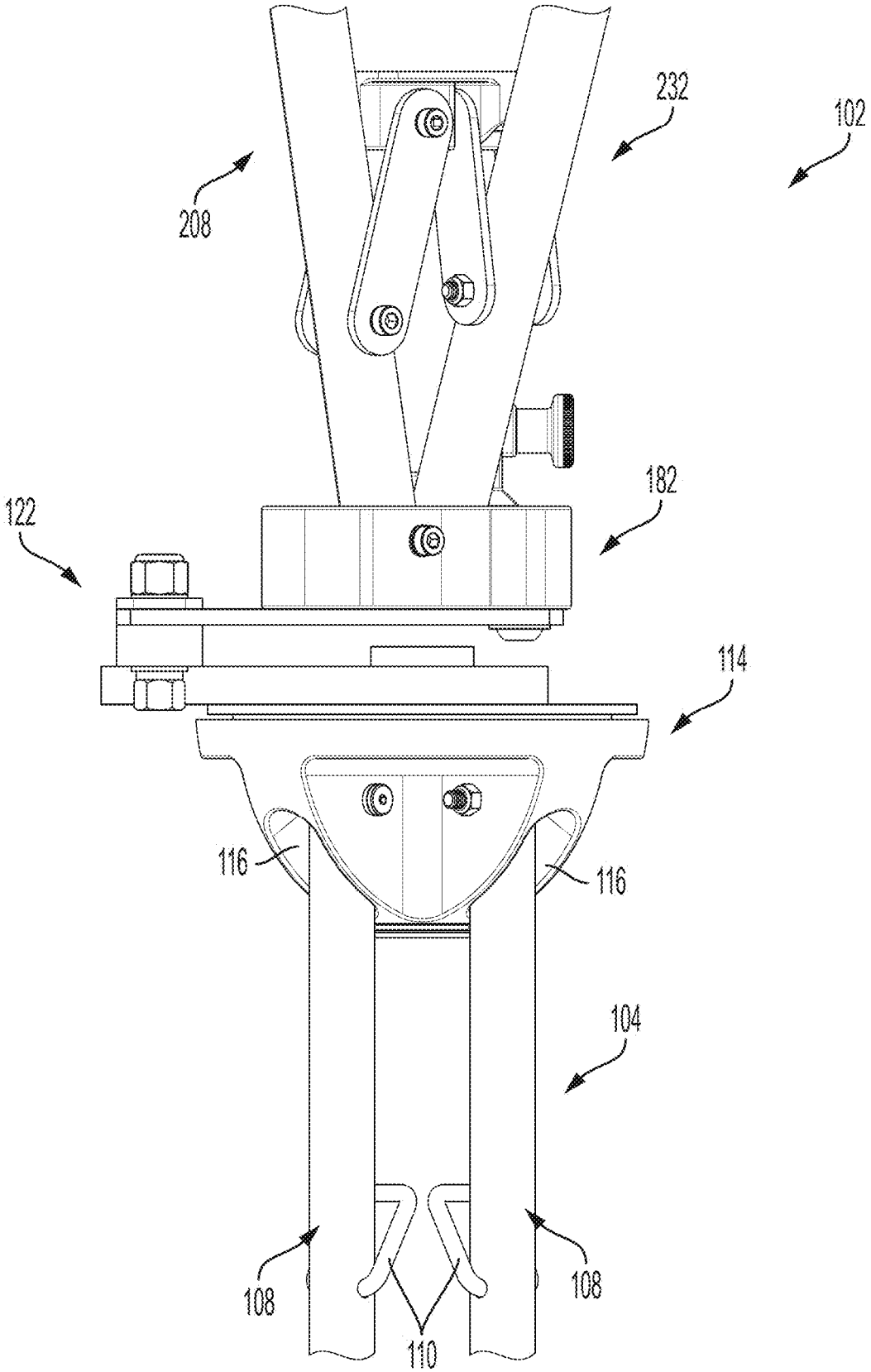
FIG. 10 is a side view of DETAIL A shown in FIG. 9.
Figure 11:
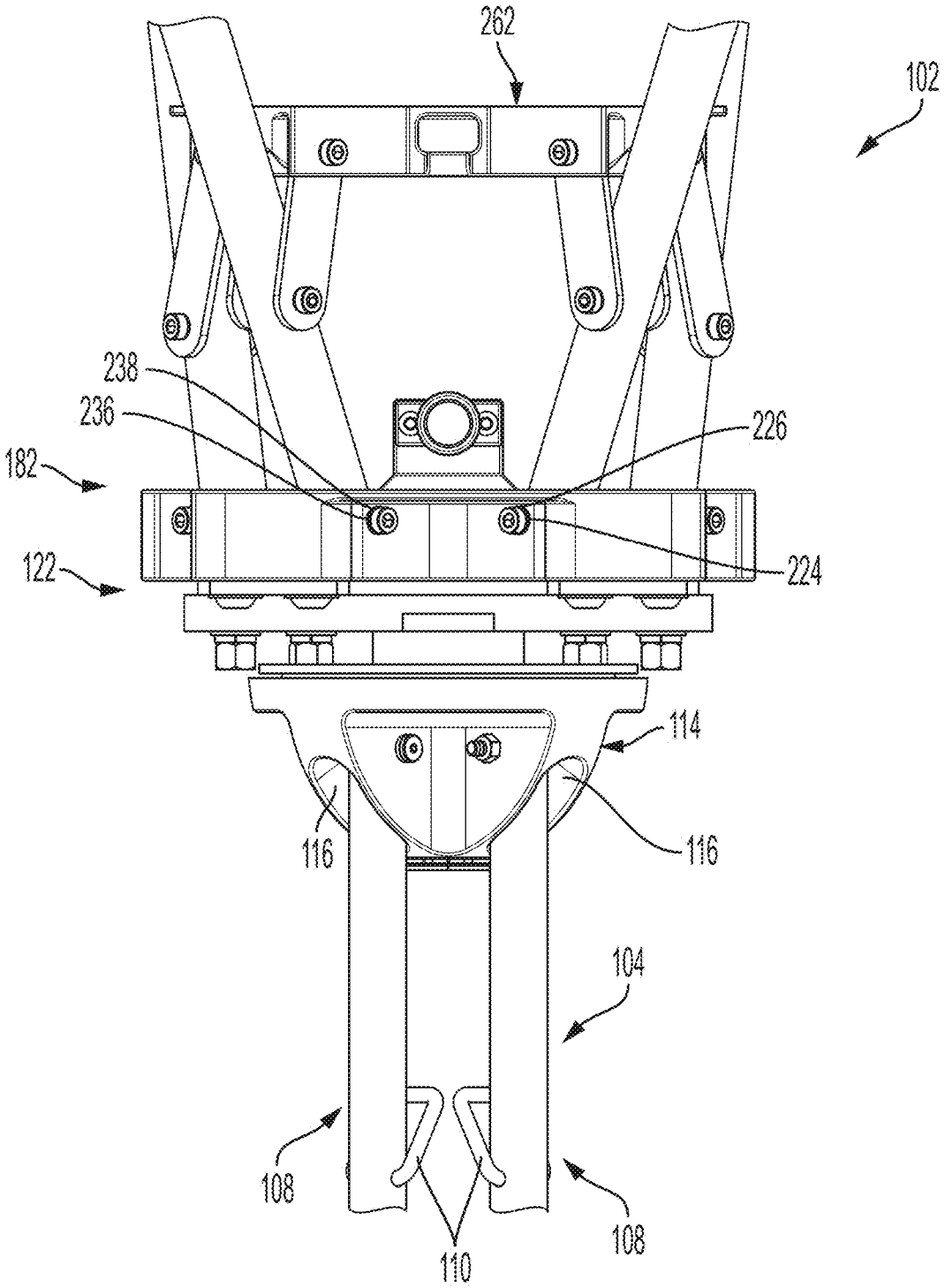
FIG. 11 is a rear view of DETAIL A shown in FIG. 9.

FIG. 7 illustrates the first back assembly 220 in greater detail. It is understood that the second back assembly 232 may be configured analogously to the first back assembly 220. The first back base 222 is centered on a first back base axis 382. In various embodiments, a portion of the first back frame 319 is also centered on the first back base axis 382. When the chair assembly 100 is in the expanded state, the first back base axis 382 is separated from a plane parallel to the mounting plane 190 by a first back angle $\alpha_1$ along a plane that is orthogonal to the mounting plane 190 and along which the first back base axis 382 extends. In various embodiments, the first back assembly 220 is configured such that the first back angle $\alpha_1$ is approximately equal to 20° to 45°, inclusive. For example, the first back assembly 220 may be configured such that the first back angle $\alpha_1$ is approximately equal to 27°.

As is also shown in FIG. 7, the first back assembly 220 is configured such that the first back base joint aperture 227 is separated from the first back base latch aperture 322 by the first back base distance $B_1$. In various embodiments, the first back base distance $B_1$ is approximately equal to 30 mm to 80 mm, inclusive. For example, the first back assembly 220 may be configured such that the first back base distance $B_1$ is approximately equal to 49.5 mm.

As is also shown in FIG. 7, the first back assembly 220, the first back first link 330, the first back second link 334, and the latch plate 262 are configured such that the first back latch aperture 328 is separated from the first back base latch aperture 322 by a first back latch distance $B_2$. In various embodiments, the first back latch distance $B_2$ is approximately equal to 40 mm to 90 mm, inclusive. For example, the first back assembly 220, the first back first link 330, the first back second link 334, and the latch plate 262 may be configured such that the first back latch distance $B_2$ is approximately equal to 78 mm.

Figure 12:
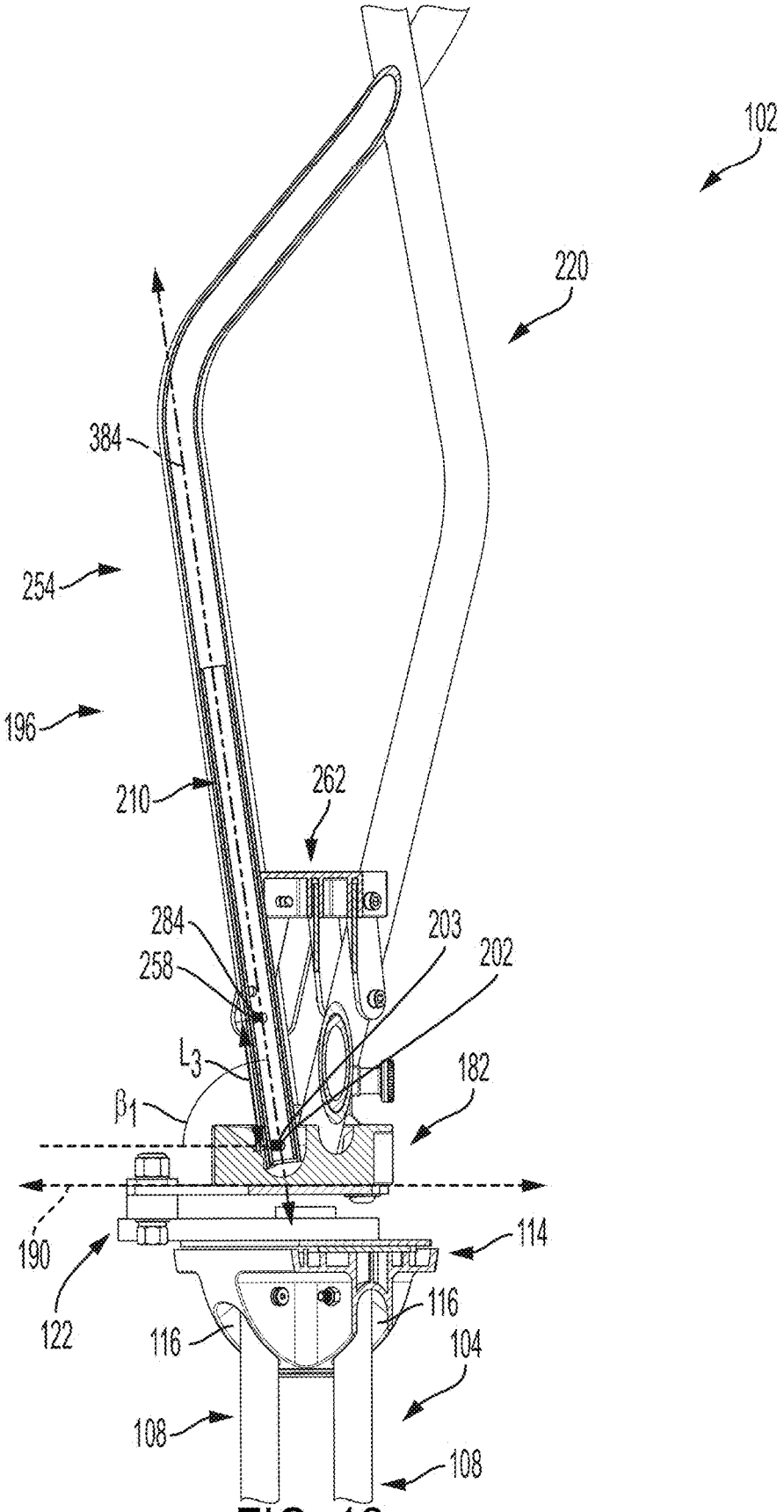
FIG. 12 is a cross-sectional view of the frame assembly shown in FIG. 9 taken along plane C-C.

FIG. 12 illustrates the first arm assembly 196 in greater detail. It is understood that the second arm assembly 208 may be configured analogously to the first arm assembly 196. The first arm base 198 is centered on a first arm base axis 384. In various embodiments, a portion of the first arm frame 254 is also centered on the first arm base axis 384. When the chair assembly 100 is in the collapsed state, the first arm base axis 384 is separated from a plane parallel to the mounting plane 190 by a first arm angle $\beta_1$ along a plane that is orthogonal to the mounting plane 190 and along which the first arm base axis 384 extends. In various embodiments, the first arm assembly 196 is configured such that the first arm angle $\beta_1$ is approximately equal to 65° to 85°, inclusive. For example, the first arm assembly 196 may be configured such that the first arm angle $\beta_1$ is approximately equal to 79.9°.

As is also shown in FIG. 12, the first arm assembly 196 is configured such that the first arm base joint aperture 203 is separated from the first arm base latch aperture 258 by the first arm base distance $L_3$. In various embodiments, the first arm base distance $L_3$ is approximately equal to 30 mm to 80 mm, inclusive. For example, the first arm assembly 196 may be configured such that the first arm base distance $L_3$ is approximately equal to 65 mm.

Figure 13:
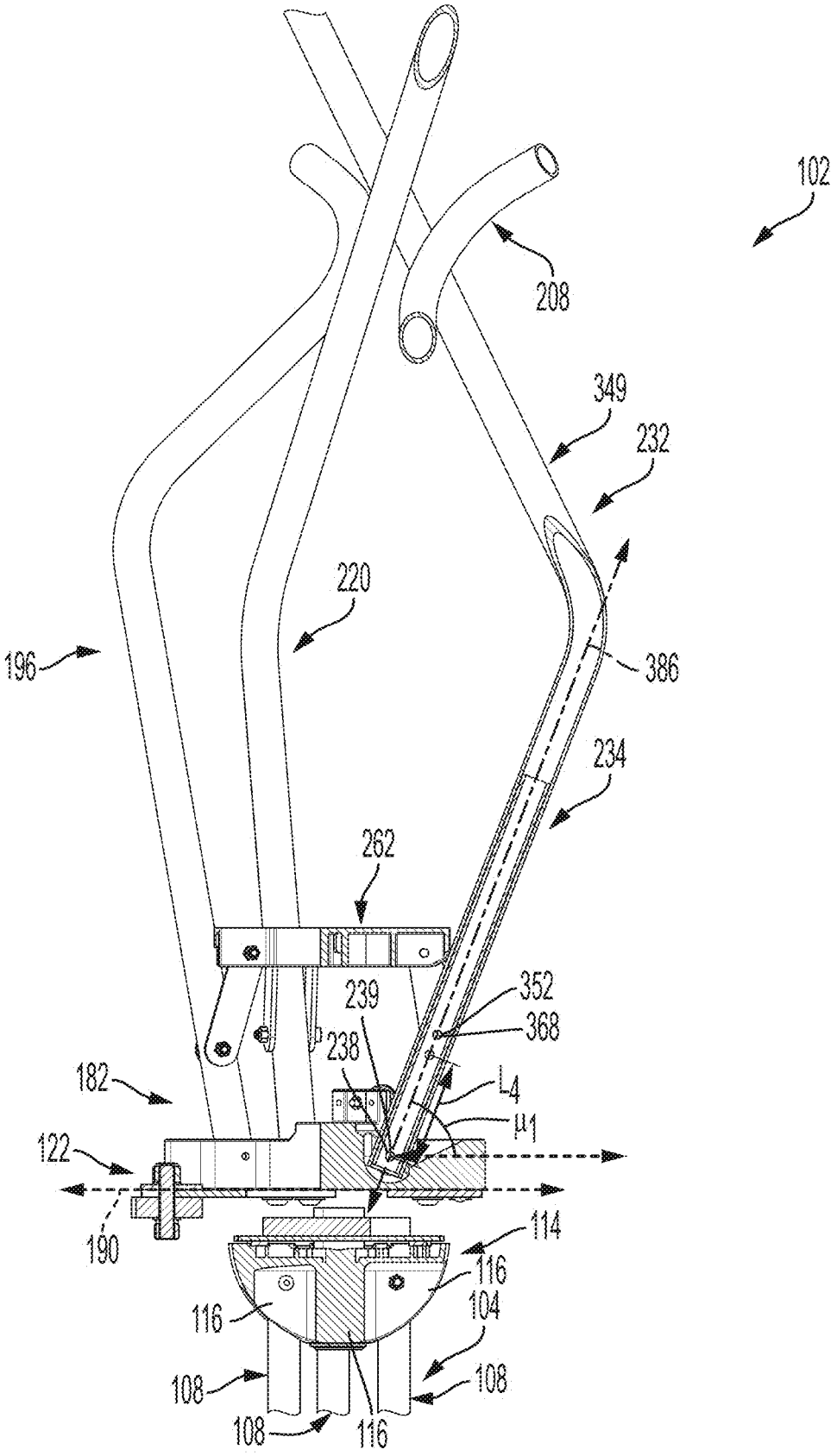
FIG. 13 is a cross-sectional view of the frame assembly shown in FIG. 9 taken along plane D-D.

FIG. 13 illustrates the second back assembly 232 in greater detail. It is understood that the first back assembly 220 may be configured analogously to the second back assembly 232. The second back base 234 is centered on a second back base axis 386. In various embodiments, a portion of the second back frame 349 is also centered on the second back base axis 386. When the chair assembly 100 is in the collapsed state, the second back base axis 386 is separated from a plane parallel to the mounting plane 190 by a second back angle $\mu_1$ along a plane that is orthogonal to the mounting plane 190 and along which the second back base axis 386 extends. In various embodiments, the second back assembly 232 is configured such that the second back angle $\mu_1$ is approximately equal to 55° to 85°, inclusive. For example, the second back assembly 232 may be configured such that the second back angle $\mu_1$ is approximately equal to 68.8°.

As is also shown in FIG. 13, the second back assembly 232 is configured such that the second back base joint aperture 239 is separated from the second back base latch aperture 352 by the second back base distance $L_4$. In various embodiments, the second back base distance $L_4$ is approximately equal to 30 mm to 80 mm, inclusive. For example, the second back assembly 232 may be configured such that the second back base distance $L_4$ is approximately equal to 49.5 mm.

The first arm assembly 196 and the second arm assembly 208 are each defined by an arm angular travel between the chair assembly 100 being in the collapsed state and the chair assembly 100 being in the expanded state. In various embodiments, the first arm assembly 196 and the second arm assembly 208 are each configured such that the arm angular travel is approximately equal to 30° to 60°, inclusive. For example, the first arm assembly 196 and the second arm assembly 208 may be each configured such that the arm angular travel is approximately equal to 46.7°.

The first back assembly 220 and the second back assembly 232 are each defined by an arm angular travel between the chair assembly 100 being in the collapsed state and the chair assembly 100 being in the expanded state. In various embodiments, the first back assembly 220 and the second back assembly 232 are each configured such that the arm angular travel is approximately equal to 30° to 60°, inclusive. For example, the first back assembly 220 and the second back assembly 232 may be each configured such that the arm angular travel is approximately equal to 41.8°.

The base assembly 104 is configured such that a first adjacent pair of the feet 106 are separated by a first width $A_1$. In various embodiments, the base assembly 104 is configured such that the first width $A_1$ is approximately equal to between 400 mm and 700 mm. For example, the base assembly 104 may be configured such that the first width $A_1$ is approximately equal to 488 mm.

The base assembly 104 is also configured such that a second adjacent pair of the feet 106 are separated by a second width $A_2$. In various embodiments, the base assembly 104 is configured such that the second width $A_2$ is approximately equal to between 400 mm and 700 mm. For example, the base assembly 104 may be configured such that the second width $A_2$ is approximately equal to 488 mm. In some embodiments, the base assembly 104 is configured such that the first width $A_1$ is equal to the second width $A_2$.

In some embodiments, the frame assembly 102 is constructed such that a weight of the frame assembly 102 is less than or equal to 20 pounds. For example, various components of the frame assembly 102 may be constructed from tubular aluminum.

Figure 14:
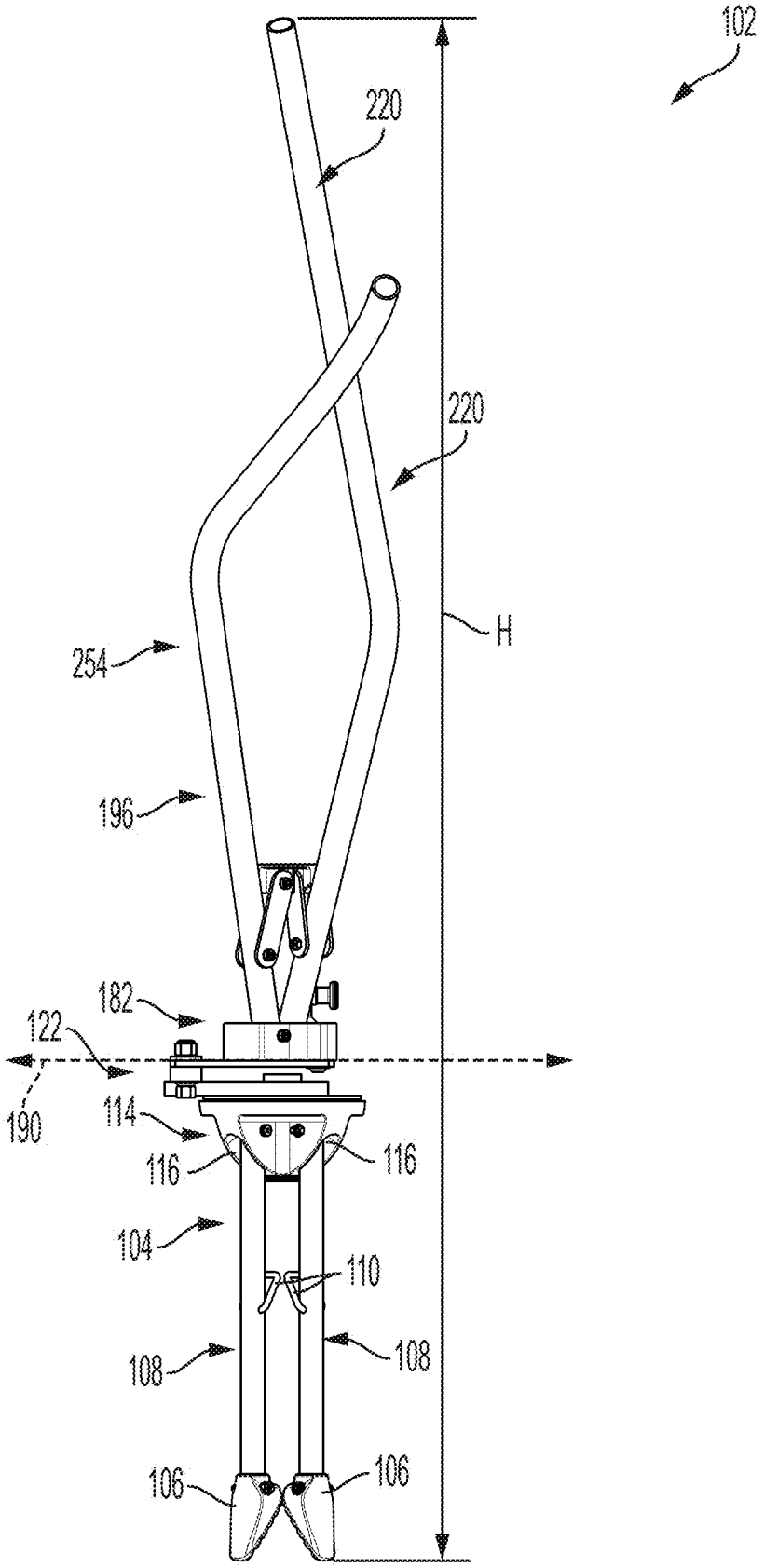
FIG. 14 is a side view of the frame assembly in the collapsed state.
Figure 15:
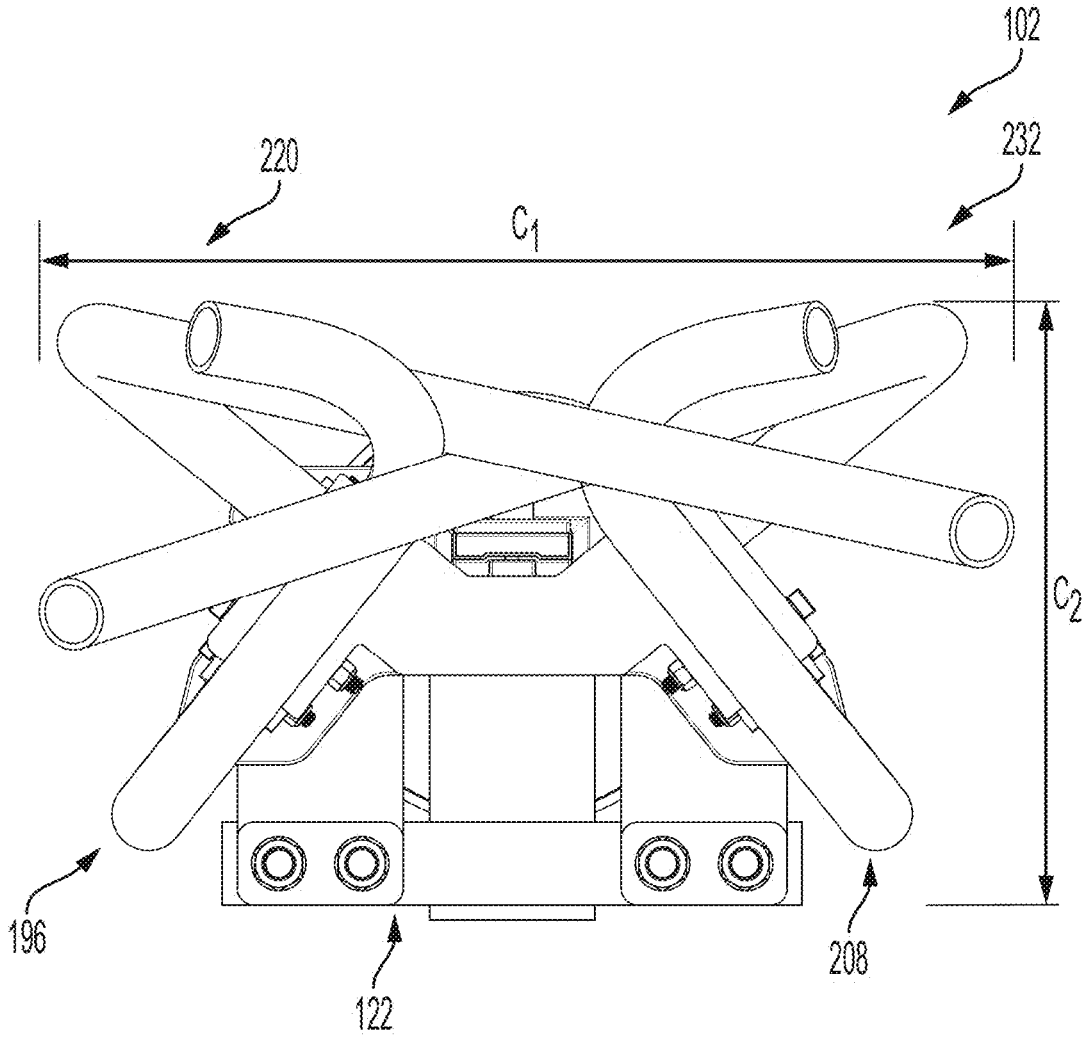
FIG. 15 is a top view of the frame assembly in the collapsed state.

FIGS. 14 and 15 illustrates the frame assembly 102 in the collapsed state. The frame assembly 102 is configured such that the feet 106 are separated from a farthest edge of the first back assembly 220 by a height H measured along a plate orthogonal to the mounting plane 190 when the chair assembly 100 is in the collapsed state. In various embodiments, the frame assembly 102 is configured such that the height H is approximately equal to between 800 mm and 1600 mm. For example, the frame assembly 102 may be configured such that the height H is approximately equal to 1227.2 mm.

When the chair assembly 100 is in the collapsed state, the frame assembly 102 is defined by a width $C_1$ along the mounting plane 190 and a depth $C_2$ along the mounting plane 190. The width $C_1$ is defined from a farthest edge of the first back assembly 220 to a farthest edge of the second back assembly 232. In various embodiments, the frame assembly 102 is configured such that the width $C_1$ is approximately equal to between 100 mm and 400 mm. For example, the frame assembly 102 may be configured such that the width $C_1$ is approximately equal to 284.25 mm. The depth $C_2$ is defined from a farthest edge of the first back assembly 220 to a farthest edge of the first arm assembly 196. In various embodiments, the frame assembly 102 is configured such that the depth $C_2$ is approximately equal to between 100 mm and 400 mm. For example, the frame assembly 102 may be configured such that the depth $C_2$ is approximately equal to 183.43 mm.

Figure 20:
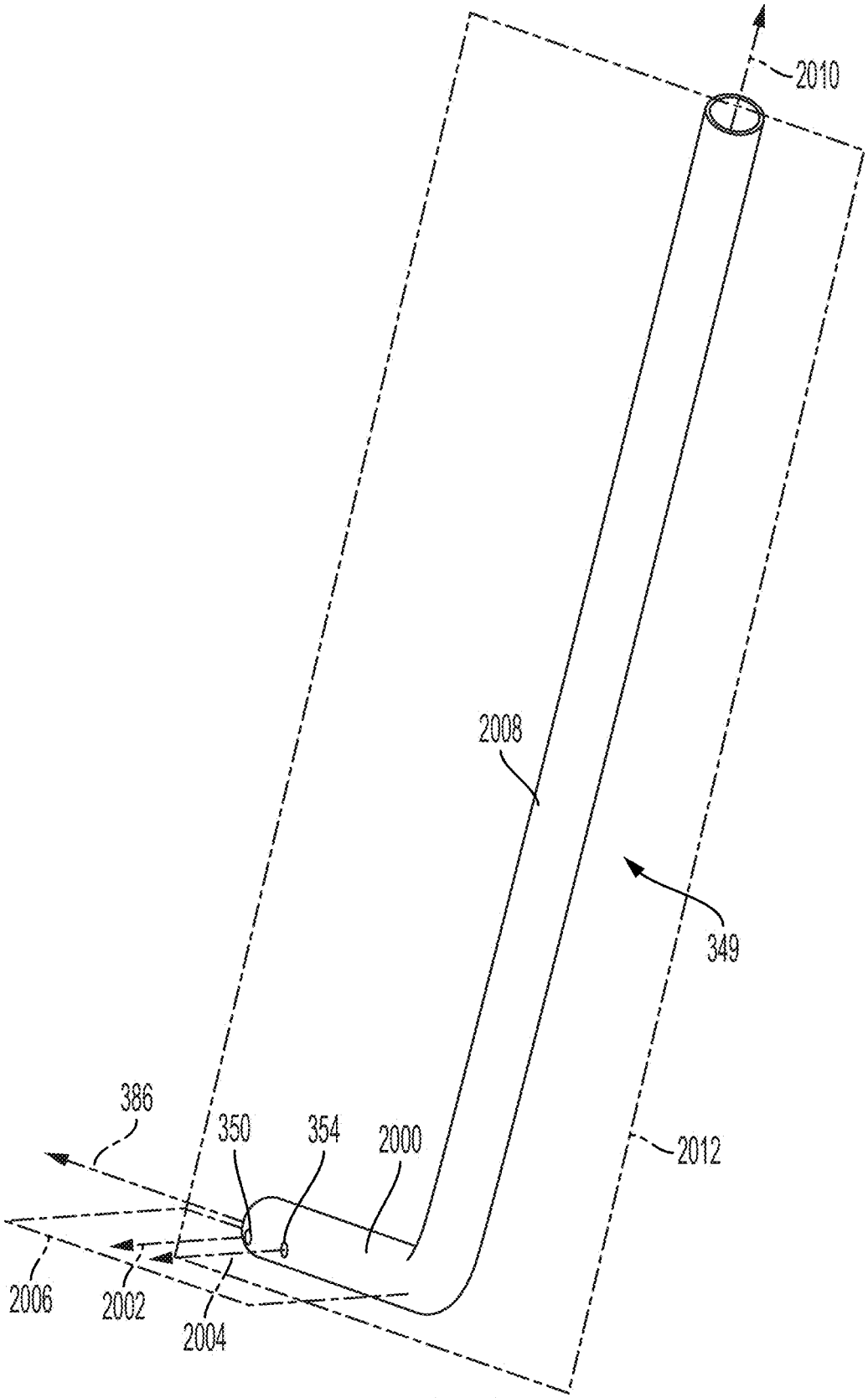
FIG. 20 is a perspective view of a first back of the frame assembly.
Figure 21:
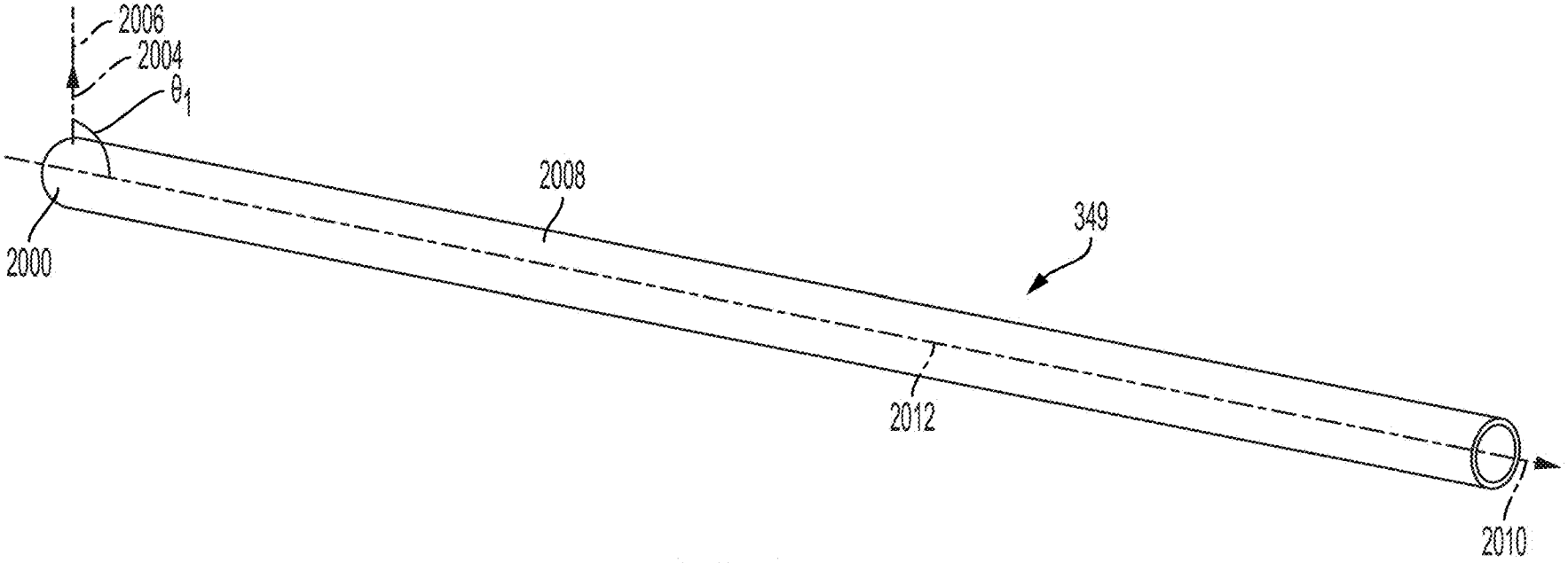
FIG. 21 is a side view of the first back.
Figure 22:
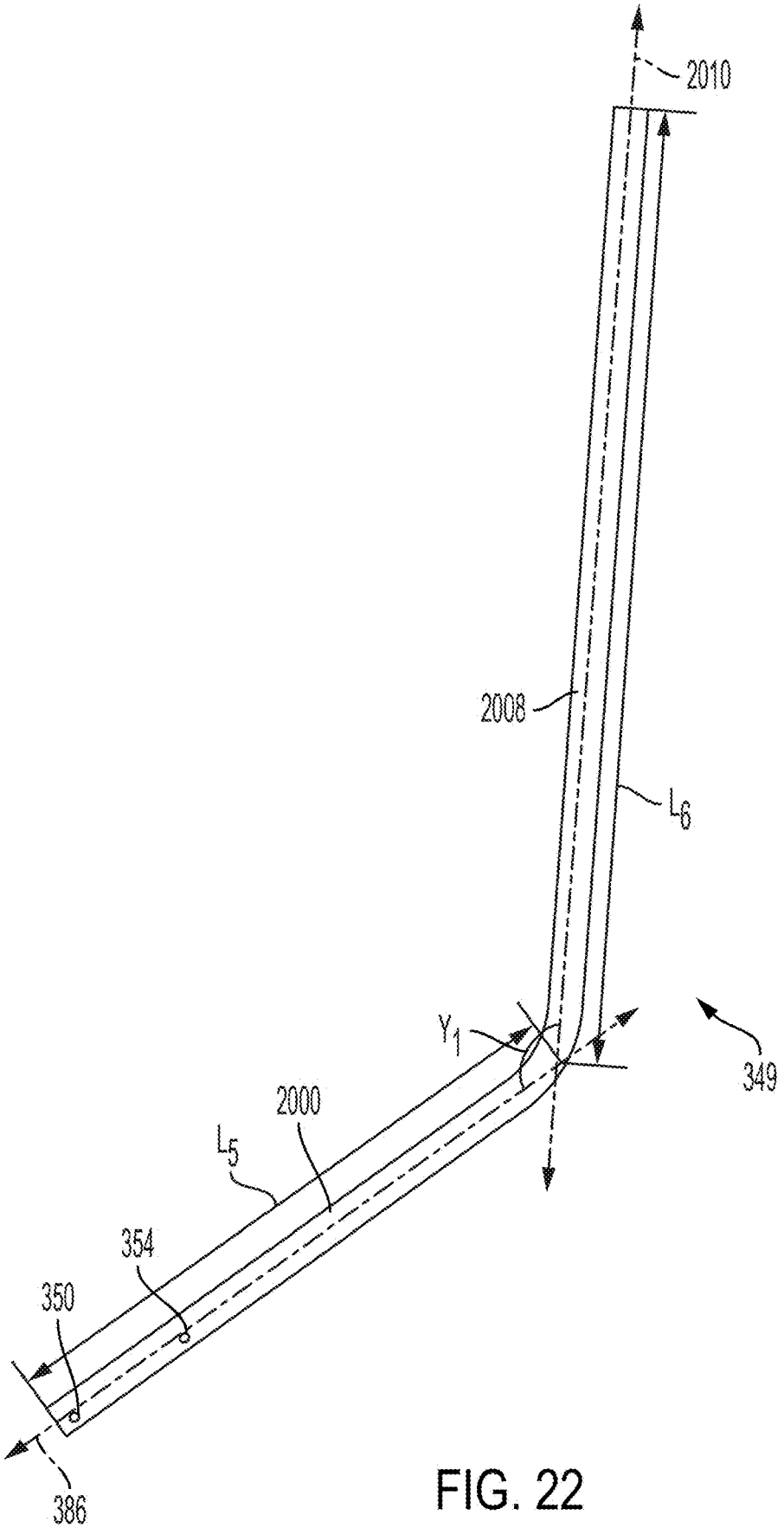
FIG. 22 is a front view of the first back.

FIGS. 20-22 illustrate the second back frame 349 in greater detail. It is understood that the first back frame 319 may be configured analogously to the second back frame 349. The second back frame 349 includes a back connector portion 2000 (e.g., lower portion, etc.). The back connector portion 2000 is centered on the second back base axis 386. The second back frame joint aperture 350 and the second back frame latch aperture 354 are disposed on the back connector portion 2000.

The second back frame joint aperture 350 is centered on a second back frame joint aperture axis 2002. In various embodiments, the second back frame joint aperture axis 2002 intersects the second back base axis 386. The second back frame latch aperture 354 is centered on second back frame latch aperture axis 2004. In various embodiments, the second back frame latch aperture axis 2004 intersects the second back base axis 386.

In various embodiments, the second back frame joint aperture axis 2002 is parallel to the second back frame latch aperture axis 2004. The second back frame joint aperture axis 2002 and the second back frame latch aperture axis 2004 are disposed along a back aperture plane 2006. In various embodiments, the second back base axis 386 extends along the back aperture plane 2006.

The second back frame 349 also includes a back frame portion 2008 (e.g., upper portion, etc.). The back frame portion 2008 is centered on a back frame portion axis 2010. The back frame portion axis 2010 intersects the second back base axis 386. The back frame portion axis 2010 and the second back base axis 386 extend along a back frame plane 2012. The back frame plane 2012 intersects the back aperture plane 2006.

As shown in FIG. 21, the back frame plane 2012 is separated from the back aperture plane 2006 by a back frame aperture angle $\theta_1$ along a plane that is orthogonal to the back frame plane 2012 and the back aperture plane 2006 and along which the back frame plane 2012 and the back aperture plane 2006 extend. In various embodiments, the second back frame 349 is configured such that the back frame aperture angle $\theta_1$ is approximately equal to 5° to 25°, inclusive. For example, the second back frame 349 may be configured such that the back frame aperture angle $\theta_1$ is approximately equal to 13.66°.

As shown in FIG. 22, the back connector portion 2000 is defined by a back connector portion length $L_5$ along the second back base axis 386. In various embodiments, the second back frame 349 is configured such that the back connector portion length $L_5$ is approximately equal to between 200 mm and 500 mm. For example, the second back frame 349 may be configured such that the back connector portion length $L_5$ is approximately equal to 357 mm.

Similarly, the back frame portion 2008 is defined by a back frame portion length $L_6$ along the back frame portion axis 2010. In various embodiments, the second back frame 349 is configured such that the back frame portion length $L_6$ is approximately equal to between 400 mm and 700 mm. For example, the second back frame 349 may be configured such that the back frame portion length $L_6$ is approximately equal to 555 mm.

Additionally, as shown in FIG. 22, the second back base axis 386 is separated from the back frame portion axis 2010 by a back frame bend angle $\gamma_1$ along a plane upon which the second back base axis 386 and the back frame portion axis 2010 extend. In various embodiments, the second back frame 349 is configured such that the back frame bend angle $\gamma_1$ is approximately equal to 110° to 145°, inclusive. For example, the second back frame 349 may be configured such that the back frame bend angle $\gamma_1$ is approximately equal to 129.6°.

Figure 23:
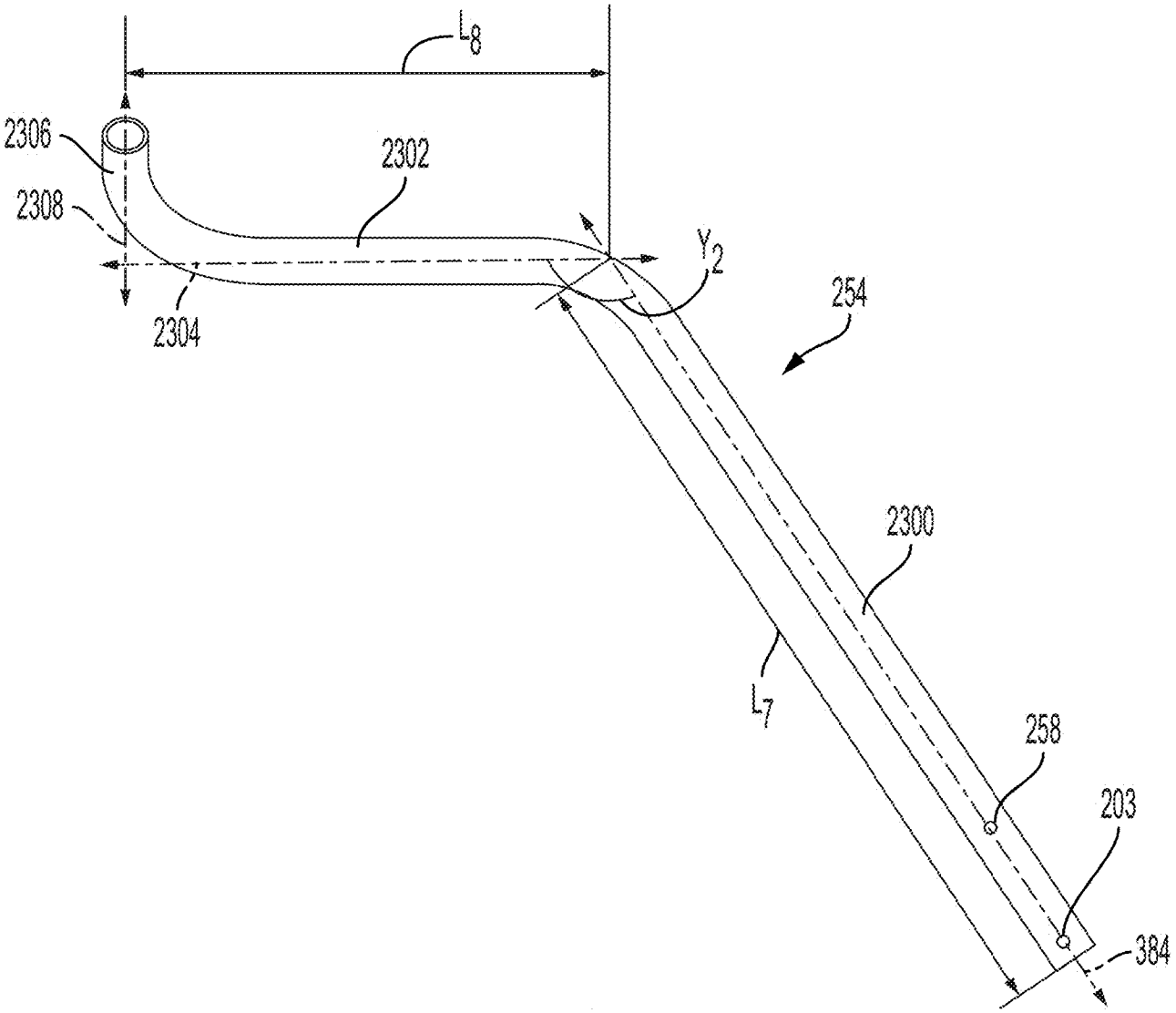
FIG. 23 is a side view of a first arm of the frame assembly.
Figure 24:
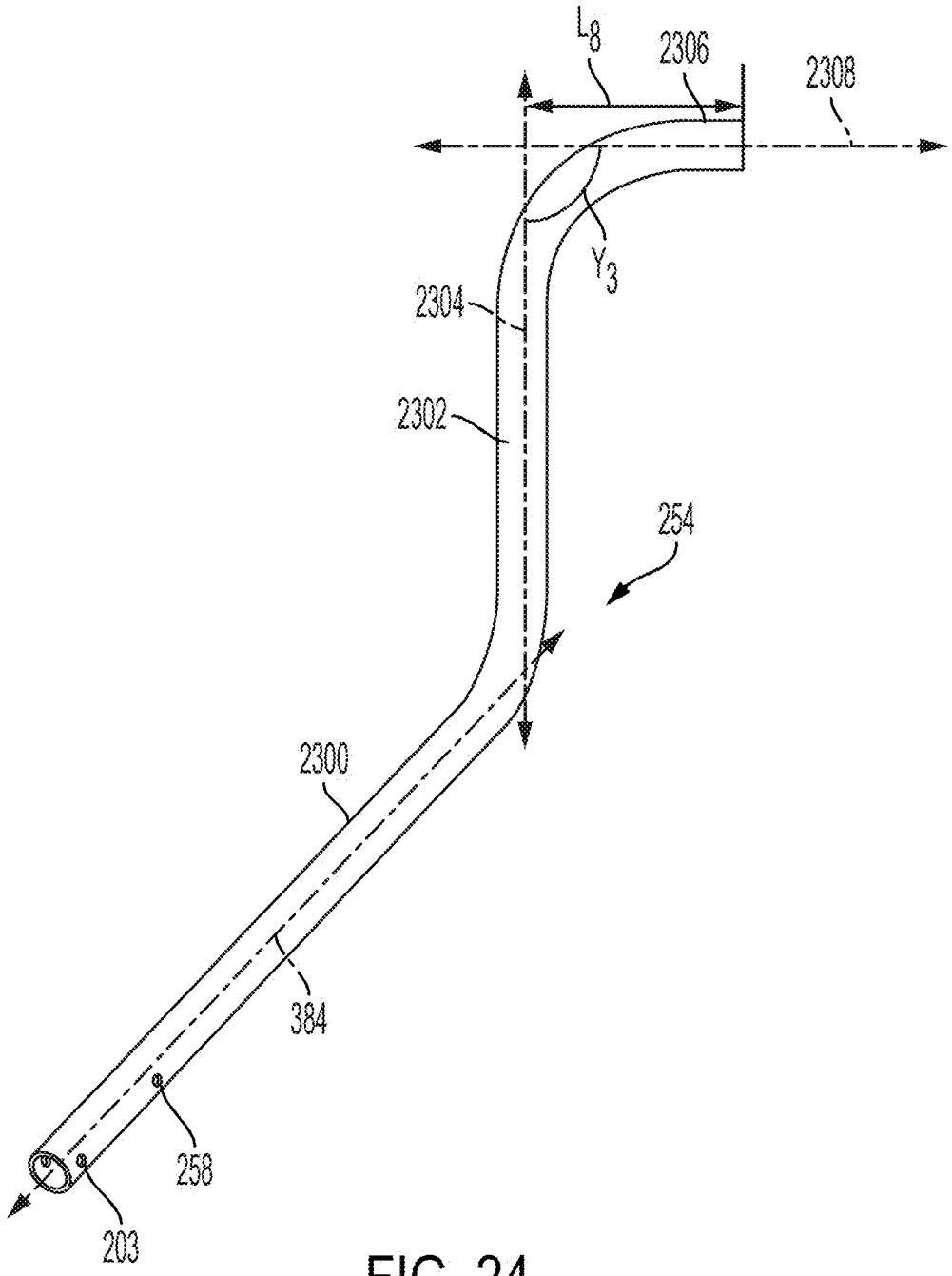
FIG. 24 is a rear view of the first arm.

FIGS. 23 and 24 illustrate the first arm frame 254 in greater detail. It is understood that the second arm frame 288 may be configured analogously to the first arm frame 254. The first arm frame 254 includes an arm connector portion 2300 (e.g., lower portion, etc.). The arm connector portion 2300 is centered on the first arm base axis 384. The first arm base joint aperture 203 and the first arm base latch aperture 258 are disposed on the arm connector portion 2300.

The first arm frame 254 also includes an arm frame portion 2302 (e.g., upper portion, etc.). The arm frame portion 2302 is centered on an arm frame portion axis 2304. The arm frame portion axis 2304 intersects the first arm base axis 384. As shown in FIG. 23, the arm connector portion 2300 is defined by an arm connector portion length $L_7$ along the first arm base axis 384. In various embodiments, the first arm frame 254 is configured such that the arm connector portion length $L_7$ is approximately equal to between 300 mm and 500 mm. For example, the first arm frame 254 may be configured such that the arm connector portion length $L_7$ is approximately equal to 405.5 mm.

Similarly, the arm frame portion 2302 is defined by an arm frame portion length $L_8$ along the arm frame portion axis 2304. In various embodiments, the first arm frame 254 is configured such that the arm frame portion length La is approximately equal to between 100 mm and 300 mm. For example, the first arm frame 254 may be configured such that the arm frame portion length La is approximately equal to 235 mm.

Additionally, as shown in FIG. 23, the first arm base axis 384 is separated from the arm frame portion axis 2304 by an arm frame bend angle $\gamma_2$ along a plane upon which the first arm base axis 384 and the arm frame portion axis 2304 extend. In various embodiments, the first arm frame 254 is configured such that the arm frame bend angle $\gamma_2$ is approximately equal to 110° to 145°, inclusive. For example, the first arm frame 254 may be configured such that the arm frame bend angle $\gamma_2$ is approximately equal to 123.2°.

The first arm frame 254 also includes an arm end portion 2306 (e.g., upper portion, etc.). The arm end portion 2306 is centered on an arm end portion axis 2308. The arm end portion axis 2308 intersects arm frame portion axis 2304. The arm frame portion axis 2304 and the first arm base axis 384.

As shown in FIG. 24, the arm end portion axis 2308 is separated from the arm frame portion axis 2304 by an arm end bend angle $\gamma_3$ along a plane upon which the arm end portion axis 2308 and the arm frame portion axis 2304 extend. In various embodiments, the first arm frame 254 is configured such that the arm end bend angle $\gamma_3$ is approximately equal to 70° to 110°, inclusive. For example, the first arm frame 254 may be configured such that the arm end bend angle $\gamma_3$ is approximately equal to 90°.

The arm end portion 2306 is defined by an arm end portion length $L_9$ along the arm end portion axis 2308. In various embodiments, the arm end portion 2306 is configured such that the arm end portion length $L_9$ is approximately equal to between 80 mm and 110 mm. For example, the arm end portion 2306 may be configured such that the arm end portion length $L_9$ is approximately equal to 98.4 mm.

As shown in FIG. 25, the latch plate 262 includes a latch opening 2500 and a latch ramp 2502. The latch opening 2500 is configured to receive the latch pin 250. The latch opening 2500 is configured to cooperate with the latch pin 250 to retain the chair assembly 100 in the collapsed state. The latch ramp 2502 may interface with the latch pin 250 during transitioning of the chair assembly 100 from the expanded state to the collapsed state.

The chair assembly 100 also includes a cover 2510 (e.g., wrap, etc.). The cover 2510 is coupled to the frame assembly 102 and defines a seat when the chair assembly 100 is in the expanded state. The cover 2510 is flexible and is configured to collapse as the chair assembly 100 is transitioned from the expanded state to the collapsed state and to expand as the chair assembly 100 is transitioned from the collapsed state to the expanded state. In various embodiments, the cover 2510 is constructed from a fabric material (e.g., nylon, synthetic fabric, etc.). The cover 2510 is coupled to the first arm assembly 196 (e.g., the arm end portion 2306, etc.), the second arm assembly 208 (e.g., an arm end portion of the second arm assembly, etc.), the first back assembly 220 (e.g., a back frame portion of the first back assembly 220, etc.), and the second back assembly 232 (e.g., the back frame portion 2008, etc.). The cover 2510 may include multiple panels which variously shape the seat provided when the chair assembly 100 is in the expanded state.

While the chair assembly 100 is shown and described above as including four of the legs 108, it is understood that the chair assembly 100 may be variously configured to have greater or fewer numbers of the legs 108, so as to be tailored to a target application. Corresponding modifications to the chair assembly 100 would also be understood as being described. For example, where the chair assembly 100 includes six of the legs 108, the base mount 114 includes six of the base couplers 116.

II. Second Example Chair Assembly

FIGS. 26-45 illustrate the chair assembly 100 according to various embodiments. The chair assembly 100 shown in FIGS. 26-45 is similar to the chair assembly 100 shown in FIGS. 1-25 unless otherwise indicated to the contrary. Features of the chair assembly 100 shown in FIGS. 1-25 may be present in the chair assembly 100 shown in FIGS. 26-45, and features of the chair assembly 100 shown in FIGS. 26-45 may be present in the chair assembly 100 shown in FIGS. 1-25.

Figure 26:
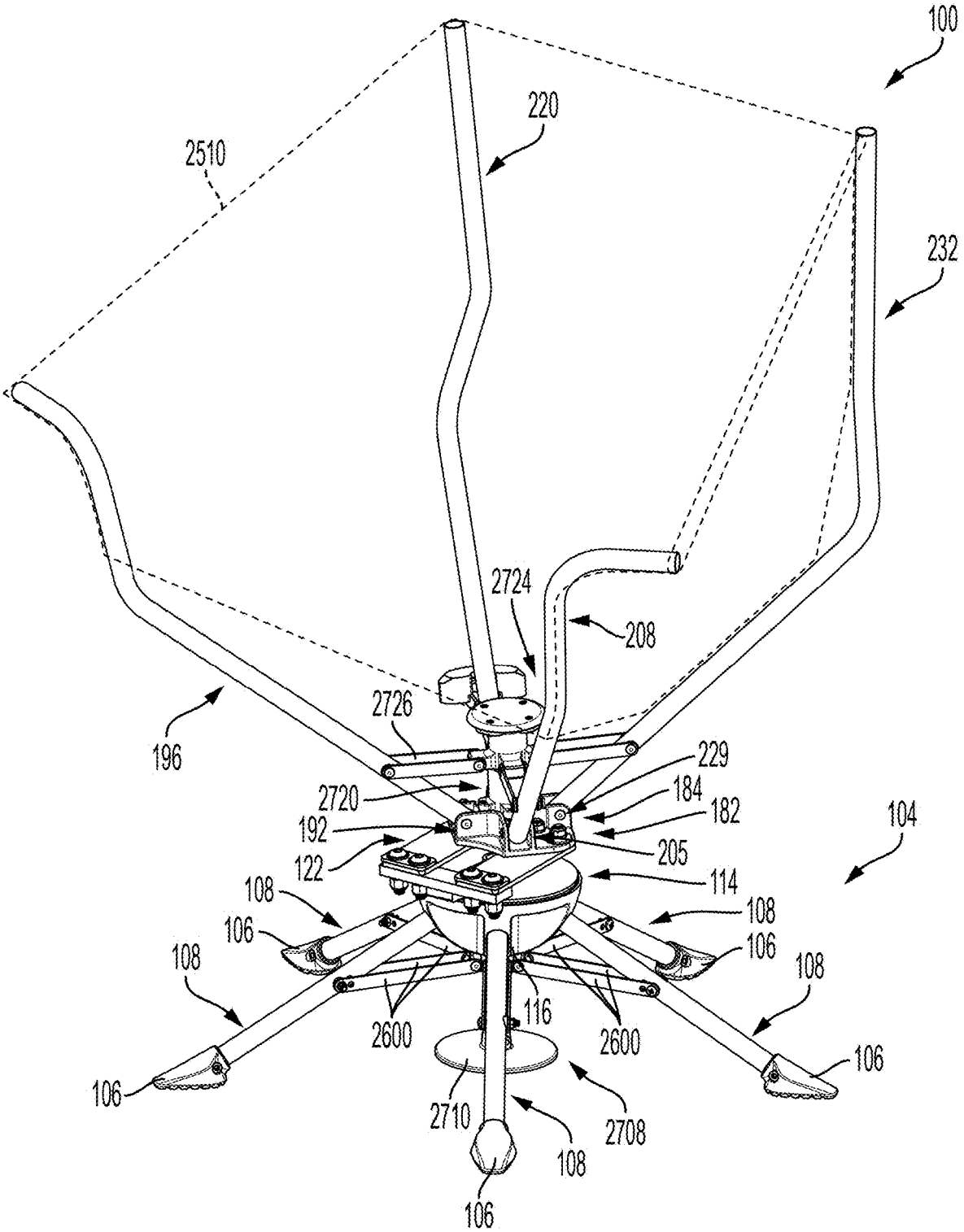
FIG. 26 is a perspective view of a chair assembly in an expanded state.
Figure 27:
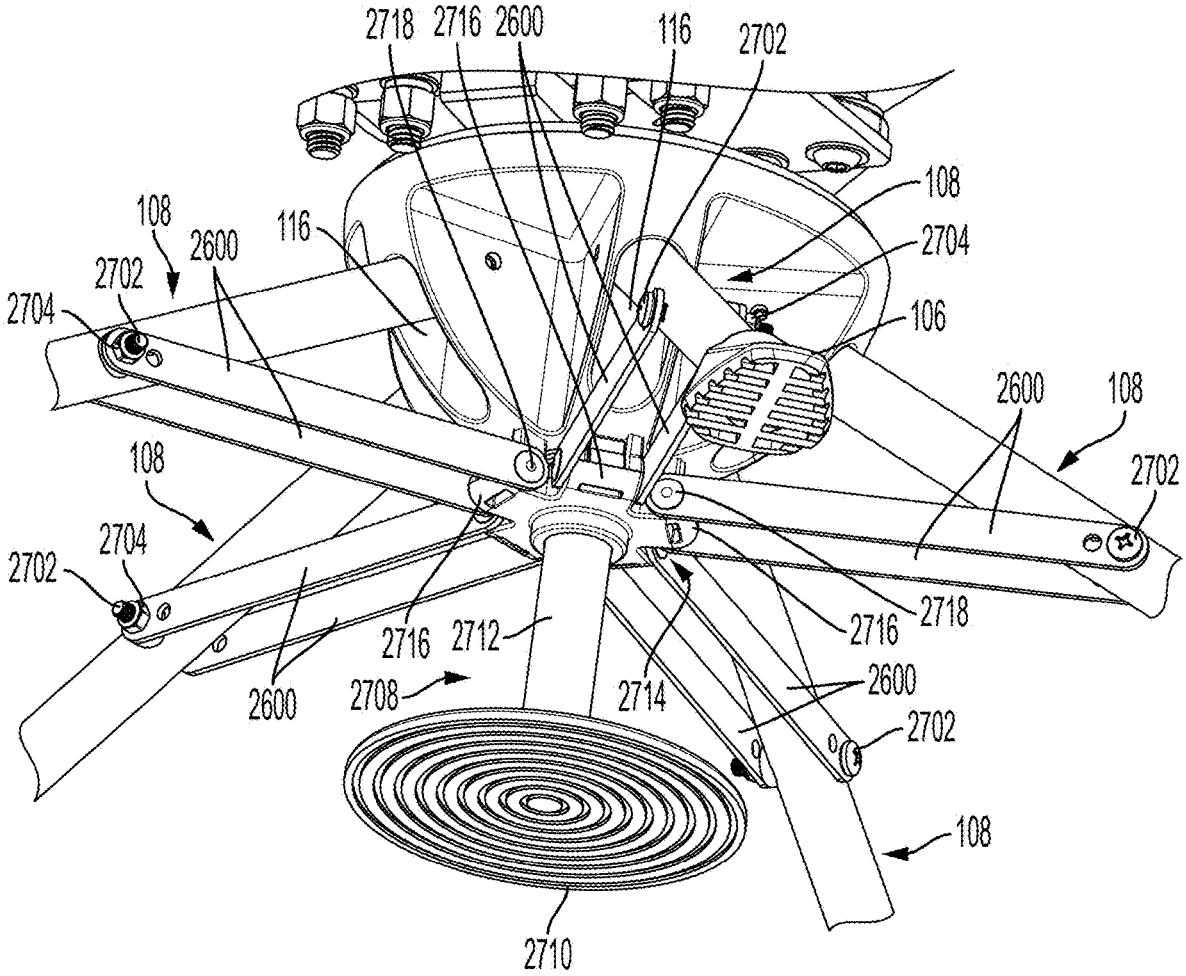
FIG. 27 is a bottom perspective view of a portion of the chair assembly in the expanded state.

As shown in FIG. 26, the legs 108 do not include the brace connectors 110 and the base assembly 104 does not include the plurality of braces 112. Instead, the base assembly 104 includes a plurality of leg links 2600 and a center post assembly 2708. The leg links 2600 are similar to the links described with respect to the chair assembly 100 shown in FIGS. 26-45, such as the first back first link 330. Two of the leg links 2600 are utilized for each of the legs 108. Fasteners 2702, similar to the first arm latch fastener 276, and nuts 2704, similar to the first arm latch nut 278, couple the leg links 2600 to the legs 108.

The center post assembly 2708 cooperates with the legs 108 to convey force to the ground surface. The center post assembly 2708 includes a center foot 2710 (e.g., shoe, cleat, etc.). The center foot 2710 contacts the ground surface. In various embodiments, the center foot 2710 includes a textured surface that is configured to engage the ground surface so as to resist movement of the center foot 2710 relative to the ground surface. The center foot 2710 may be constructed of plastic or rubber, for example. The center post assembly 2708 is configured such that the center foot 2710 contacts the ground surface when the feet 106 contact the ground surface. For example, a length of the post 2712 may be selected based on a length of the legs 108 and/or the leg links 2600.

In various embodiments, the center foot 2710 has a larger contact area than any one of the feet 106. This enlarged contact area may accommodate increased force conveyed to the center post assembly 2708 because the center foot 2710 is directly underneath a user seated in the chair assembly 2310.

The center post assembly 2708 also includes a post 2712 (e.g., pillar, pipe, beam, etc.). The post 2712 is coupled to the center foot 2710. The center post assembly 2708 also includes a center post base 2714 (e.g., plate, etc.). The center post base 2714 is positioned below the base mount 114. However, the center post base 2714 is not coupled to the base mount 114. As discussed in more detail below, the center post base 2714 is movable with respect to the base mount 114.

Figure 29:
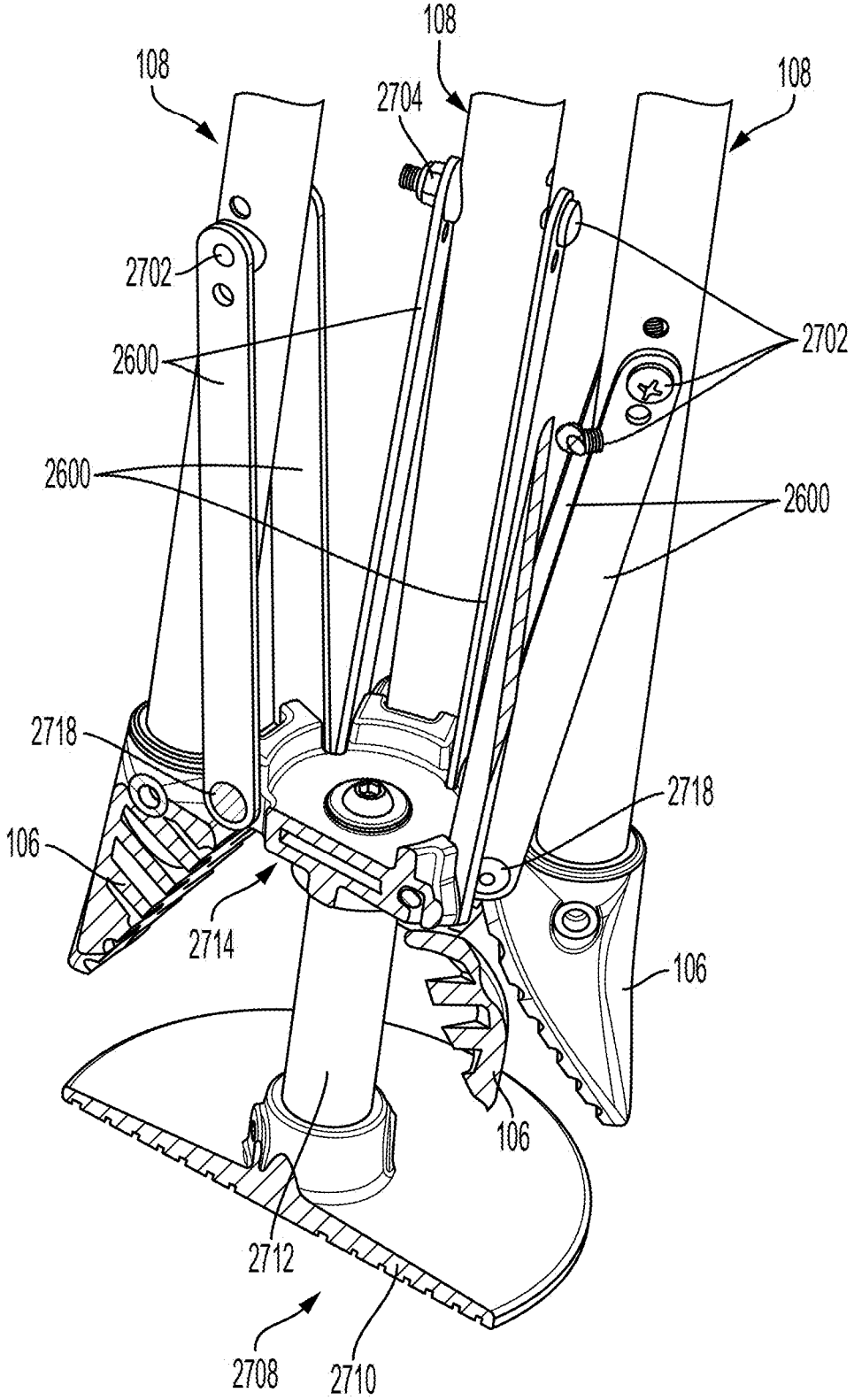
FIG. 29 is a cross-sectional view of a bottom perspective view of a portion of the chair assembly in the collapsed state.
Figure 30:
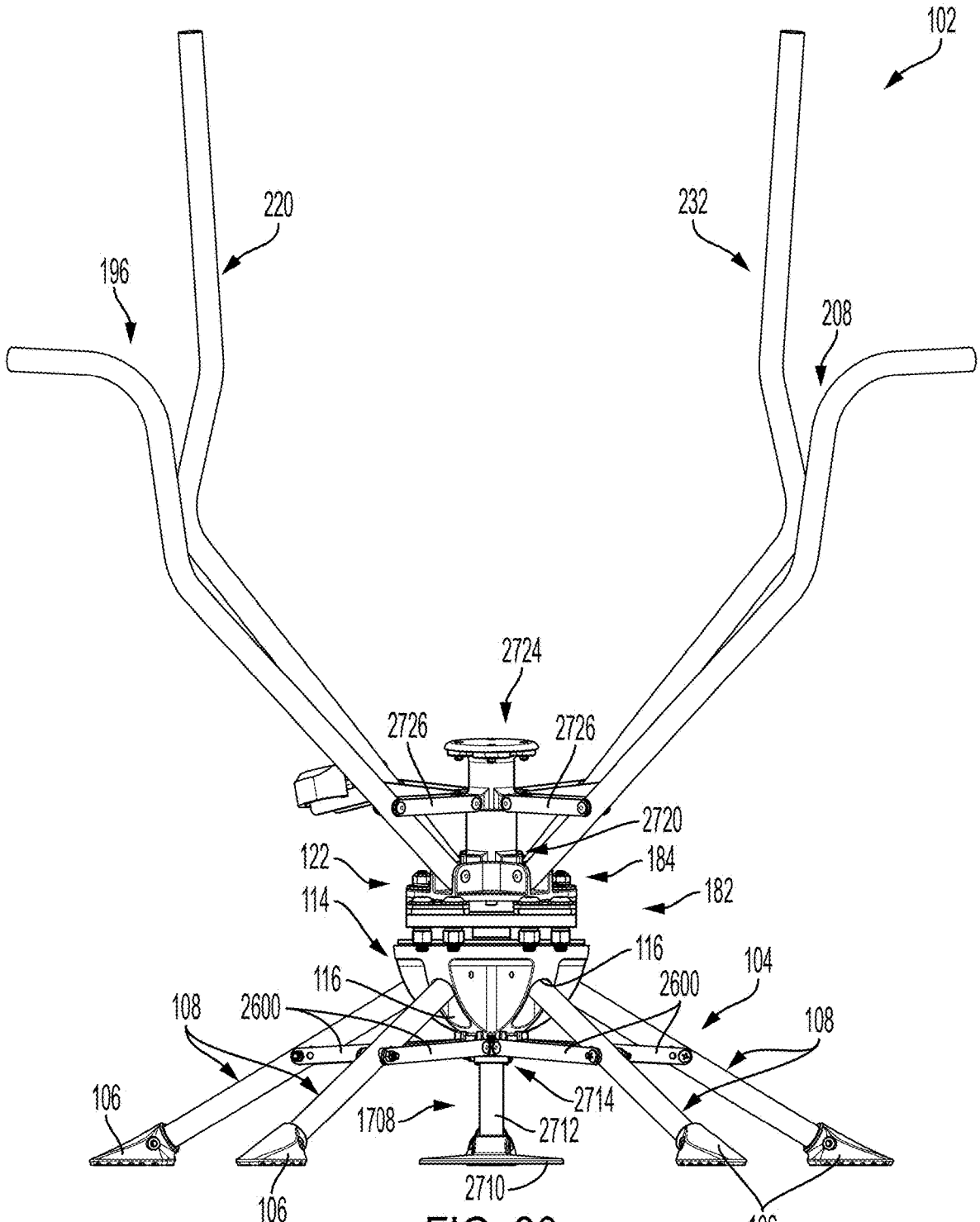
FIG. 30 is a front view of the chair assembly in the expanded state.
Figure 31:
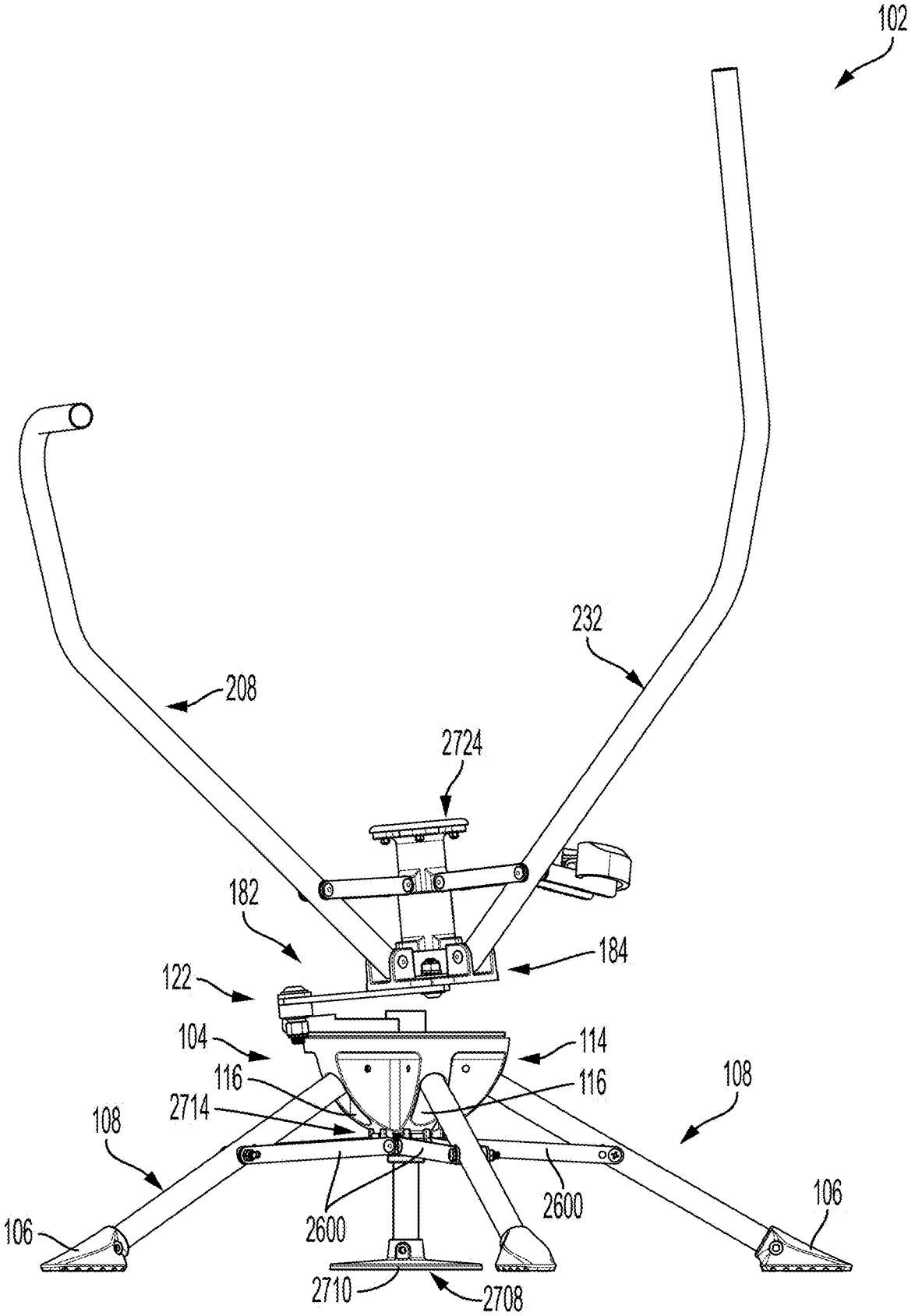
FIG. 31 is a side view of the chair assembly in the expanded state.
Figure 32:
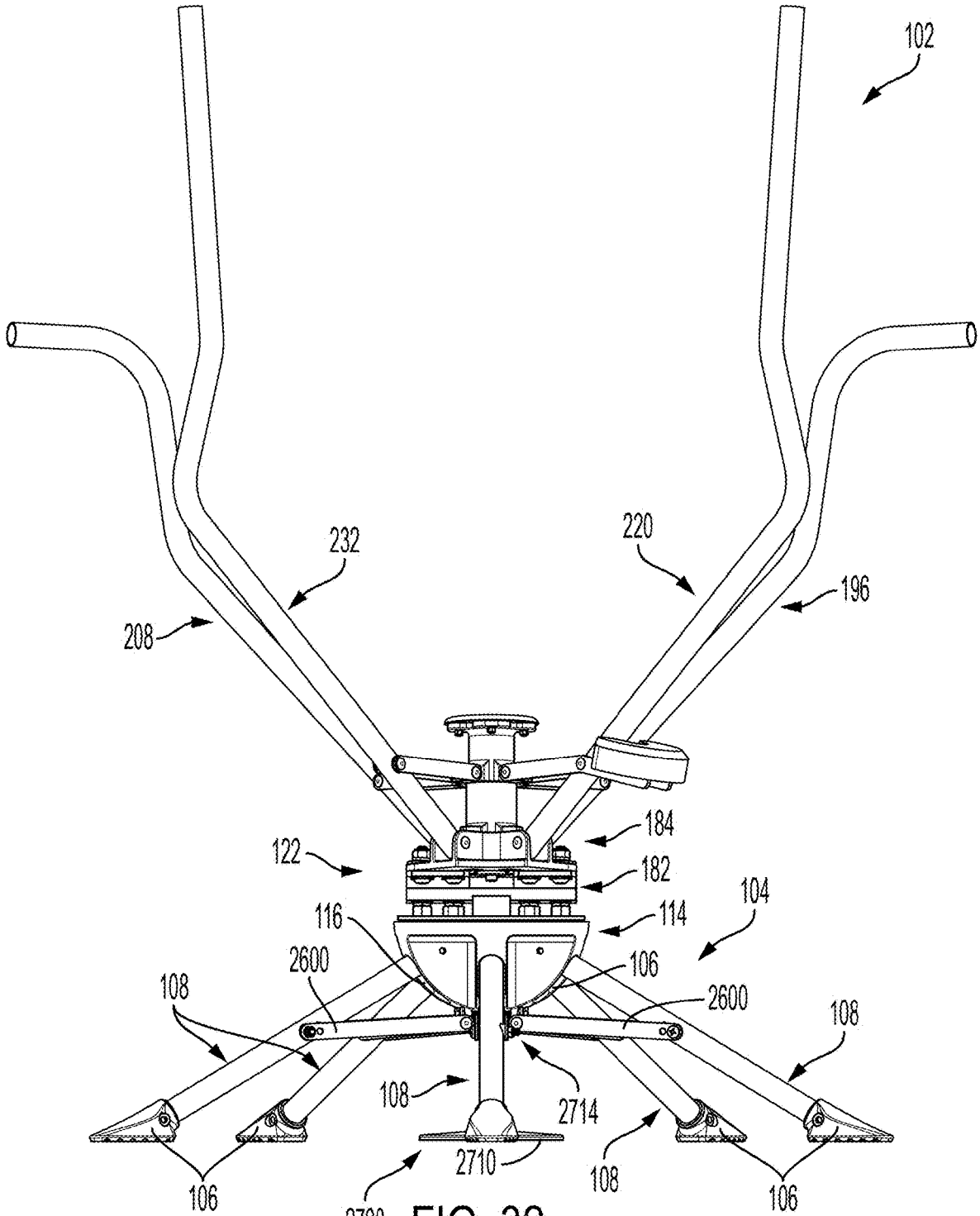
FIG. 32 is a rear view of the chair assembly in the expanded state.
Figure 33:
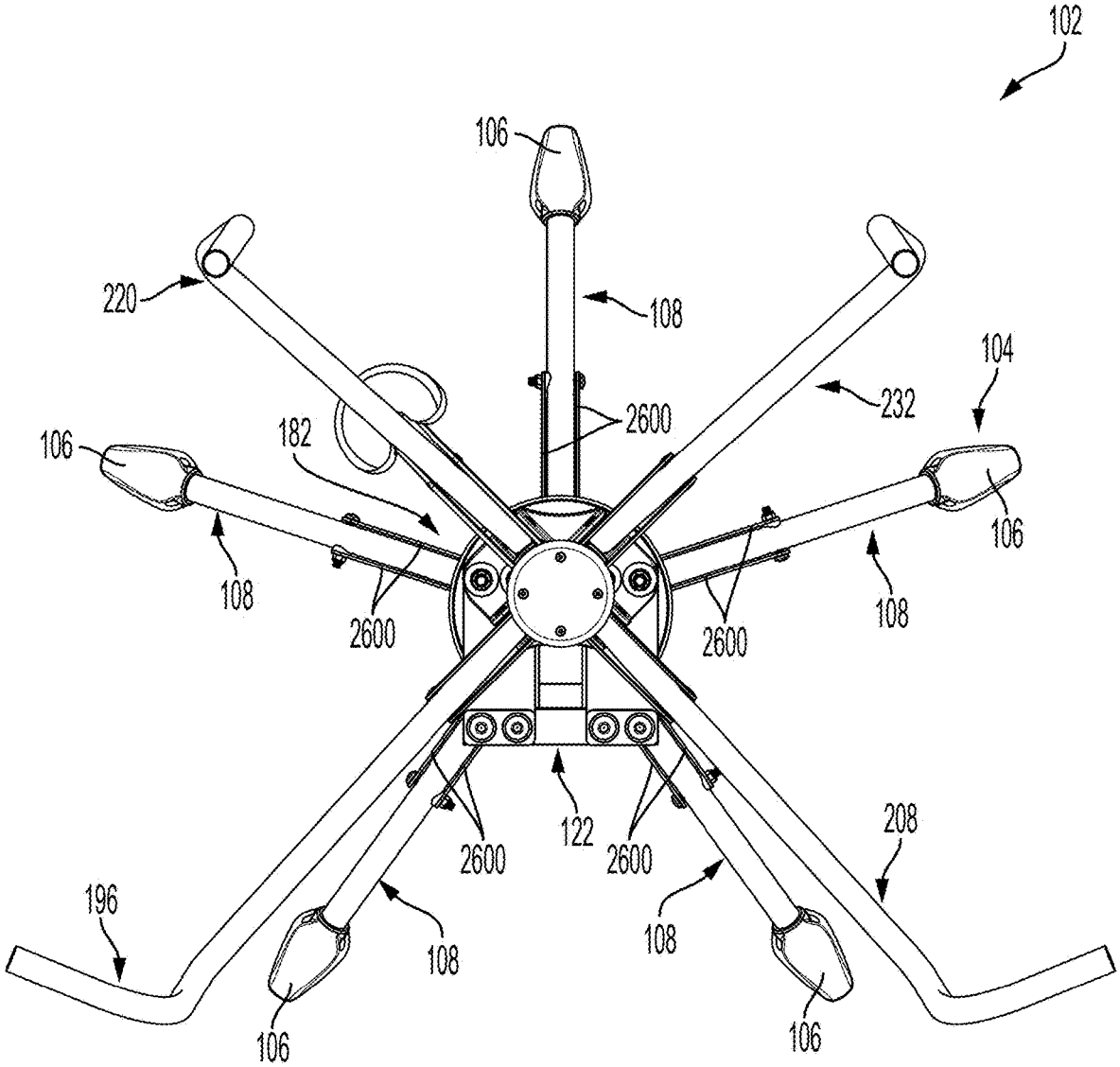
FIG. 33 is a top view of the chair assembly in the expanded state.
Figure 34:
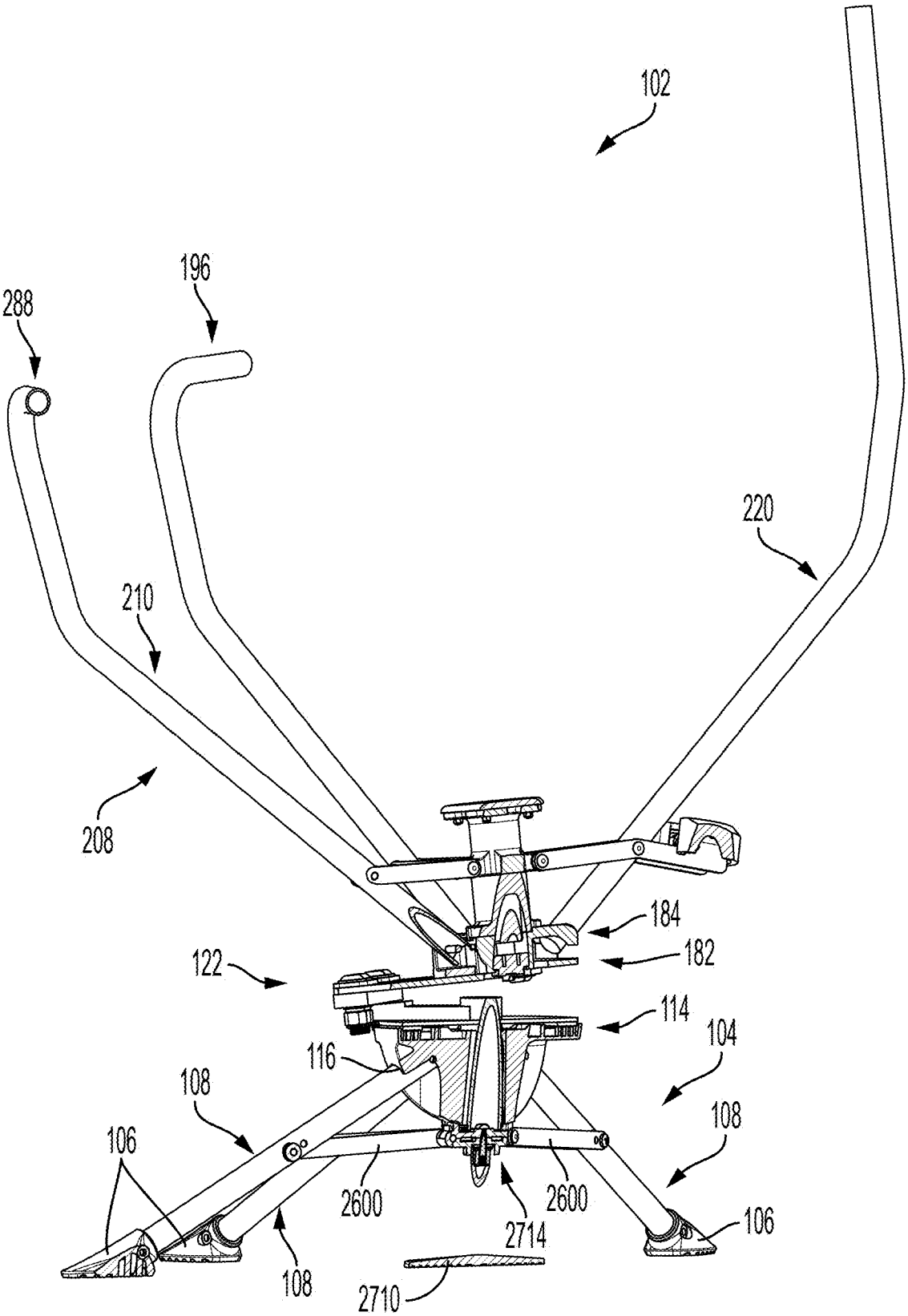
FIG. 34 is a cross-sectional side view of the chair assembly in the expanded state.
Figure 35:
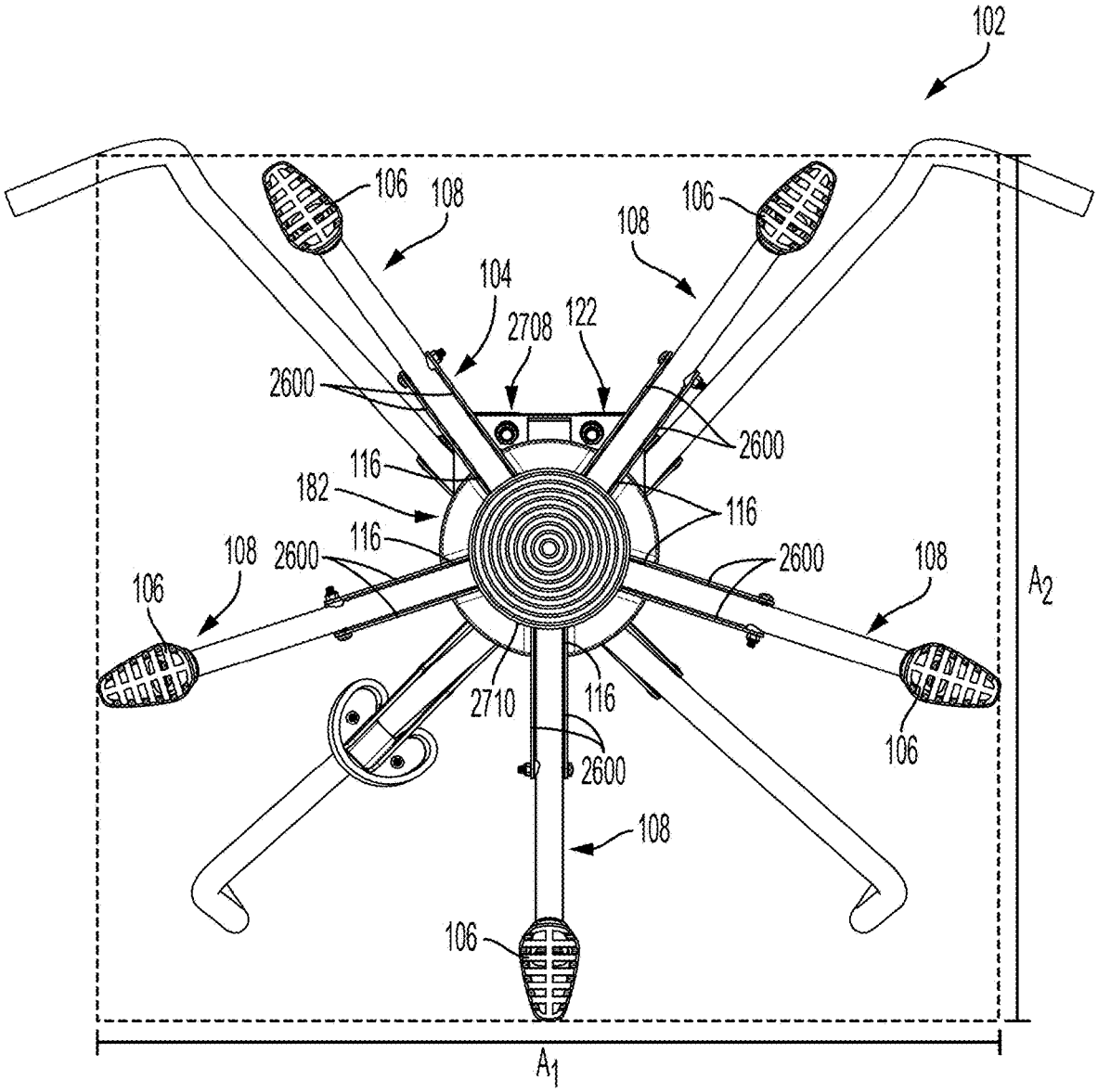
FIG. 35 is a bottom view of the chair assembly in the expanded state.
Figure 36:
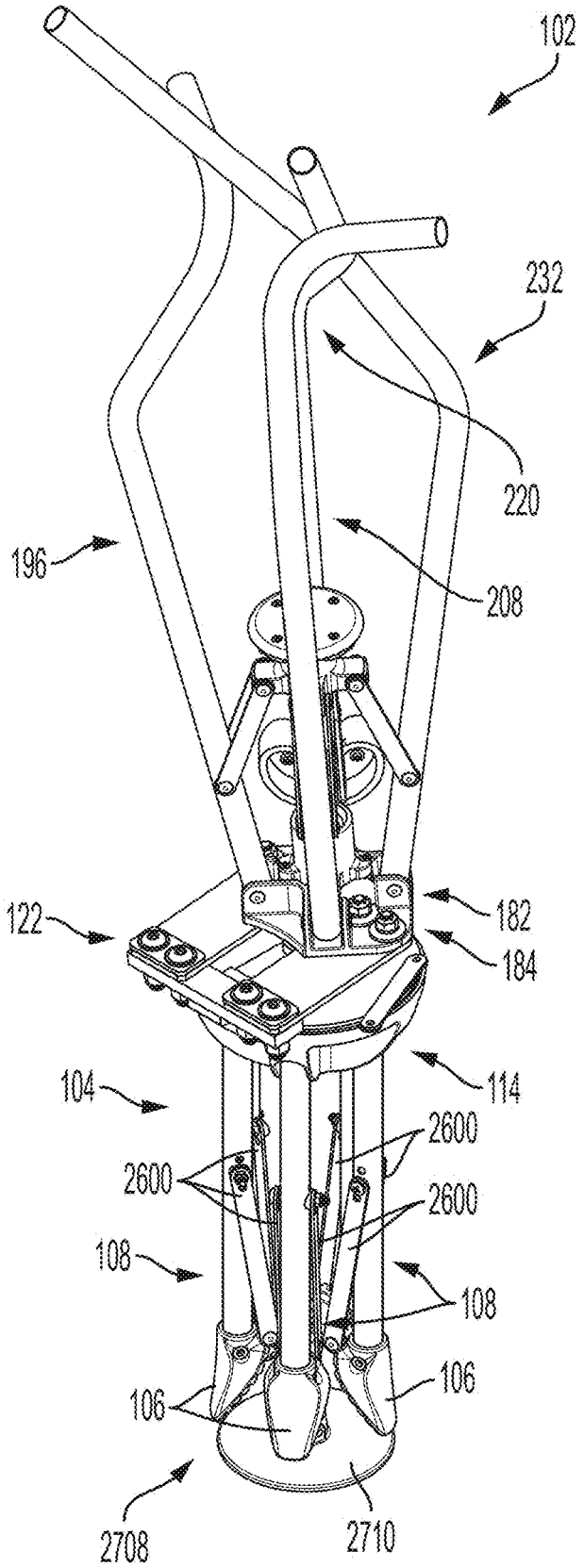
FIG. 36 is a perspective view of the chair assembly in the collapsed state.
Figure 37:
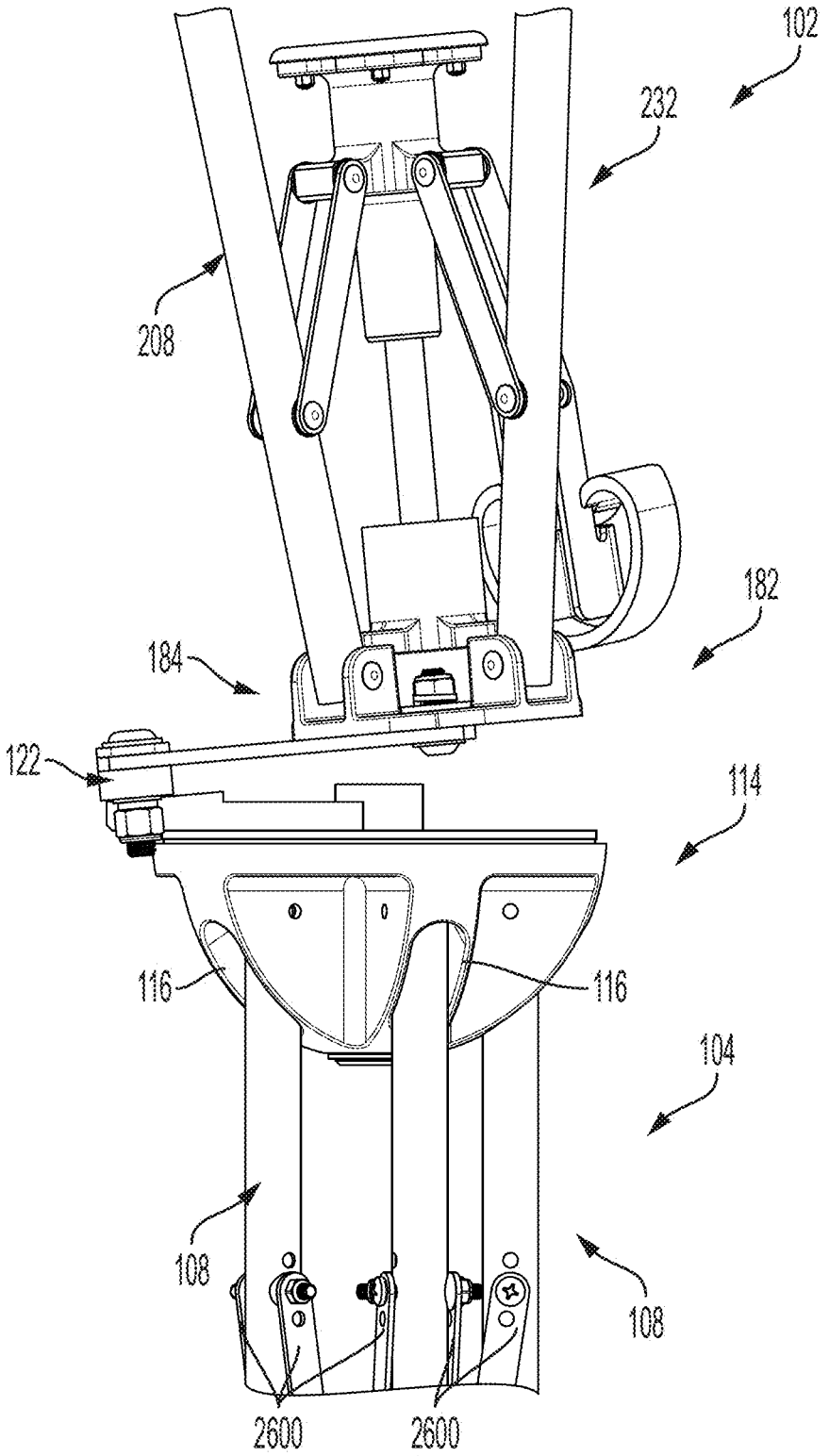
FIG. 37 is a side view of a portion of the chair assembly in the collapsed state.
Figure 38:
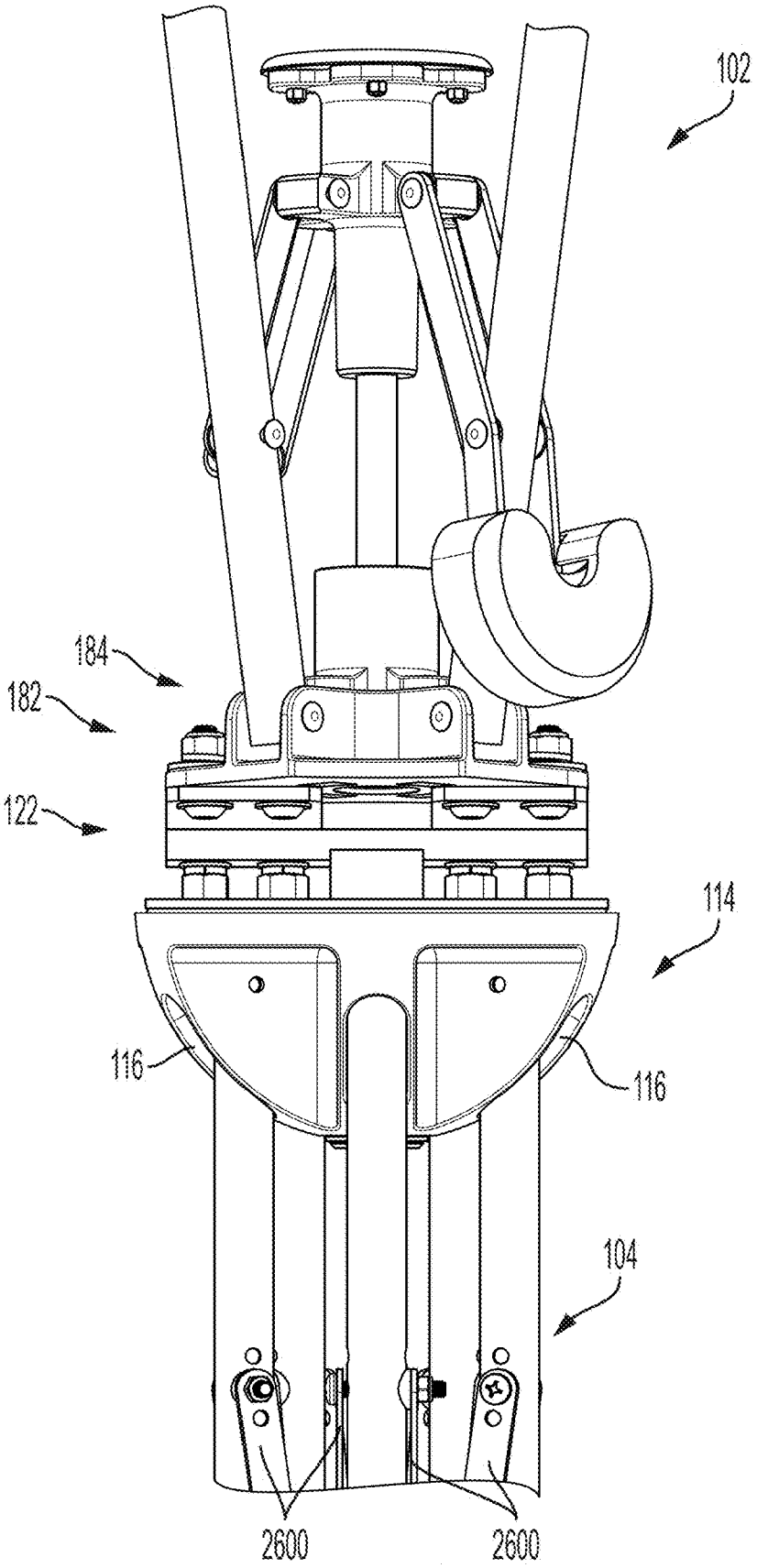
FIG. 38 is a rear view of a portion of the chair assembly in the collapsed state.
Figure 39:
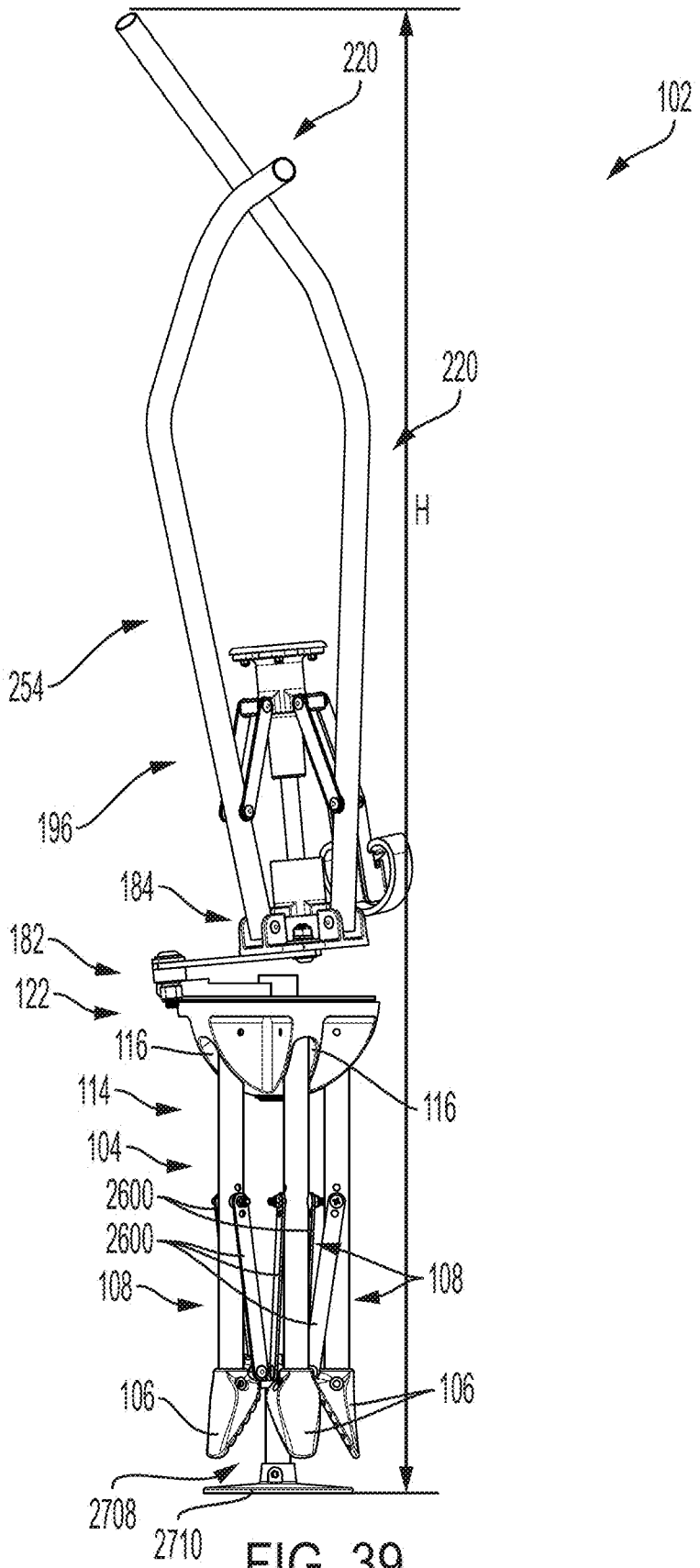
FIG. 39 is a side view of the chair assembly in the collapsed state.
Figure 40:
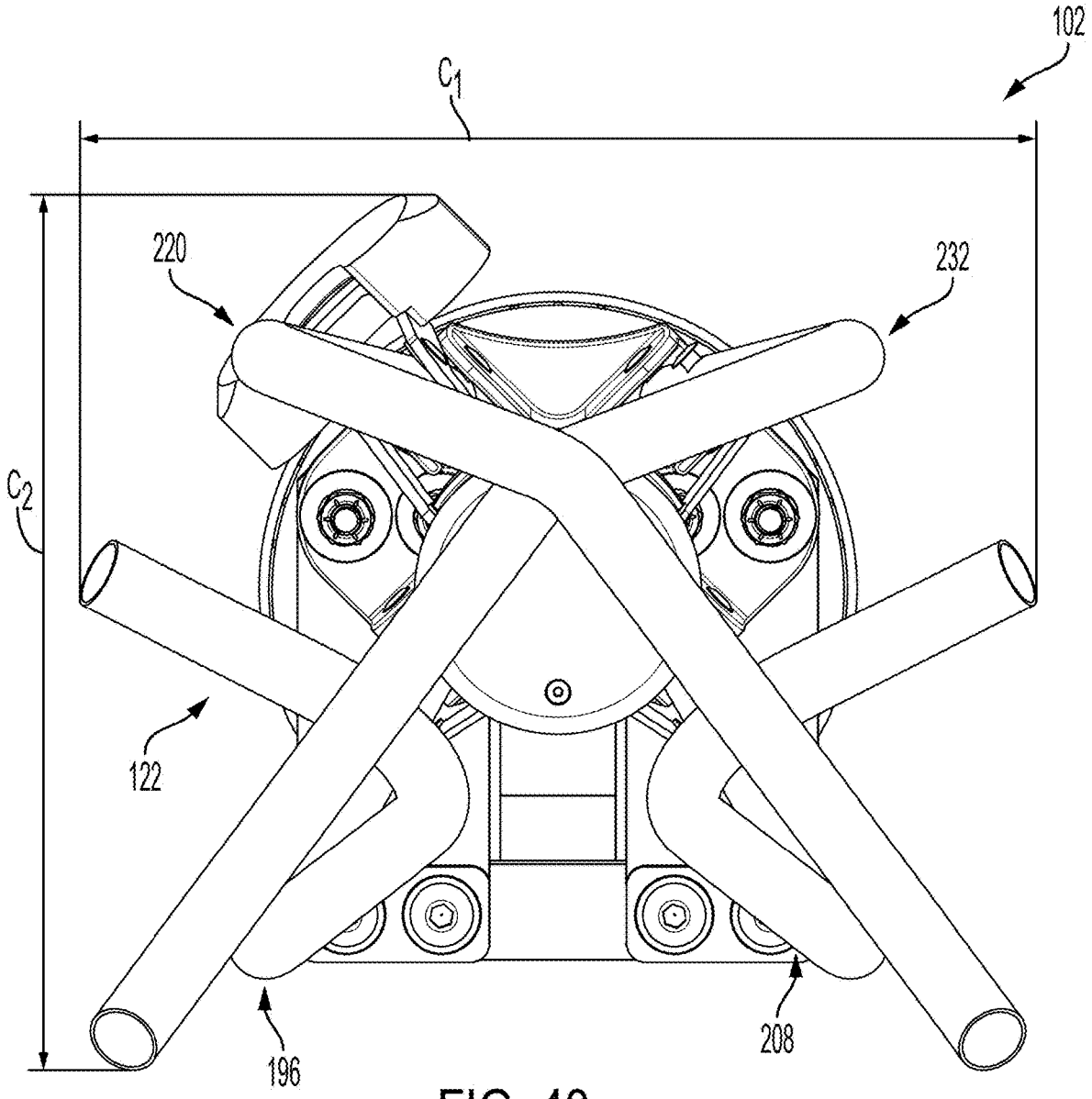
FIG. 40 is a top view of the chair assembly in the collapsed state.
Figure 41:
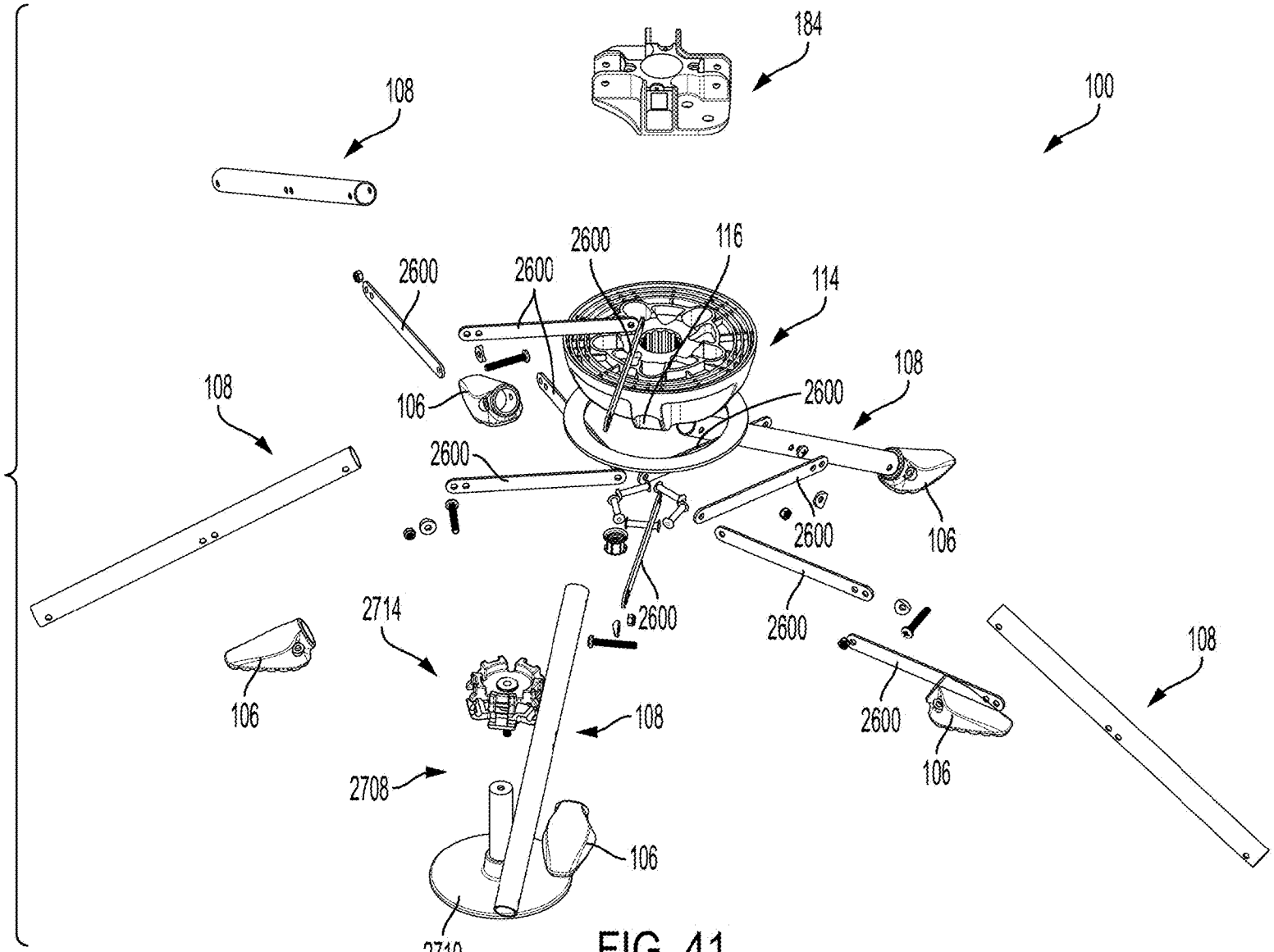
FIG. 41 is an exploded view of a portion of a frame assembly of the chair assembly.
Figure 42:
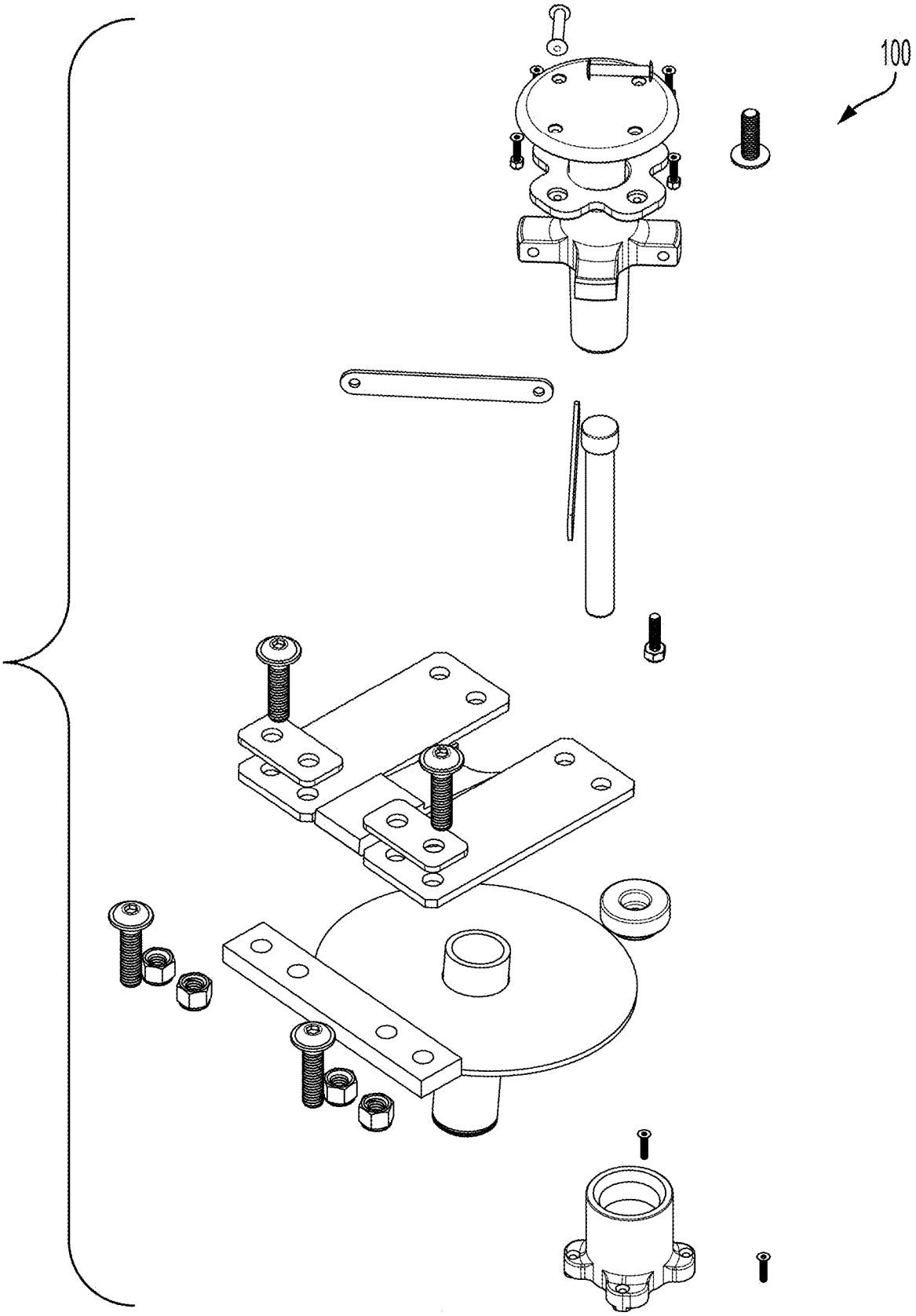
FIG. 42 is an exploded view of another portion of the frame assembly.
Figure 43:
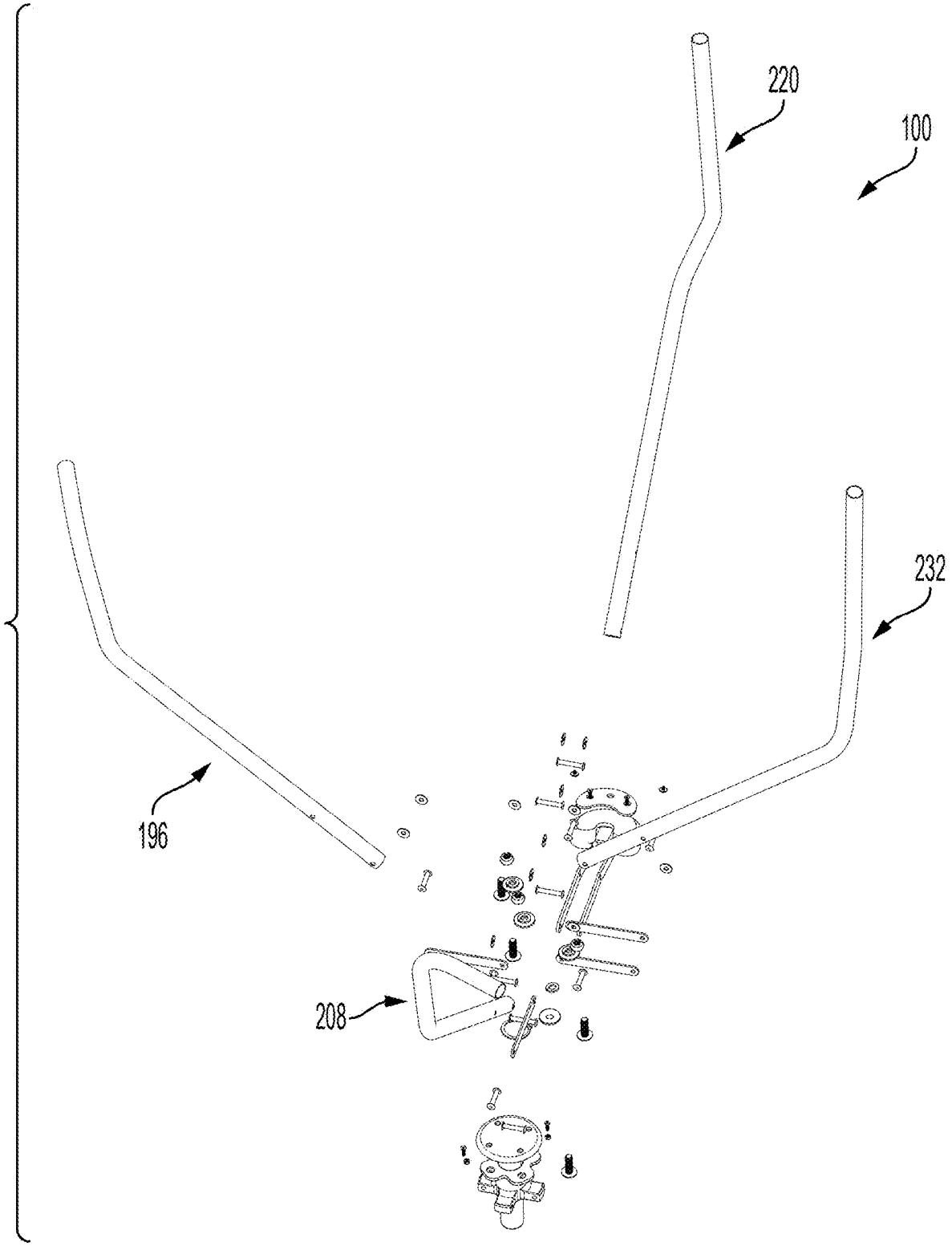
FIG. 43 is an exploded view of another portion of the frame assembly.

As shown in FIG. 29, the center post base 2714 includes a plurality of center post base couplers 2716. Each of the center post base couplers 2716 is associated with one of the legs 108. Two of the leg links 2600 are coupled to each of the center post base couplers 2716 via fasteners 2718 (e.g., screws, etc.).

When the chair assembly 100 is in the expanded state, the center post base 2714 is held against the base mount 114. Specifically, the center post base couplers 2716 are held against the base mount 114 around the base couplers 116. Additionally, a portion (e.g., center portion, etc.) of the center post base 2714 between the base couplers 116 may be held against a portion (e.g., a center portion, etc.) of the base mount 114.

Force from a user may be transferred to the base mount 114, thereby spreading the legs 108 and causing the center post base 2714 to be drawn upward and against the base mount 114. Simultaneously, the center foot 2710 and post 2712 transfer force from the ground surface to the center post base 2714, thereby holding the center post base 2174 against the base mount 114.

In various embodiments, the post 2712 is not collapsible and is instead of a fixed length. This configuration of the post 2712 may decrease a cost associated with the center post assembly 2708, thereby making the chair assembly 100 more desirable. Moreover, the fixed length may be desirable because a user does not need to collapse and expand the post 2712 when transitioning the chair assembly 100 between the collapsed state and the expanded state. This simplification of use may make the chair assembly 100 more desirable than other chairs.

Figure 28:
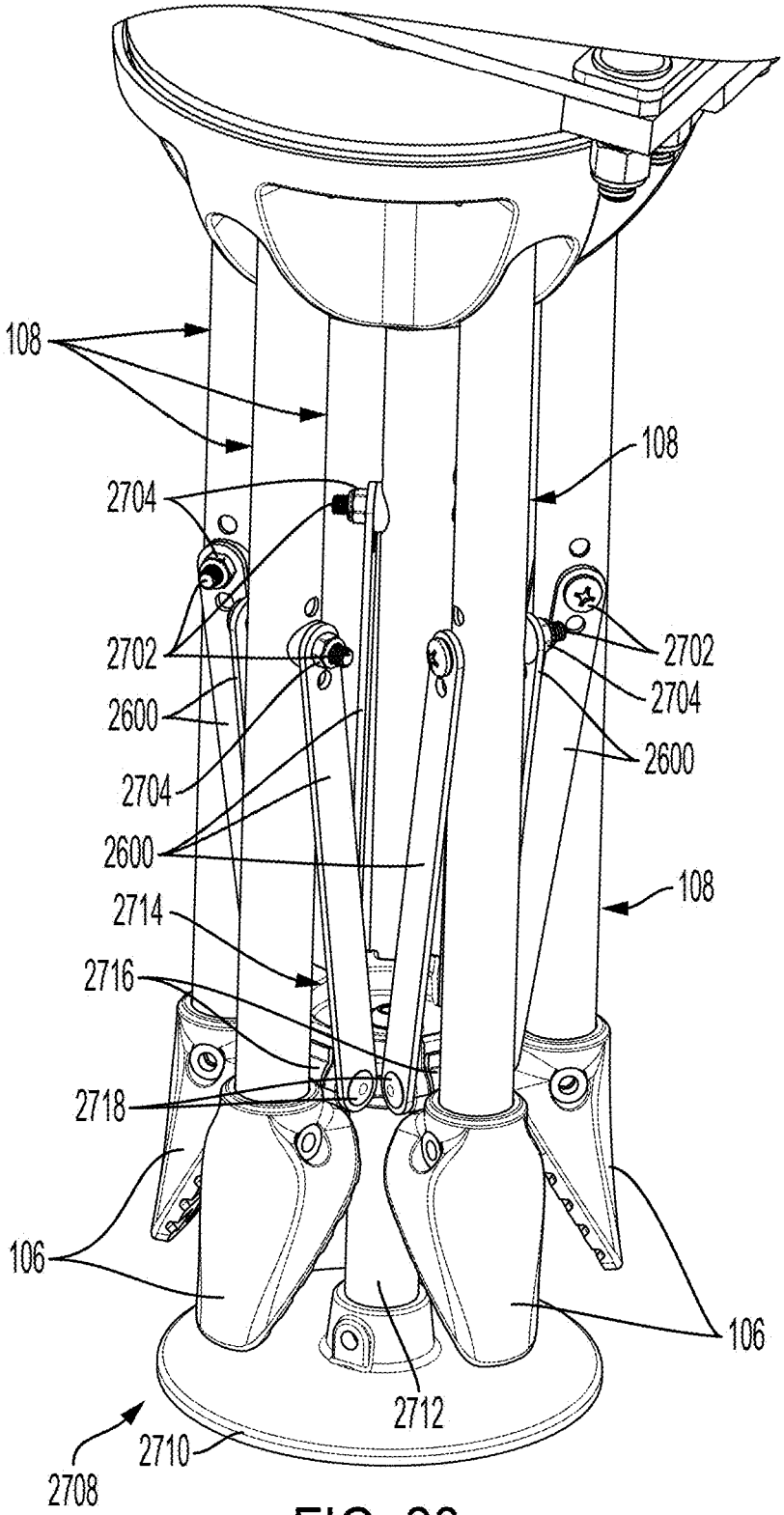
FIG. 28 is a bottom perspective view of a portion of the chair assembly in a collapsed state.

FIG. 28 illustrates the chair assembly 100 in the collapsed state. As shown, the center foot 2710 is positioned below each of the feet 106. As a result, the center post assembly 2708 is capable of providing additional support when in the expanded state (e.g., via the center foot 2710) without significantly increasing the space claim of the chair assembly 100 in the collapsed state. This enables the size of a packaging of the chair assembly 100 in the collapsed state to be as small as possible, which increases desirability of the chair assembly 100 relative to other chairs.

The chair assembly 100 does not include the latch plate 262. Similarly, the frame plate 184 does not include the latch flange 242, and the seat assembly 182 does not include the latch 244. Instead, the seat assembly 182 includes an upper base 2720. The upper base 2720 is coupled to the frame plate 184 between the first arm support 194, the second arm support 206, the first back support 218, and the second back support 230. For example, the upper base 2720 may include four upper base couplers, each of which is positioned in and coupled to one of the first arm joint coupler 192, the second arm joint coupler 205, the first back joint coupler 216, or the second back joint coupler 229.

The upper base 2720 includes an upper base aperture 2722 (e.g., hole, etc.). As explained in more detail below, the upper base aperture 2722 facilitates collapsing and expansion of the chair assembly 100. Rather than the latch plate 262, the seat assembly 182 includes an upper plate 2724.

The seat assembly 182 also includes a translation assembly 2728 (e.g., damper, telescopic assembly, etc.). The translation assembly 2726 transitions between an expanded state, when the chair assembly 100 is in the collapsed state, and a collapsed state, when the chair assembly 100 is in the expanded state. In various embodiments, the translation assembly 2726 provides dampening (e.g., resistance, etc.) between the expanded state and the collapsed state. As explained below, the translation assembly 2728 provides alignment between the upper plate 2724 and the upper base 2720, thereby ensuring repeated desirable transitioning of the chair assembly 100 between the collapsed state and the expanded state.

The translation assembly 2728 includes a translation receiver 2730 that is coupled to the upper plate 2724. The translation receiver 2730 is cylindrical in various embodiments. The translation receiver 2730 may be received within an aperture in the upper plate 2724. The translation receiver 2730 is configured to be received within the upper base aperture 2722. When the chair assembly 100 is in the collapsed state, the translation receiver 2730 is not received within the upper base aperture 2722 and is instead positioned above the upper base aperture 2722. When the chair assembly 100 is in the expanded state, the translation receiver 2730 is positioned within the upper base aperture 2722. An interaction between the translation receiver 2730 and the upper base aperture 2722 retains the upper plate 2724 relative to frame plate 184, and therefore retains the first arm assembly 196, the second arm assembly 208, the first back assembly 220, and the second back assembly 232 relative to the legs 108.

The translation assembly 2728 also includes a translation insert 2732. The translation insert 2732 is coupled to the translation receiver 2730 and to the upper base 2720 within the upper base aperture 2722. The translation insert 2732 is selectively repositionable within the translation receiver 2730. Translation of the translation insert 2732 relative to the translation receiver 2730 may be resisted (e.g., via a spring, via a fluid, etc.).

In various embodiments, the seat assembly 182 also includes a button cap 2733. The button cap 2733 is coupled to the upper plate 2724 and is positioned between the upper plate 2724 and the cover 2510.

Similar to the latch plate 262, the upper plate 2724 is coupled to at least some of the first arm assembly 196, the second arm assembly 208, the first back assembly 220, or the second back assembly 232 via plurality of links 2734. The frame assembly 102 also includes a lever assembly 2736 (e.g., arm, etc.) (one of the links 2734 coupled to the second back assembly 232 is hidden in FIG. 44). The lever assembly 2736 is operated by a user to transition the chair assembly 100 between the expanded state and the collapsed state.

Figure 44:
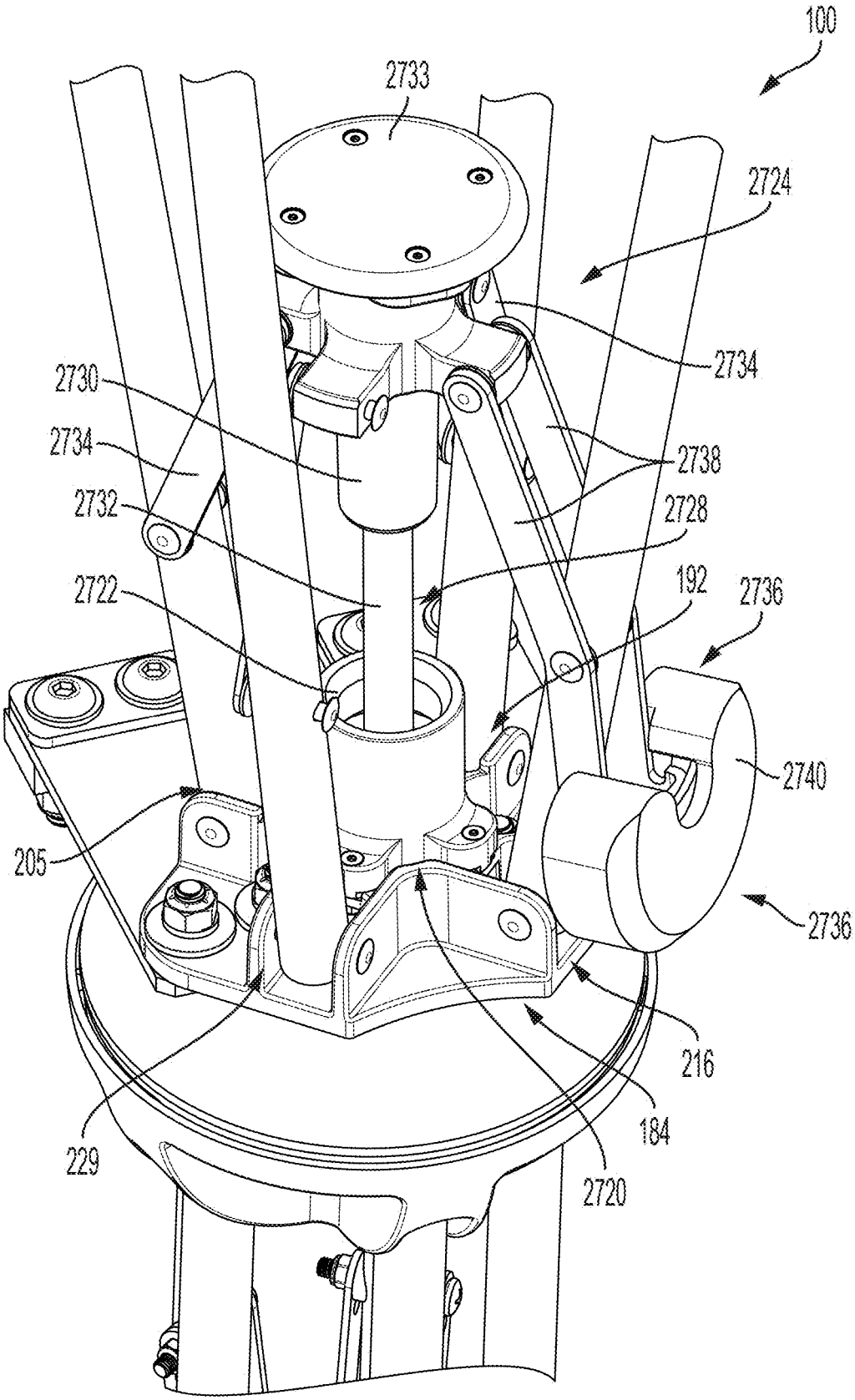
FIG. 44 is a top perspective view of a portion of the chair assembly in the collapsed state.
Figure 45:
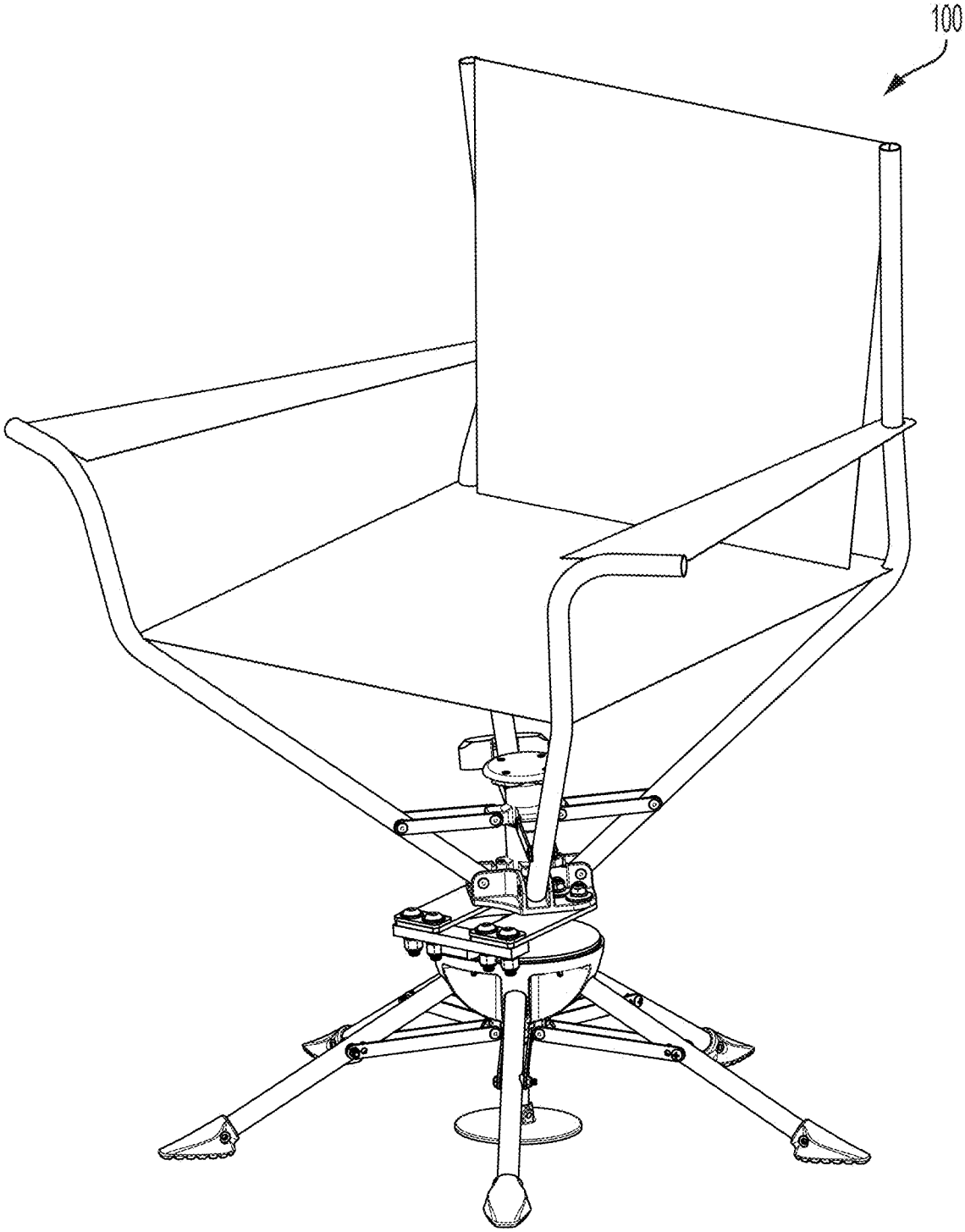
FIG. 45 is another perspective view of the chair assembly in the expanded state.

The lever assembly 2736 includes lever links 2738 that are coupled to one of the first arm assembly 196, the second arm assembly 208, the first back assembly 220, or the second back assembly 232. As shown in FIG. 44, the lever links 2738 are coupled to the first back assembly 220. The lever links 2738 are similar to the links 2734 but extend outward and past the first back assembly 220. The lever assembly 2736 also includes a handle 2740. The handle 2740 is coupled to each of the lever links 2738. The lever links 2738 are coupled to the upper plate 2724 and the first back assembly 220 such that the handle 2740 is repositionable relative to the first back assembly 220. Movement of the handle 2740 relative to the first back assembly 220 causes corresponding movement of the upper plate 2724 relative to the first back assembly 220. As a result, a user can manipulate the handle 2740 to cause the upper plate 2724 to be drawn upwards, thereby facilitating transitioning of the chair assembly 100 from the expanded state to the collapsed state.

III. Third Example Chair Assembly

FIGS. 46-53 illustrate the chair assembly 100 according to various embodiments. The chair assembly 100 shown in FIGS. 46-53 is similar to the chair assembly 100 shown in FIGS. 1-45 unless otherwise indicated to the contrary. Features of the chair assemblies 100 shown in FIGS. 1-45 may be present in the chair assembly 100 shown in FIGS. 46-53, and features of the chair assembly 100 shown in FIGS. 46-53 may be present in the chair assemblies 100 shown in FIGS. 1-45.

Figure 46:
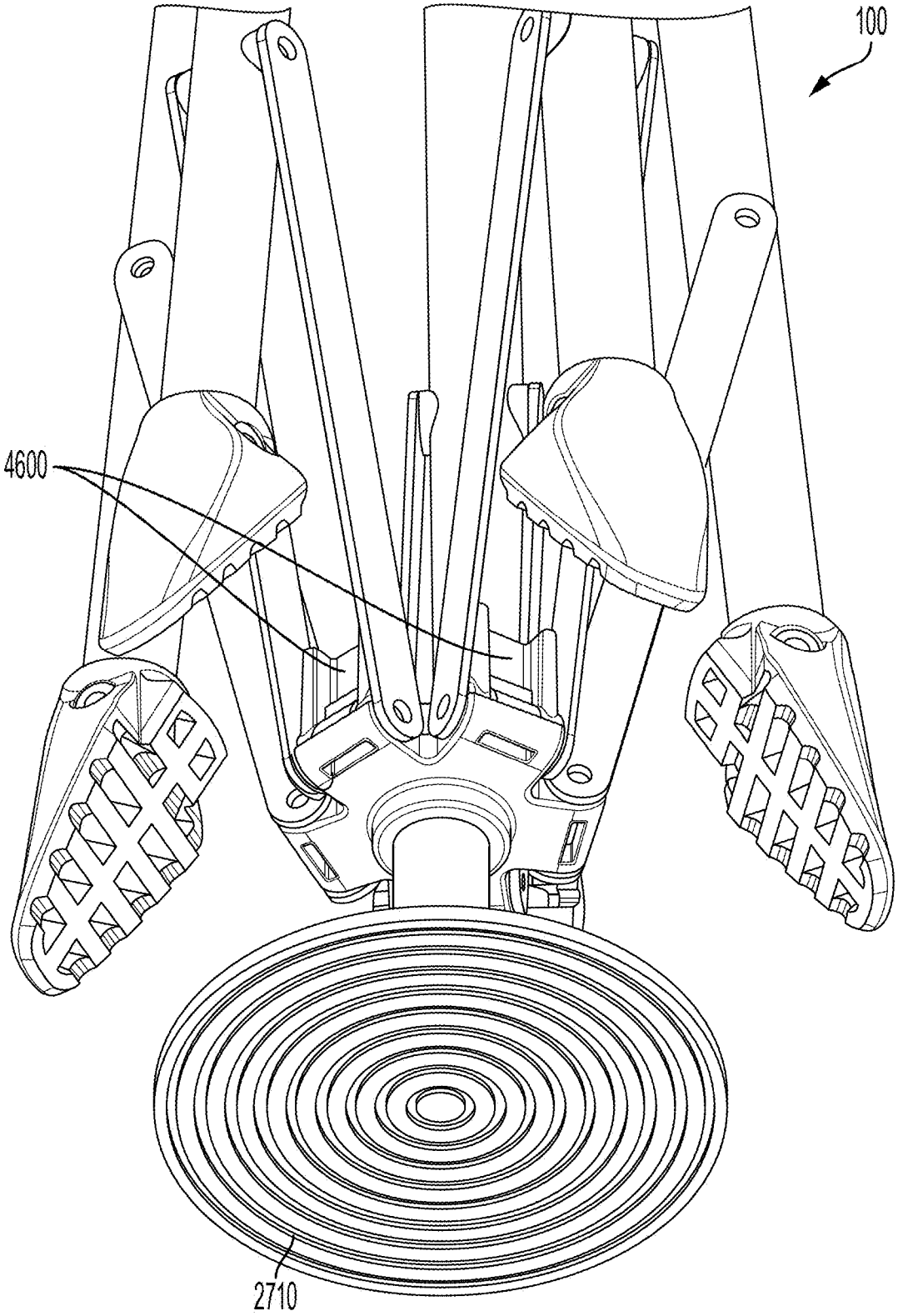
FIG. 46 is another perspective view of a portion the chair assembly in the collapsed state.
Figure 49:
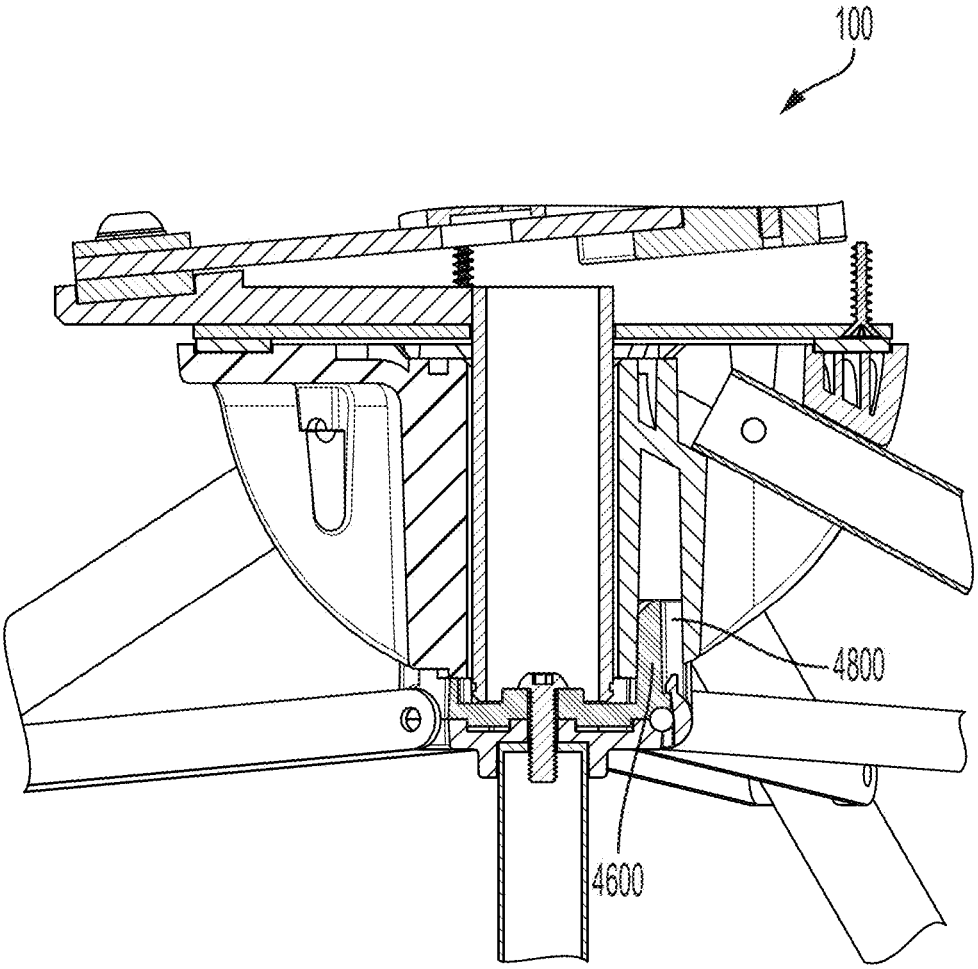
FIG. 49 is a cross-sectional view of a portion of the chair assembly in the expanded state.

FIG. 46 illustrates the center post base 2714 as including a plurality of center post base inserts 4600 (e.g., projections, etc.). Each of the center post base inserts 4600 extends upwardly from one of the center post base couplers 2716. The center post base inserts 4600 couple the center post base 2714 to the base mount 114 by being received in corresponding slots 4800 in the base mount 114, as shown in FIG. 49. The center post base inserts 4600 cooperate with the slots 4800 to resist rotation of the legs 108 relative to the base mount 114 when the chair assembly 100 is in the expanded state. This interaction provides additional rigidity and stability to the chair assembly 100 in the expanded state.

Figure 47:
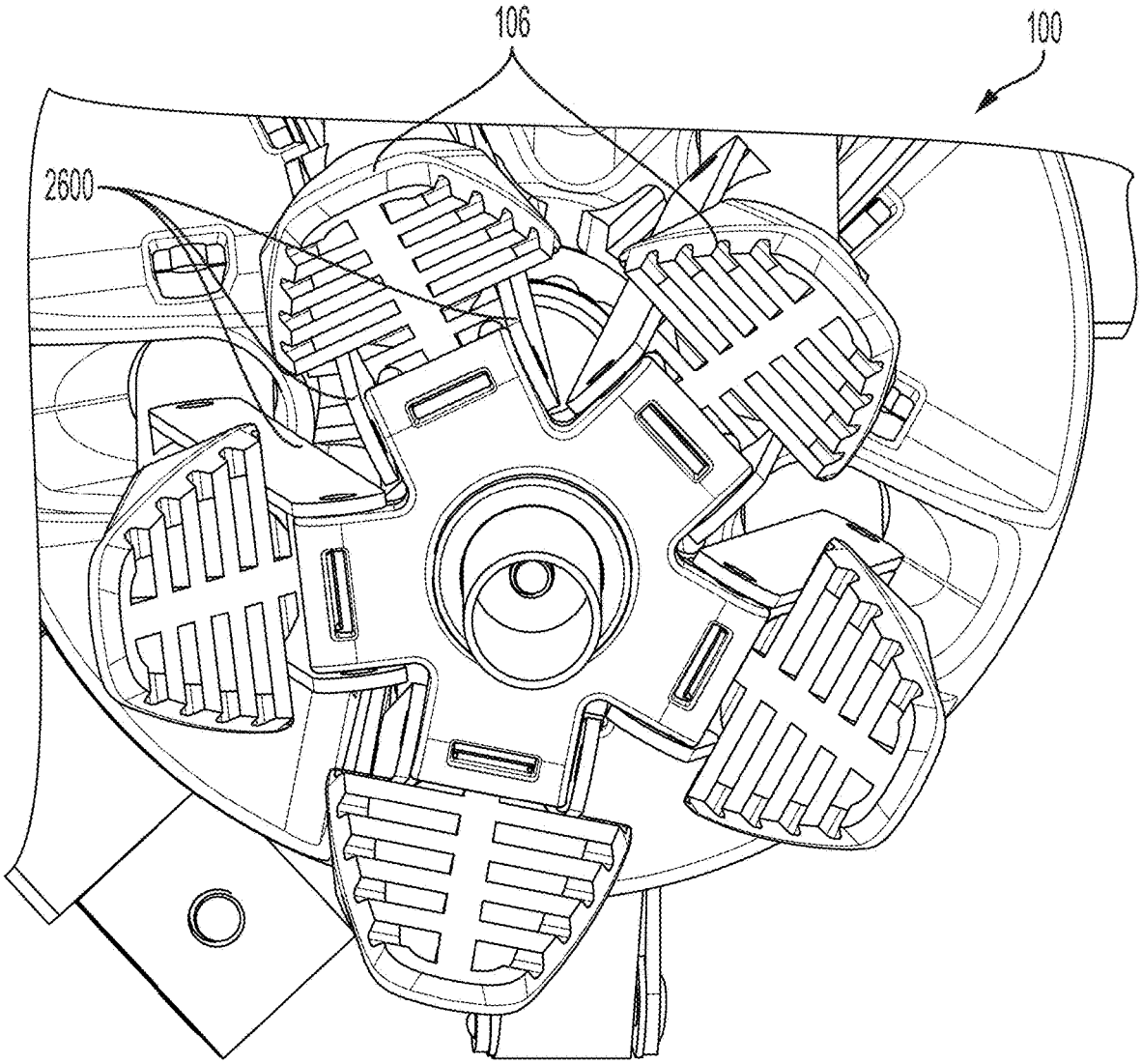
FIG. 47 is another perspective view of a portion the chair assembly in the collapsed state with a center foot hidden.
Figure 48:
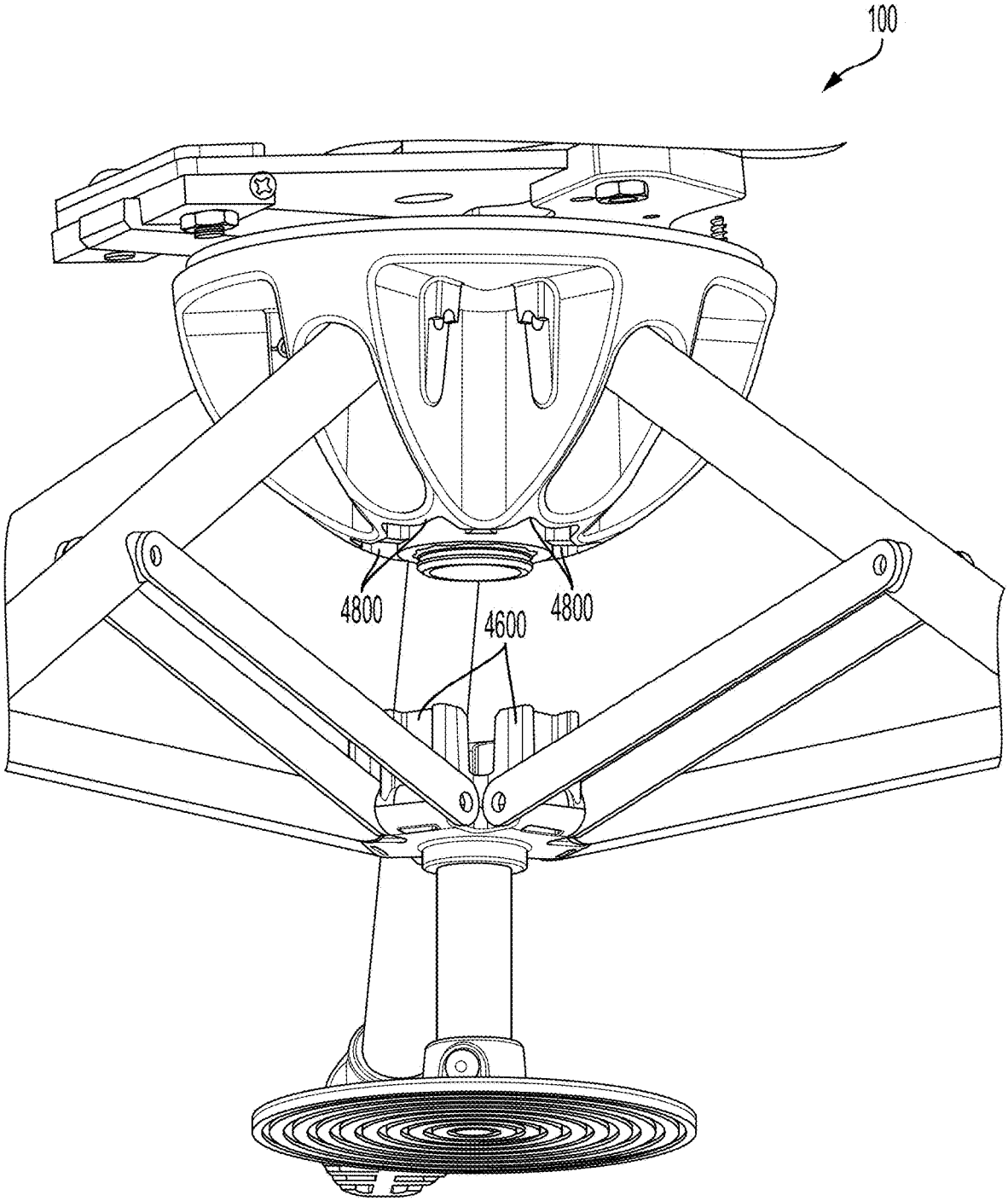
FIG. 48 is a side perspective view of a portion of the chair assembly between the collapsed state and the expanded state.

As shown in FIG. 47, where the center foot 2710 is hidden, the leg links 2600 and feet 106 are configured such that the feet 106 nest within the leg links 2600 and against the center post base couplers 2716. This arrangement minimizes a footprint of the chair assembly 100 in the collapsed state.

Figure 50:
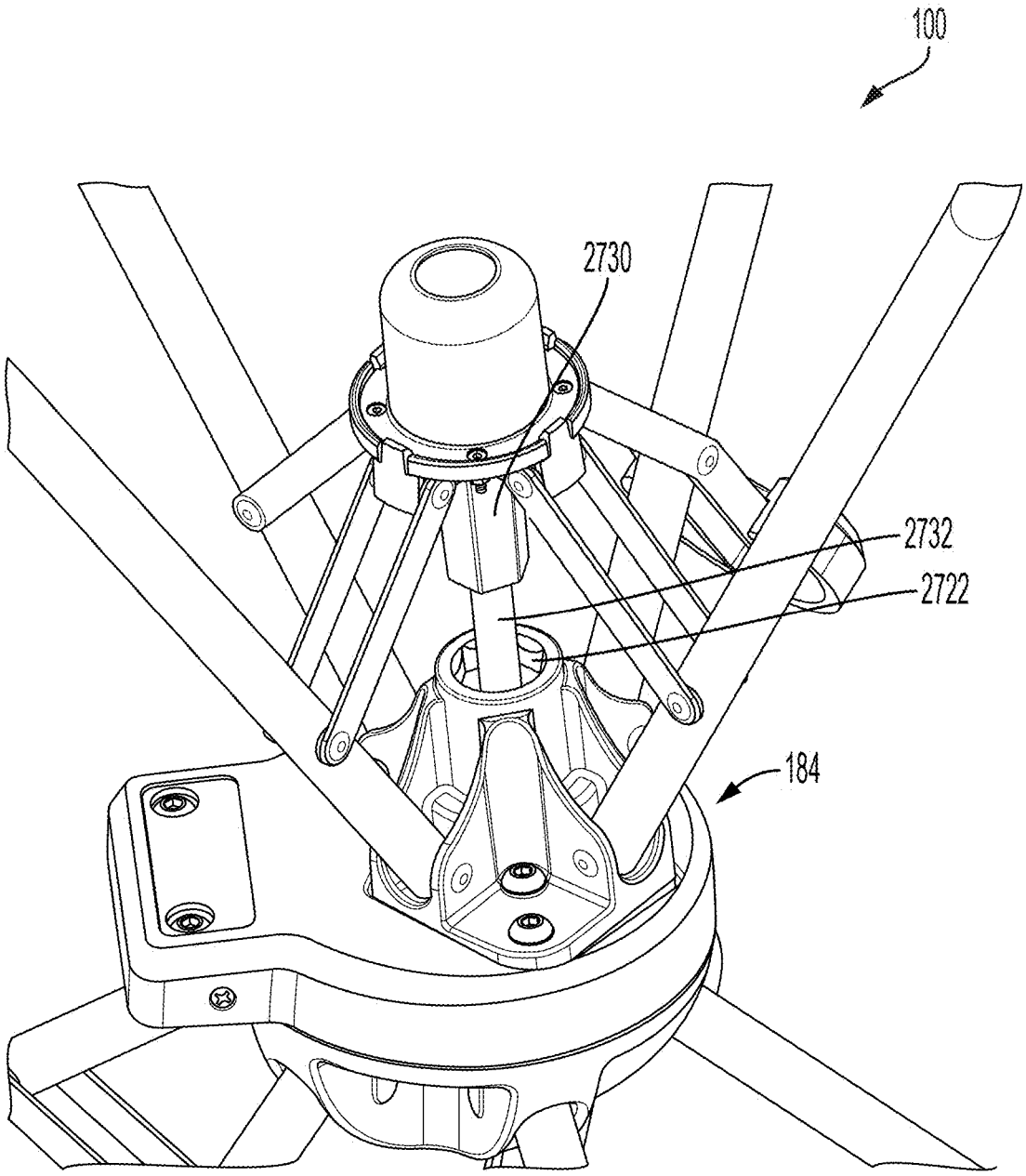
FIG. 50 is a top perspective view of a portion of the chair assembly between the collapsed state and the expanded state.

FIG. 50 illustrates the translation receiver 2730 being hexagonal in shape and the upper base aperture 2722 being hexagonal in shape. As a result, the translation receiver 2730 and the upper base aperture 2722 rotationally lock when the chair assembly 100 is in the expanded state. This interaction provides additional rigidity and stability to the chair assembly 100 in the expanded state by minimizing sway, over-center wobble, and undesirable rotation.

Figure 51:
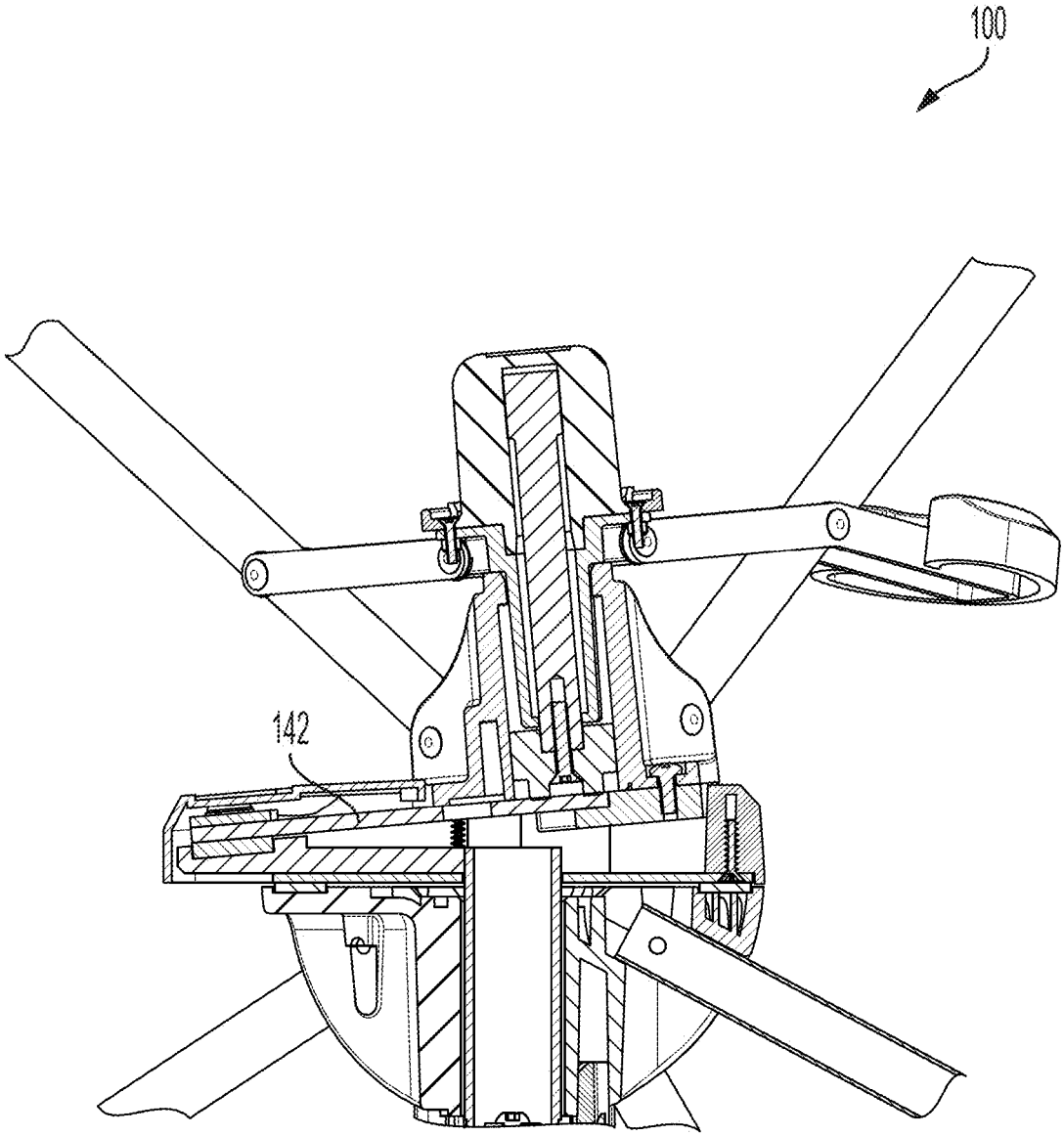
FIG. 51 is a cross-sectional view of a portion of the chair assembly in the expanded state.
Figure 52:
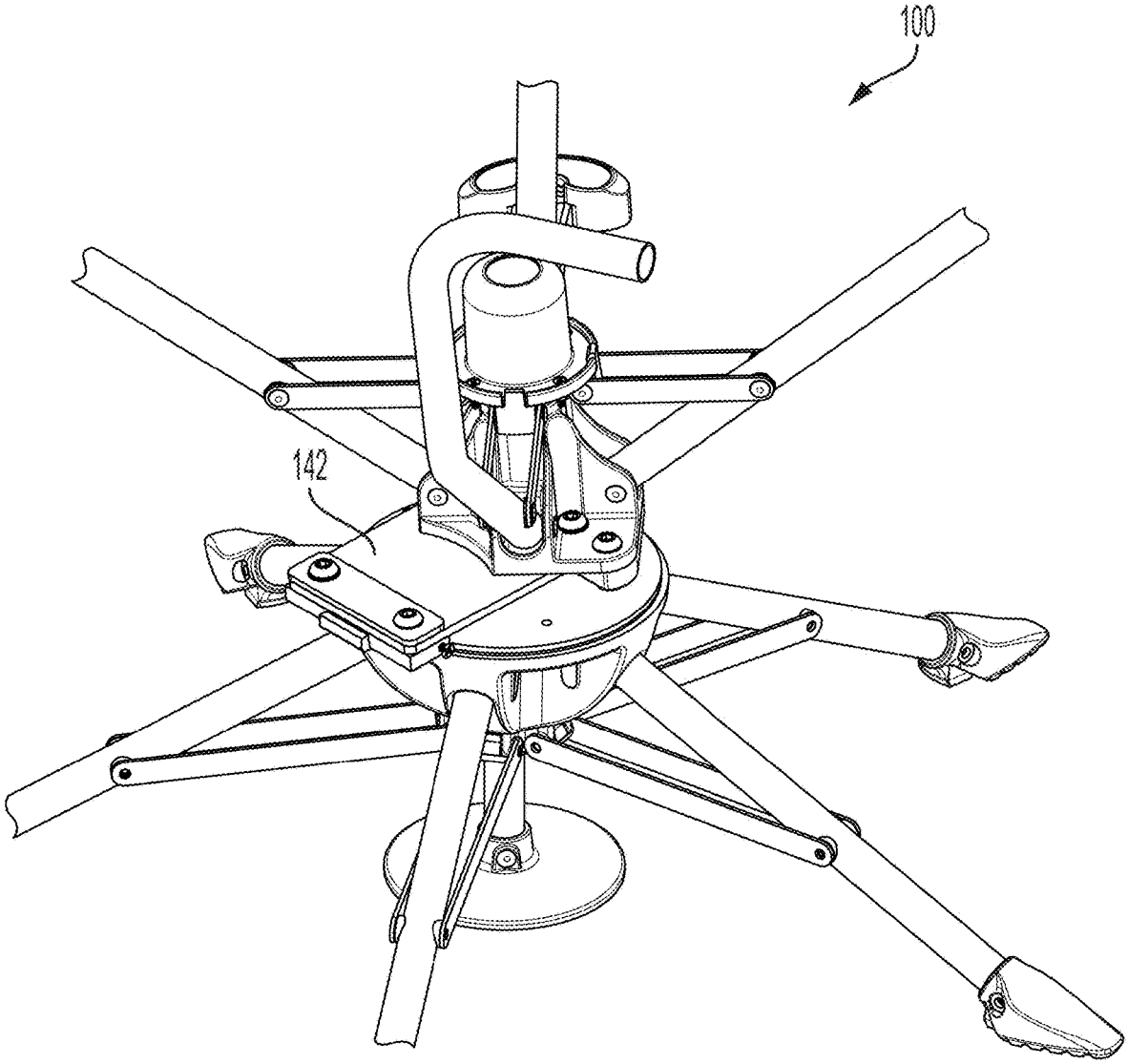
FIG. 52 is a top perspective view of a portion of the chair assembly in the expanded state.
Figure 53:
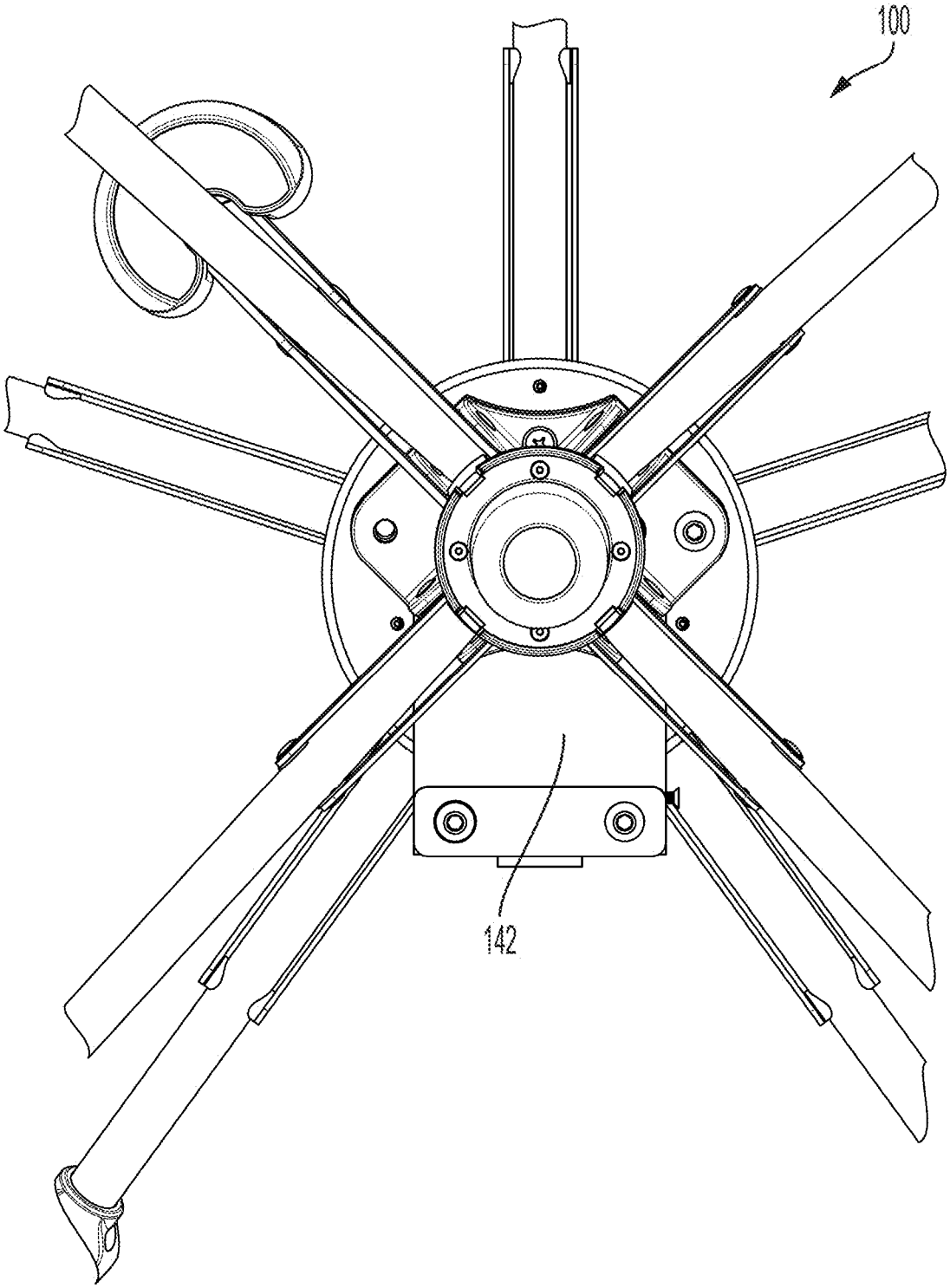
FIG. 53 is a top view of a portion of the chair assembly in the expanded state.

FIGS. 51-53 illustrate the chair assembly 100 without the second deflection plate 158. In other words, the chair assembly 100 only includes a single deflection plate (the first deflection plate 142). Such an arrangement may minimize a footprint of the chair assembly 100.

IV. Construction of Example Embodiments

While this specification contains many specific implementation details, these should not be construed as limitations on the scope of what may be claimed but rather as descriptions of features specific to particular implementations. Certain features described in this specification in the context of separate implementations can also be implemented in combination in a single implementation. Conversely, various features described in the context of a single implementation can also be implemented in multiple implementations separately or in any suitable subcombination. Moreover, although features may be described as acting in certain combinations and even initially claimed as such, one or more features from a claimed combination can, in some cases, be excised from the combination, and the claimed combination may be directed to a subcombination or variation of a subcombination.

As utilized herein, the terms "approximately," "generally," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

The term "coupled" and the like, as used herein, mean the joining of two components directly or indirectly to one another. Such joining may be stationary (e.g., permanent) or moveable (e.g., removable or releasable). Such joining may be achieved with the two components or the two components and any additional intermediate components being integrally formed as a single unitary body with one another, with the two components, or with the two components and any additional intermediate components being attached to one another.

It is important to note that the construction and arrangement of the various systems shown in the various example implementations is illustrative only and not restrictive in character. All changes and modifications that come within the spirit and/or scope of the described implementations are desired to be protected. It should be understood that some features may not be necessary, and implementations lacking the various features may be contemplated as within the scope of the disclosure, the scope being defined by the claims that follow. When the language "a portion" is used, the item can include a portion and/or the entire item unless specifically stated to the contrary.

Also, the term "or" is used, in the context of a list of elements, in its inclusive sense (and not in its exclusive sense) so that when used to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, Z, X and Y, X and Z, Y and Z, or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

Additionally, the use of ranges of values (e.g., W1 to W2, etc.) herein are inclusive of their maximum values and minimum values (e.g., W1 to W2 includes W1 and includes W2, etc.), unless otherwise indicated. Furthermore, a range of values (e.g., W1 to W2, etc.) does not necessarily require the inclusion of intermediate values within the range of values (e.g., W1 to W2 can include only W1 and W2, etc.), unless otherwise indicated.

What is claimed is:

1. A frame assembly for a chair assembly, the frame assembly comprising:
- a base assembly comprising:
  - a first leg, and
  - a base mount including a mounting aperture and a first base coupler, the first base coupler coupled to the first leg and facilitating rotation of the first leg;
- a joint assembly comprising:
  - a joint mount including a mounting post inserted within the mounting aperture,
  - a mounting arm including a support arm coupled to the joint mount and a suspension arm coupled to the support arm, and
  - a first deflection plate coupled to the suspension arm and extending over the joint mount; and
- a seat assembly comprising:
  - a frame plate coupled to the first deflection plate,
  - a first arm assembly coupled to the frame plate,
  - a second arm assembly coupled to the frame plate,
  - a first back assembly coupled to the frame plate, and
  - a second back assembly coupled to the frame plate.

2. The frame assembly of claim 1, wherein the seat assembly further comprises:
- an upper plate;
- a first arm first link coupled to the first arm assembly and the upper plate; and
- a first back first link coupled to the first back assembly and the upper plate.

3. The frame assembly of claim 2, wherein the seat assembly further comprises:
- a second arm first link coupled to the second arm assembly and the upper plate; and
- a second back first link coupled to the second back assembly and the upper plate.

4. The frame assembly of claim 2, wherein:
- the seat assembly further comprises:
  - an upper base coupled to the frame plate, and
  - a translation assembly comprising:
    - a translation receiver coupled to the upper plate, and
    - a translation insert coupled to the upper base and the translation receiver; and
- the translation receiver and the translation insert cooperate to facilitate translation of the upper plate relative to the upper base.

5. The frame assembly of claim 4, further comprising a lever assembly comprising:
- a lever link coupled to the upper plate and one of the first arm assembly, the second arm assembly, the first back assembly, or the second back assembly; and
- a handle coupled to the lever link;
- wherein the lever link cooperates with the one of the first arm assembly, the second arm assembly, the first back assembly, or the second back assembly to facilitate translation of the upper plate relative to the upper base.

6. The frame assembly of claim 1, wherein:
- the first arm assembly comprises a first arm base;
- the first back assembly comprises a first back base; and
- the frame plate comprises:
  - a first arm joint coupler coupled to the first arm base and facilitating rotation of the first arm base, and
  - a first back joint coupler coupled to the first back base and facilitating rotation of the first back base independent of the first arm base.

7. The frame assembly of claim 6, wherein:
the second arm assembly comprises a second arm base;
the second back assembly comprises a second back base; and
the frame plate further comprises:
a second arm joint coupler coupled to the second arm base and facilitating rotation of the second arm base, and
a second back joint coupler coupled to the second back base and facilitating rotation of the second back base independent of the second arm base.

8. The frame assembly of claim 1, wherein:
the base assembly further comprises a second leg; and
the base mount further includes a second base coupler, the second base coupler coupled to the second leg and facilitating rotation of the second leg independent of the first leg.

9. The frame assembly of claim 8, wherein:
the base assembly further comprises:
a center post assembly comprising:
a center post base,
a center post coupled to the center post base, and
a center foot coupled to the center post,
a first leg link coupled to the first leg and the center post base, and
a second leg link coupled to the second leg and the center post base; and
the first leg link and the second leg link cooperate to facilitate translation of the center post base relative to the base mount.

10. A chair assembly comprising:
the frame assembly of claim 1; and
a cover coupled to the first arm assembly, the second arm assembly, the first back assembly, and the second back assembly.

11. The chair assembly of claim 10, wherein:
the first back assembly comprises:
a first back base coupled to the frame plate, the first back base comprising:
a first back base joint aperture, and
a first back base latch aperture, and
a first back frame coupled to the first back base, the first back frame comprising:
a first back frame joint aperture, and
a first back frame latch aperture; and
the seat assembly further comprises:
a first back joint fastener extending through the first back base joint aperture and the first back frame joint aperture, and
a first back latch fastener extending through the first back base latch aperture and the first back frame latch aperture.

12. A chair assembly comprising:
a frame assembly comprising:
a joint assembly comprising:
a joint mount,
a mounting arm including a support arm coupled to the joint mount and a suspension arm coupled to the support arm, and
a deflection plate coupled to the suspension arm and extending over the joint mount, and
a seat assembly comprising:
a frame plate coupled to the deflection plate, the frame plate including a first arm joint coupler, a second arm joint coupler, a first back joint coupler, and a second back joint coupler,
a first arm assembly coupled to the first arm joint coupler and rotatable relative to the frame plate,
a second arm assembly coupled to the second arm joint coupler and rotatable relative to the frame plate,
a first back assembly coupled to the first back joint coupler and rotatable relative to the frame plate, and
a second back assembly coupled to the second back joint coupler and rotatable relative to the frame plate; and
a cover coupled to the first arm assembly, the second arm assembly, the first back assembly, and the second back assembly.

13. The chair assembly of claim 12, wherein the seat assembly further comprises:
an upper plate;
a first arm first link coupled to the first arm assembly and the upper plate; and
a first back first link coupled to the first back assembly and the upper plate.

14. The chair assembly of claim 13, wherein the seat assembly further comprises:
a second arm first link coupled to the second arm assembly and the upper plate; and
a second back first link coupled to the second back assembly and the upper plate.

15. The chair assembly of claim 13, wherein:
the seat assembly further comprises:
an upper base coupled to the frame plate, and
a translation assembly comprising:
a translation receiver coupled to the upper plate, and
a translation insert coupled to the upper base and the translation receiver; and
the translation receiver and the translation insert cooperate to facilitate translation of the upper plate relative to the upper base.

16. The chair assembly of claim 12, wherein:
the chair assembly is operable between a collapsed state and an expanded state; and
the cover is configured to define a seat when the chair assembly is in the expanded state.

17. The chair assembly of claim 16, wherein the deflection plate is configured to deflect in response to rocking of a user in the seat when the chair assembly is in the expanded state.

18. The chair assembly of claim 12, wherein:
the first back assembly comprises:
a first back base coupled to the frame plate, the first back base comprising:
a first back base joint aperture, and
a first back base latch aperture, and
a first back frame coupled to the first back base, the first back frame comprising:
a first back frame joint aperture, and
a first back frame latch aperture; and
the seat assembly further comprises:
a first back joint fastener extending through the first back base joint aperture and the first back frame joint aperture, and
a first back latch fastener extending through the first back base latch aperture and the first back frame latch aperture.

19. The chair assembly of claim 18, further comprising a base assembly comprising:
a first leg,
a second leg, and a base mount including a first base coupler and a second base coupler, the first base coupler coupled to the first leg and facilitating rotation of the first leg, the second base coupler coupled to the second leg and facilitating rotation of the second leg;

wherein the base assembly further comprises:

a center post assembly comprising:

a center post base, a center post coupled to the center post base, and a center foot coupled to the center post, a first leg link coupled to the first leg and the center post base, and a second leg link coupled to the second leg and the center post base; and wherein the first leg link and the second leg link cooperate to facilitate translation of the center post base relative to the base mount.

20. The chair assembly of claim 18, wherein:

the seat assembly further comprises an upper plate;

the first back joint fastener couples the first back assembly to the frame plate; and the first back latch fastener couples the first back assembly to the upper plate.

* * * * *